US007179585B2

(12) United States Patent
Okutsu et al.

(10) Patent No.: US 7,179,585 B2
(45) **Date of Patent: *Feb. 20, 2007**

(54) IMAGE FORMING METHOD UTILIZING PHOTOTHERMOGRAPHIC MATERIAL

(75) Inventors: Eiichi Okutsu, Kanagawa (JP); Katsutoshi Yamane, Kanagawa (JP); Yasuhiro Yoshioka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/768,038

(22) Filed: Feb. 2, 2004

(65) Prior Publication Data

US 2004/0152023 A1 Aug. 5, 2004

(30) Foreign Application Priority Data

Feb. 5, 2003 (JP) ..... 2003-028105
Feb. 7, 2003 (JP) ..... 2003-030490

(51) Int. Cl.
*G03C 5/16* (2006.01)
*G03C 1/498* (2006.01)

(52) U.S. Cl. ..... 430/350; 430/619; 430/945; 396/575

(58) Field of Classification Search ..... 430/350, 430/619, 945; 396/575
See application file for complete search history.

(56) References Cited

U.S. PATENT DOCUMENTS 5,041,369 A * 8/1991 Fukui et al. ..... 430/619
6,171,767 B1 1/2001 Kong et al.
6,288,370 B1 9/2001 Ogawa et al.
6,376,166 B1 * 4/2002 Oya et al. ..... 430/619
6,420,102 B1 7/2002 Bauer et al.
6,468,720 B1 10/2002 Hirabayashi et al.
6,524,781 B2 2/2003 Wada
6,649,338 B2 11/2003 Mitsuhashi
6,800,427 B2 * 10/2004 Yamane ..... 430/350
6,814,506 B2 11/2004 Nanami
2003/0215756 A1 * 11/2003 Morita et al. ..... 430/350
2004/0005521 A1 * 1/2004 Kudo ..... 430/527
2004/0038156 A1 * 2/2004 Oyamada et al. ..... 430/350
2004/0058281 A1 * 3/2004 Yamane et al. ..... 430/350

* cited by examiner

*Primary Examiner*—Thorl Chea
(74) *Attorney, Agent, or Firm*—Margaret A. Burke; Sheldon J. Moss

(57) ABSTRACT

The present invention provides an image forming method using an image recording apparatus that includes a laser irradiating means for laser scanning of a photothermographic material that has a support and includes on at least one surface thereof a photosensitive silver halide, a non-photosensitive organic silver salt, a reducing agent and a binder, and a conveying means for guiding the photothermographic material in a sub-scanning direction to a thermal development unit, wherein the reducing agent is a specific bisphenol compound. The invention also provides another image forming method including carrying out thermal development, with an interval time equal to or less than 12 seconds, of the photothermographic material.

7 Claims, 2 Drawing Sheets

IMAGE FORMING METHOD UTILIZING PHOTOTHERMOGRAPHIC MATERIAL

CROSS-REFERENCE TO RELATED APPLICATION

This application claims priority under 35 USC 119 from Japanese Patent Application Nos. 2003-028105 and 2003-030490, the disclosures of which are incorporated by reference herein.

BACKGROUND OF THE INVENTION

1. Field of the Invention

The present invention relates to an image forming method utilizing thermal development. More particularly, the invention relates to an image forming method with satisfactory density and stable color tone of an image even at high-speed continuous processing.

2. Description of the Related Art

In recent years, there has been a strong desire in the medical field to reduce the amount of used processing liquids in consideration of environmental safety and space saving. For this reason, there is a need for a technology in the field of photothermographic material for medical diagnosis and for photographic applications, capable of efficient exposure with a laser image setter or a laser imager and of forming a sharp black image with high resolution and sharpness. Such photothermographic material can eliminate use of processing chemicals in solutions and can provide users with a thermal development system which is simpler and does not pollute the environment.

Although there is a similar need in the field of ordinary image forming materials, an image for medical use requires particularly high image quality excellent in sharpness and granularity since minute image presentation is necessary. Further, an image of cold black tone is preferred in consideration of ease of diagnosis. Currently various hard copy systems utilizing pigments or dyes, such as an ink jet printing system and an electrophotographic system, are available as ordinary image forming systems, but such systems are not satisfactory to be used as medical-use image output systems.

On the other hand, a thermal image forming system utilizing an organic silver salt is disclosed (for example, U.S. Pat. Nos. 3,152,904 and 3,457,075, and "Thermally Processed Silver Systems", D. Klosterboer, Imaging Processes and Materials, Neblette 8th edition, edited by Sturge, V. Walworth and A. Shepp, Chap. 9, p.279(1989)). More specifically, a photothermographic material (hereinafter also called a "photosensitive material") has a photosensitive layer in which a photocatalyst (for example, silver halide) of a catalytic active amount, a reducing agent, a reducible silver salt (for example, organic silver salt) and a toning agent for regulating silver color tone if necessary, are generally dispersed in a matrix binder. After image exposure, the photothermographic material is heated to a high temperature (for example, 80° C. or higher) whereby a black silver image is formed by a redox reaction between the silver halide or reducible silver salt (acting as an oxidizing agent) and the reducing agent. The redox reaction is accelerated by a catalytic effect of a latent image on silver halide, formed by light exposure. Therefore, a black silver image is formed in an exposed area, which is disclosed in various references (refer to, for example, U.S. Pat. No. 2,910,377 and JP-B No. 43-4924). As a medical image forming system based on a photothermographic material utilizing such principles, Fuji Medical Dry Imager FM-DPL has been launched on the market (refer to, for example, Fuji Medical Review No. 8, p.39–p.55 (1999)).

A photothermographic material including a photosensitive silver halide and a non-photosensitive organic silver salt has high sensitivity and is a material suitable as an image recording material for the aforementioned laser output, and applications in such a field are anticipated to further increase hereafter. For expansion of such applications and increase in the process amount, further improvements are required in image recording speed and developing speed, improved adaptability to installation of the apparatus and the environment, and reduction in size of the entire apparatus including an optical system for laser exposure and a thermal development unit.

There has been developed and widely utilized an advanced image recording apparatus integrating a laser exposure unit and a thermal development unit and not requiring water supplying and discharging pipes and an exhaust pipe for discharged gas (refer to, for example, U.S. Pat. Nos. 3,152,904 and 3,457,075, and "Thermally Processed Silver Systems", D. H. Klosterboer, Imaging Processes and Materials, Neblette 8th edition, edited by J. Sturge, V. Walworth and A. Shepp, Chap. 9, p.279(1989)). In such an apparatus, a photothermographic material is at first transported to a laser exposure unit, and after an image data is recorded by scanning exposure, the photothermographic material is guided to a heat development unit for heating to form an image. Thereafter it is cooled and discharged from the apparatus. However, since the laser exposure unit and the thermal development unit are sufficiently separated from each other in order to avoid mutual detrimental influence, the entire apparatus lacks compactness in size and requires a large space for installation.

One way of reducing the size of the total system is to place the laser exposure unit and the thermal development unit closely. Conventionally, the heat development unit is equipped with a heat source for uniform heating at around 120° C., and is formed with a material of high heat capacity at high temperature in order to reduce temperature variation. Furthermore, in order to prevent heat leakage, it is entirely covered with a heat insulating material. However, in order to prevent the temperature in the laser exposure unit from rising caused by heat conduction by a recording material or by heat diffusion by leaking air, the thermal development unit and the laser exposure unit are designed with sufficient mutual distance. The principal object of preventing the temperature increase of the laser exposure unit is to maintain the precision of the optical system. Particularly in the case of photothermographic material, in addition to thermal aberration in the precision of the optical system, another factor is a stain of the optical system by volatile substances generated by heating.

Designing of a photothermographic material with reduced generation of volatile substances under heating, for the purpose of reducing the size of the apparatus, has solved the drawback of stain in the optical system, but another drawback has been newly discovered. In the case of continuously executing exposure and thermal development of the photothermographic material in an apparatus in which a laser exposure unit and a thermal development unit are closely positioned with each other, sensitivity of a first photosensitive material and that of a last (for example, the 20th)

photosensitive material are clearly different. It is beleaved that such a change is generated gradually and continuously, but an apparent difference from the first material is clearly recognized at approximately the 20th material.

Since a system is required to exhibit a constant sensitivity, this is an important issue in reducing the size of the apparatus. Even if such problems are caused by a local temperature variation in the apparatus, a photothermographic material that is not affected by such variation is required.

Concomitant with the spread of CT, MRI and CR, many medical images are outputted, requiring processing of many medical images within a short period of time. Under such a situation, there is a strong desire for higher processing ability of the medical dry imager. On the other hand, in the dry imagers utilizing a thermal development method by a plate heater or a drum heater, higher stability of the thermal development unit is desired for achieving higher processing ability. As the temperature at the thermal development unit is lowered by thermal development of one sheet of photosensitive material, such temperature lowering must be recovered before the next sheet of photosensitive material arrives. A local temperature variation may be reduced by increasing the heat capacity or volume of the thermal development unit, particularly a heater drum, but such a method leads to a larger size of the apparatus, longer start-up time of the apparatus, and increased electric power consumption, thus undesirable in terms of use and cost. Therefore, there has been a need for an image forming method which uses a photothermographic material and is not susceptible to temperature variation, and is capable of forming a stable image without being easily affected by the instability in temperature at the thermal development unit in such high-speed processing.

SUMMARY OF THE INVENTION

In consideration of the foregoing, an object of the present invention is to provide an image forming method capable of outputting an image with stable sensitivity using an apparatus, for carrying out laser exposure and thermal development, that is compact due to close positioning of a laser exposure unit and a thermal development unit.

Another object of the invention is to provide an image forming method that may be subjected to rapid processing using a photothermographic material, is excellent in density stability and color tone stability of images, and is capable of forming a stable image even at rapid processing.

The aforementioned objects of the invention are attained by the following methods.

A first aspect of the invention is an image forming method using an image recording apparatus which comprises a laser irradiating means for laser scanning of a photothermographic material that has a support and includes on at least one surface thereof a photosensitive silver halide, a non-photosensitive organic silver salt, a reducing agent and a binder, and a conveying means for guiding the photothermographic material in a sub-scanning direction to a thermal development unit, wherein a distance between a scanning line of the laser irradiating means and an inserting portion of the thermal development unit is equal to or smaller than 50 cm, and the reducing agent is at least one selected from the group of compounds represented by the following formula (R1):

Formula (R1)

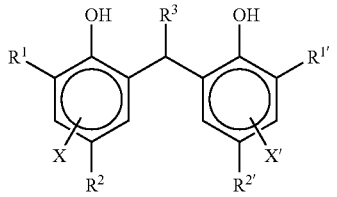

wherein, in formula (R1), $R^1$ and $R^{1'}$ each independently represents an alkyl group having 1 to 20 carbon atoms; $R^2$ and $R^{2'}$ each independently represents a hydrogen atom or a substituent for a benzene ring; $R^3$ represents a substituent for forming a 3- to 7-membered ring composed of atoms selected from a carbon atom, an oxygen atom, a nitrogen atom, a sulfur atom and a phosphor atom; and X and X' each independently represents a hydrogen atom or a substituent for a benzene ring; and compounds represented by the following formula (R2):

Formula (R2)

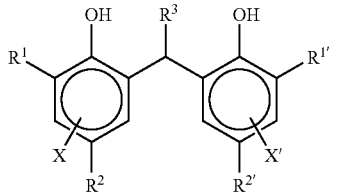

wherein, in formula (R2), $R^1$ and $R^{1'}$ each independently represents an alkyl group having 1 to 20 carbon atoms; $R^2$ and $R^{2'}$ each independently represents a hydrogen atom or a substituent for a benzene ring; $R^3$ represents an alkenyl group or an alkyl group having an unsaturated bond; and X and X' each independently represents a hydrogen atom or a substituent for a benzene ring.

A second aspect of the invention is an image forming method which comprises carrying out thermal development, with an interval time equal to or less than 12 seconds, of a photothermographic material that has a support and includes on at least one surface thereof a photosensitive silver halide, a non-photosensitive organic silver salt, a reducing agent and a binder, wherein the reducing agent is at least one selected from the group of compounds represented by the following formula (R1):

Formula (R1)

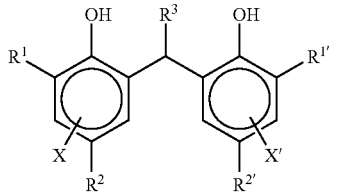

wherein, in formula (R1), $R^1$ and $R^{1'}$ each independently represents an alkyl group having 1 to 20 carbon atoms; $R^2$ and $R^{2'}$ each independently represents a hydrogen atom or a substituent for a benzene ring; $R^3$ represents a substituent for forming a 3- to 7-membered ring composed of atoms selected from a carbon atom, an oxygen atom, a nitrogen atom, a sulfur atom and a phosphor atom; and X and X' each independently represents a hydrogen atom or a substituent for a benzene ring; and compounds represented by the following formula (R2):

Formula (R2)

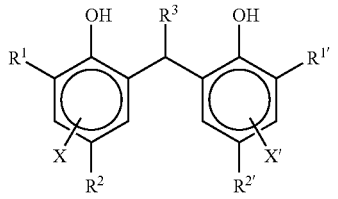

wherein, in formula (R2), $R^1$ and $R^{1'}$ each independently represents an alkyl group having 1 to 20 carbon atoms; $R^2$ and $R^{2'}$ each independently represents a hydrogen atom or a substituent for a benzene ring; $R^3$ represents an alkenyl group or an alkyl group having an unsaturated bond; and X and X' each independently represents a hydrogen atom or a substituent for a benzene ring.

DETAILED DESCRIPTION OF THE INVENTION

Figure 1:
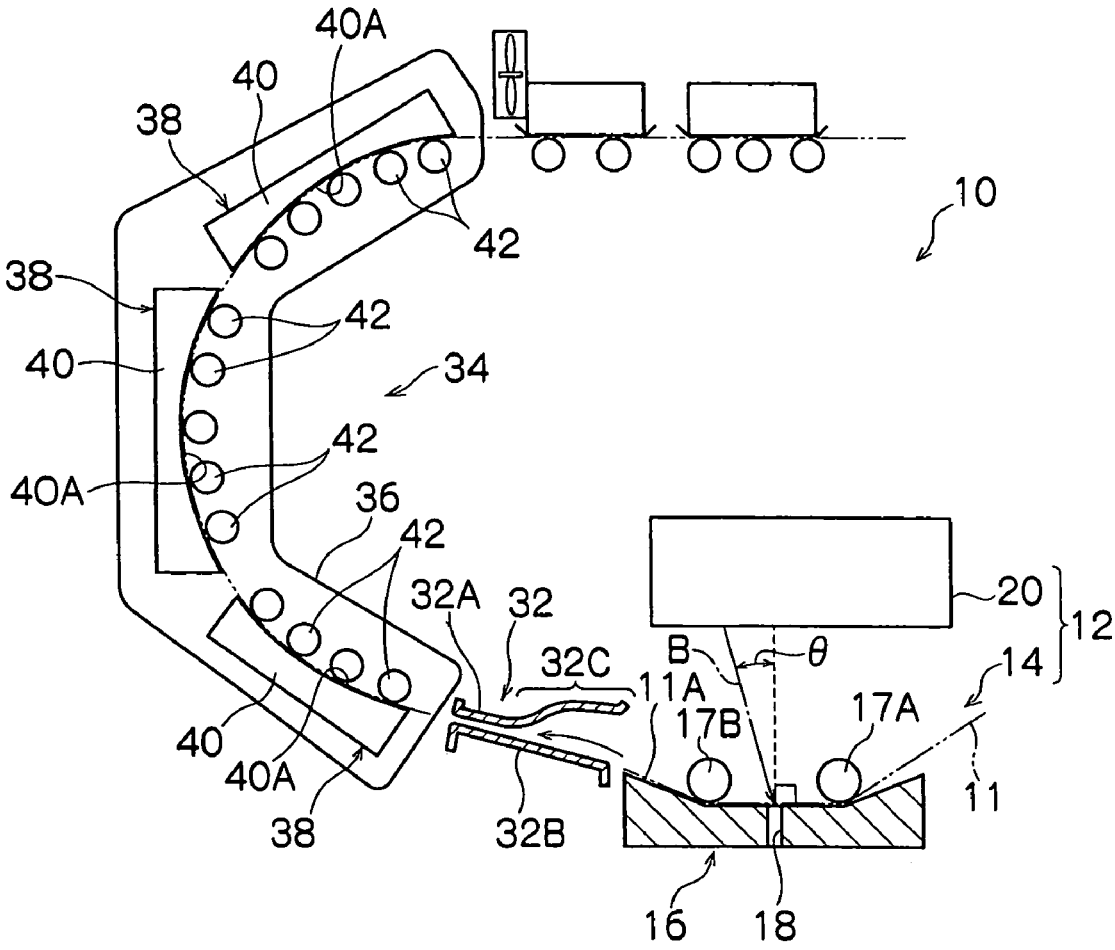
FIG. 1 is a schematic view showing an image recording apparatus employed in an image forming method according to a first aspect of the present invention.

Hereinafter, the present invention will be explained in detail.

An image forming method according to a first aspect of the invention is an image forming method using an image recording apparatus which comprises a laser irradiating means for laser scanning of a photothermographic material that has a support and includes on at least one surface thereof a photosensitive silver halide, a non-photosensitive organic silver salt, a reducing agent and a binder, and a conveying means for guiding the photothermographic material in a sub-scanning direction to a thermal development unit, wherein a distance between a scanning line of the laser irradiating means and an inserting portion of the thermal development unit is equal to or smaller than 50 cm, and the reducing agent is at least one selected from the group of compounds represented by the following formula (R1) and compounds represented by the following formula (R2).

An image forming method using a photothermographic material according to a second aspect of the invention is an image forming method which comprises carrying out thermal development, with an interval time equal to or less than 12 seconds, of a photothermographic material that has a support and includes on at least one surface thereof a photosensitive silver halide, a non-photosensitive organic silver salt, a reducing agent and a binder, wherein the reducing agent is at least one selected from the group of compounds represented by the following formula (R1) and compounds represented by the following formula (R2).

Detailed description will now be given of a preferred composition of the photothermographic material and an image forming method of the present invention.

1. Photothermographic Material

A photothermographic material of the invention has, on at least one surface of a support, an image forming layer including a photosensitive silver halide, a non-photosensitive organic silver salt, a reducing agent and a binder. Also it may preferably be provided with a surface protective layer on the image forming layer, or a back layer or a back protective layer on an opposite surface.

1-1. Reducing Agent

1) Reducing Agent Represented by Formula (R1)

A reducing agent to be employed in the invention is a compound represented by the following formula (R1), and is a compound capable of reducing a silver ion into developed silver upon thermal development:

Formula (R1)

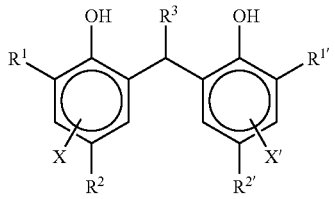

wherein, in formula (R1), $R^1$ and $R^{1'}$ each independently represents an alkyl group with 1 to 20 carbon atoms; $R^2$ and $R^{2'}$ each independently represents a hydrogen atom or a substituent for a benzene ring; $R^3$ represents a substituent forming a 3- to 7-membered ring composed of one or more atoms selected from a carbon atom, an oxygen atom, a nitrogen atom, a sulfur atom and a phosphor atom; and X and X' each independently represents a hydrogen atom or a substituent for a benzene ring.

A detailed explanation on formula (R1) will be given below.

(1) $R^1$ and $R^{1'}$ $R^1$ and $R^{1'}$ each independently represents a substituted or unsubstituted alkyl group having 1 to 20 carbon. A substituent on the alkyl group is not particularly limited, but is preferably an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group or a halogen atom.

$R^1$ and $R^{1'}$ each is preferably a secondary or tertiary alkyl group with 3 to 15 carbon atoms, of which specific examples include an isopropyl group, an isobutyl group, a t-butyl group, a t-amyl group, a t-octyl group, a cyclohexyl group, a cyclopentyl group, a 1-methylcyclohexyl group, and 1-methylcyclopropyl group. For $R^1$ and $R^{1'}$, there is more preferred a tertiary alkyl group with 4 to 12 carbon atoms, among which a t-butyl group, a t-amyl group or a 1-methylcyclohexyl group is further preferably and a t-butyl group is most preferable.

(2) $R^2$, $R^{2'}$, X and X'

$R^2$ and $R^{2'}$ each independently represents a hydrogen atom or a substituent for a benzene ring, and also X and X' each independently represents a hydrogen atom or a group substitutable on a benzene ring.

Preferred examples of the substituent for a benzene ring include an alkyl group, an aryl group, a halogen atom, an alkoxy group and an acylamino group.

$R^2$ and $R^{2'}$ each is preferably an alkyl group having 1 to 20 carbon atoms, of which specific examples include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group. Among them, more preferred are a methyl group, an ethyl group, a propyl group, an isopropyl group or a t-butyl group.

X and X' each is preferably a hydrogen atom, a halogen atom, or an alkyl group, more preferably a hydrogen atom.

(3) $R^3$ $R^3$ represents a substituent to form a 3- to 7-membered ring composed of a carbon atom, an oxygen atom, a nitrogen atom, a sulfur atom and a phosphor atom. The ring may be solely composed of carbon atoms, or may be a heterocyclic group including a carbon atom and the hetero atom.

$R^3$ is preferably a group having 3 to 20 carbon atoms to form a 5- or 6-membered carbon or heterocyclic ring, and more preferably a group to form a ring composed of carbon atoms or oxygen atoms.

Such a ring may include an unsaturated bond.

Such a ring may have substituents. The number of carbon atoms including the substituent is preferably within a range from 2 to 30.

Examples of the substituent on the ring represented by $R^3$ include a halogen atom, an alkyl group, an alkenyl group, an alkinyl group, a cycloalkyl group, an aryl group, an alkoxy group, an alkylthio group, an aryloxy group, an arylthio group, an allyloxy group, an allylthio group, an acylamino group, a sulfonamide group, a sulfonyl group, a phosphoryl group, a carbonyl group, an oxycarbonyl group, a carbamoyl group, a sulfamoyl group, a heterocyclic group, an amino group and a hydroxyl group.

Specific examples of the ring represented by $R^3$ include a cyclopropyl group, a cyclobutyl group, a cyclopentyl group, a cyclohexyl group, a cycloheptyl group, a 2-norbornyl group, 2-[2,2,2]-bicyclooctyl group, 2-adamantyl group, a 2-cyclopentenyl group, a 2-cyclohexenyl group, a 3-cyclohexenyl group, a 2-tetrahydrofuranyl group, a 2-dihydrofuranyl group, a 2-tetrahydropyranyl group, a 3-dihydropyranyl group, a 2-pyrrolidine group, a 2-piperidine group, a 3-tetrahydrothiopyranyl group and 3-tetrahydrophosphoran group.

More preferred specific examples of the ring represented by $R^3$ include a cycloalkyl group, a cycloalkenyl group and a heterocyclic group, having 1 to 15 carbon atoms. As the cycloalkyl group, a cyclohexyl group or a cyclopentyl group is preferred, while, as the cycloalkenyl group, a 2-cyclohexenyl group, a 3-cyclohexenyl group or a 3-cyclopentenyl group is preferred. As the heterocyclic group, a 2-tetrahydrofuranyl group, a 2-tetrahydropyranyl group or a 3-tetrahydropyranyl group is preferred. As $R^3$, a cyclohexyl group, a 3-cyclohexenyl group or a 3-cyclopentenyl group is particularly preferred.

Specific examples of the reducing agent, including the compounds represented by formula (R1) of the invention are shown below, but the invention is not limited thereto.

R1-1

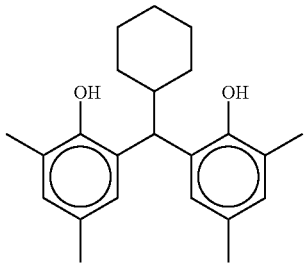

R1-2

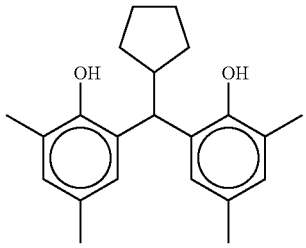

R1-3

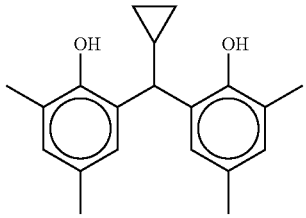

R1-4

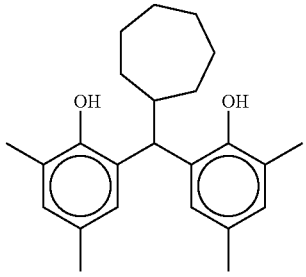

R1-5

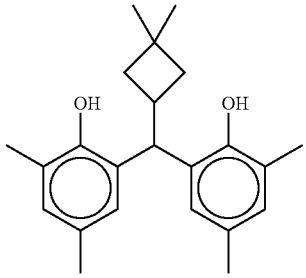

R1-6

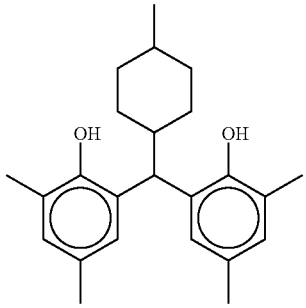

-continued
R1-7
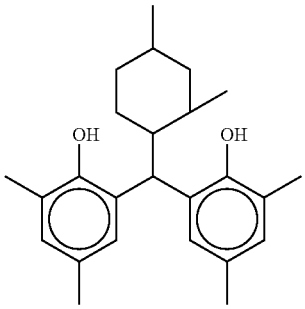
R1-8
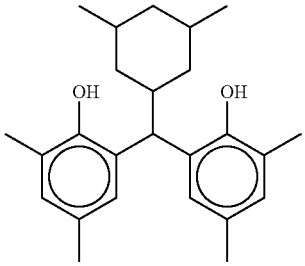
R1-9
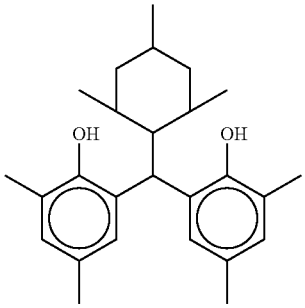
R1-10
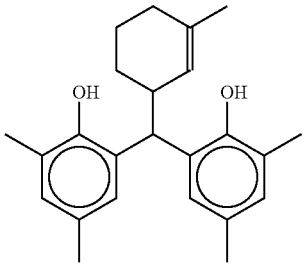
R1-11
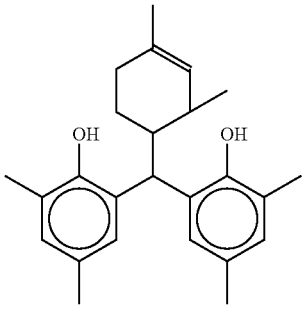
-continued
R1-12
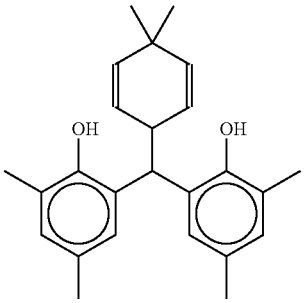
R1-13
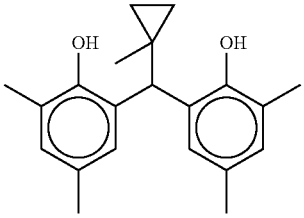
R1-14
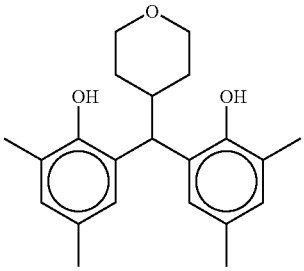
R1-15
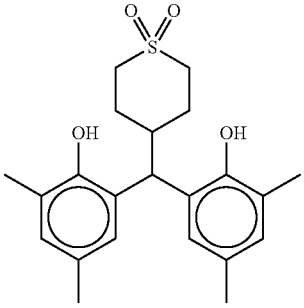
R1-16
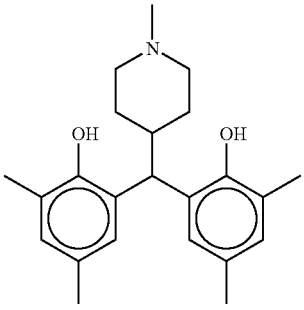

-continued
R1-17
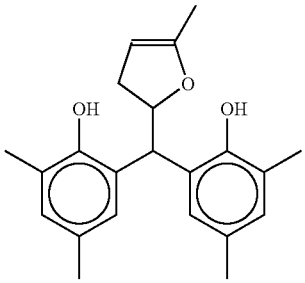
R1-18
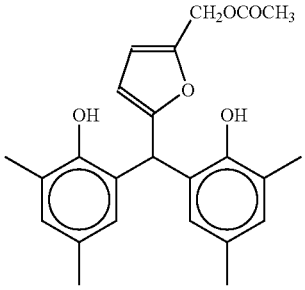
R1-19
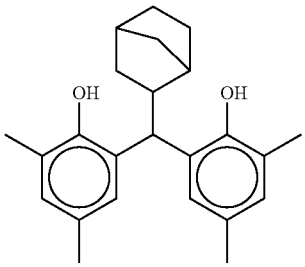
R1-20
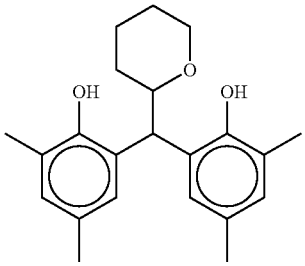
R1-21
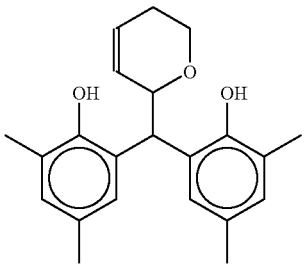
-continued
R1-22
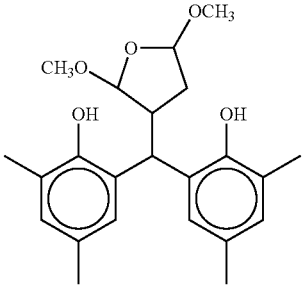
R1-23
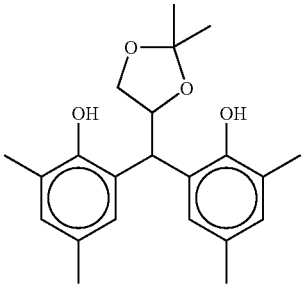
R1-24
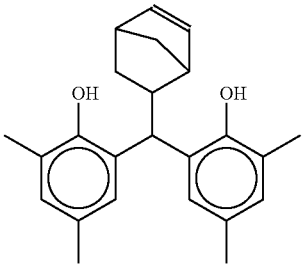
R1-25
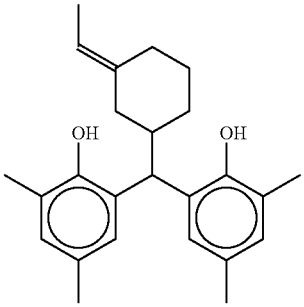
R1-26
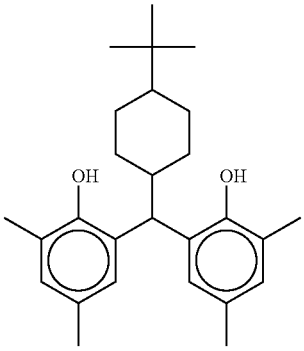

-continued
R1-27
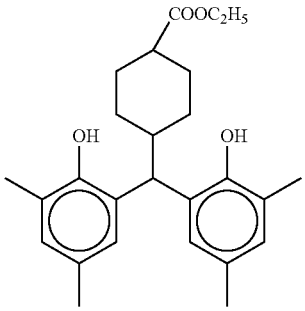
R1-28
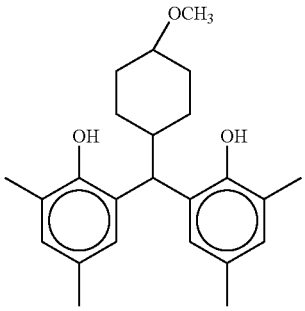
R1-29
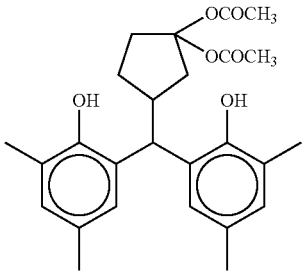
R1-30
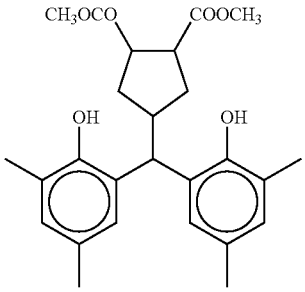
R1-31
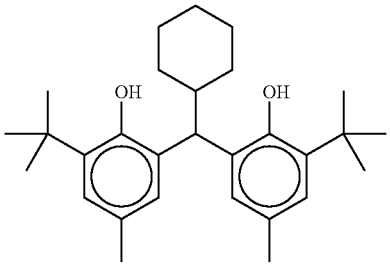
-continued
R1-32
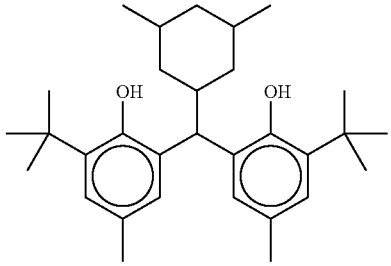
R1-33
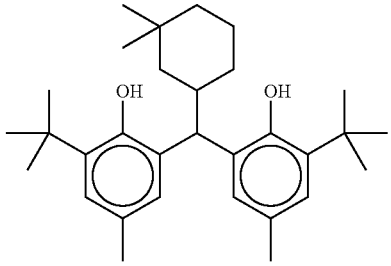
R1-34
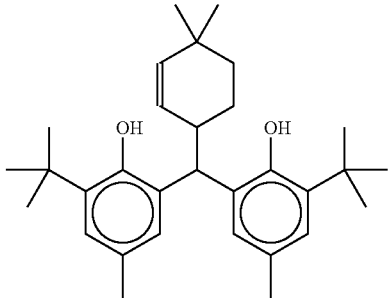
R1-35
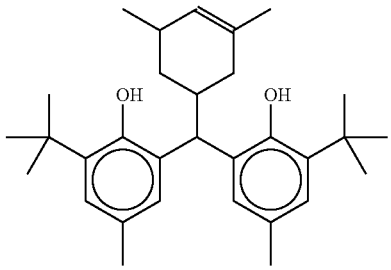
R1-36
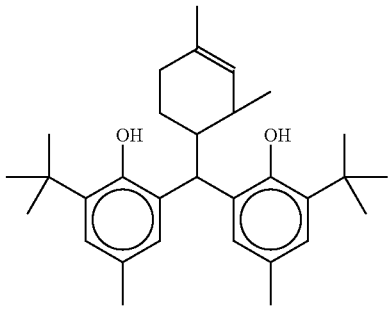

-continued
R1-37
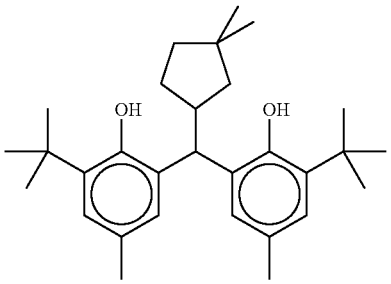
R1-38
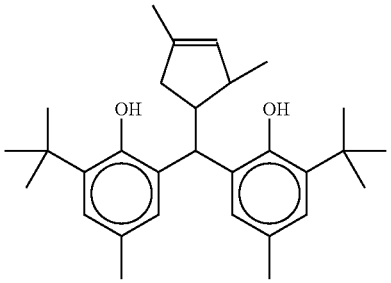
R1-39
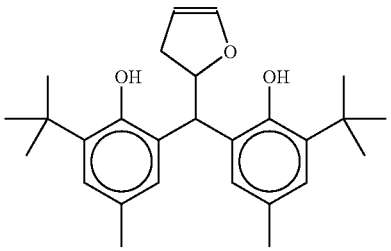
R1-40
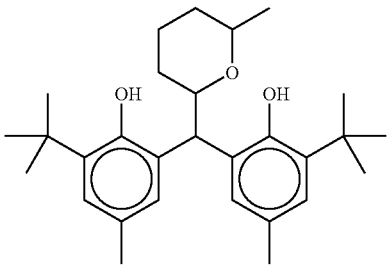
R1-41
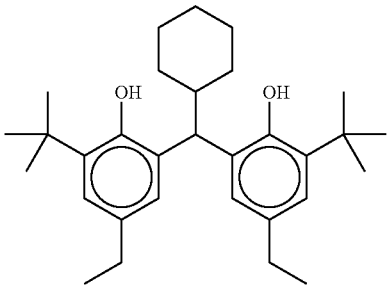
-continued
R1-42
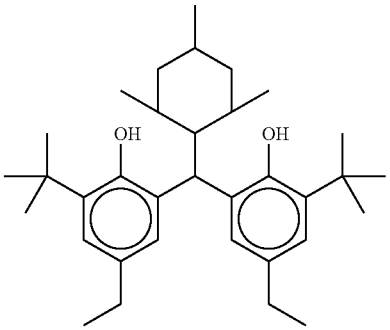
R1-43
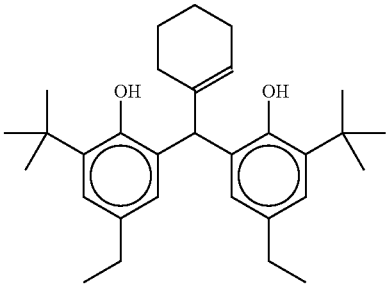
R1-44
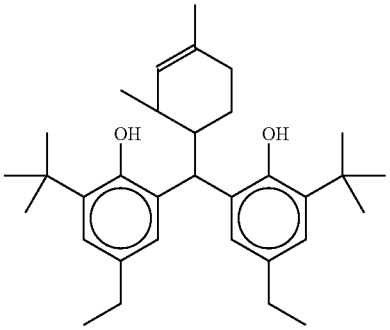
R1-45
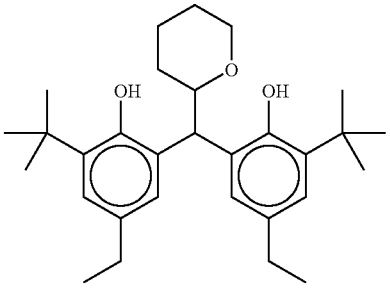
R1-46
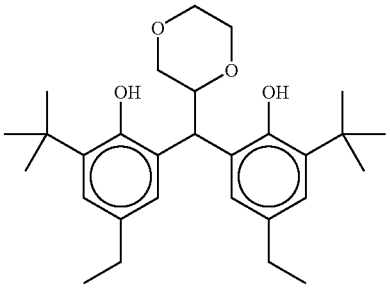

-continued
R1-47
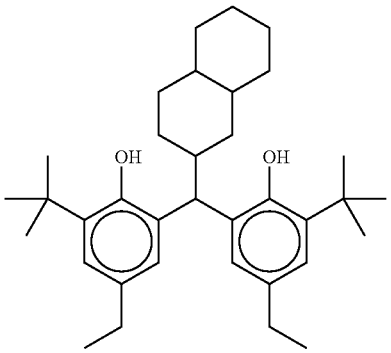
R1-48
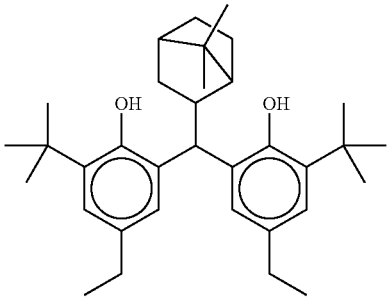
R1-49
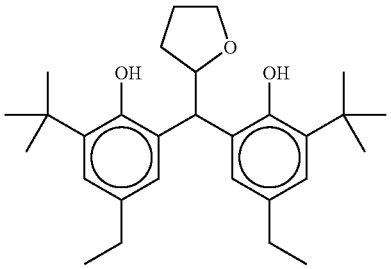
R1-50
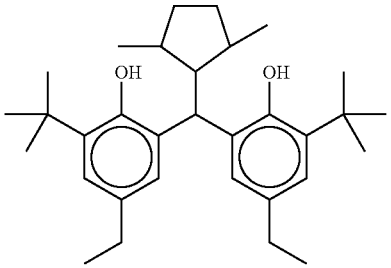
R1-51
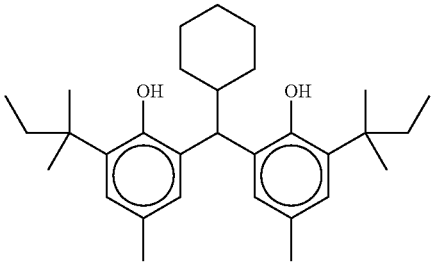
-continued
R1-52
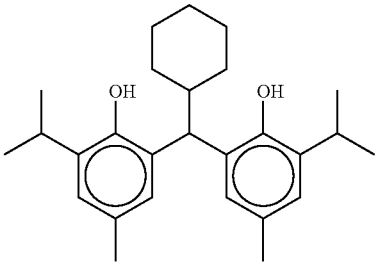
R1-53
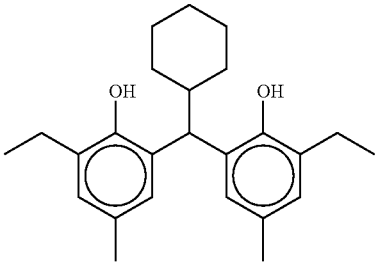
R1-54
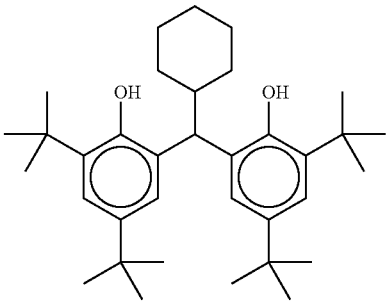
R1-55
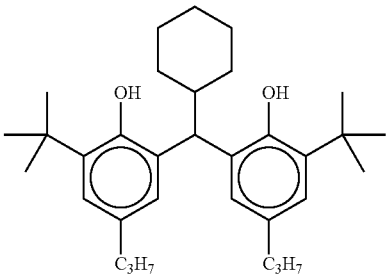
R1-56
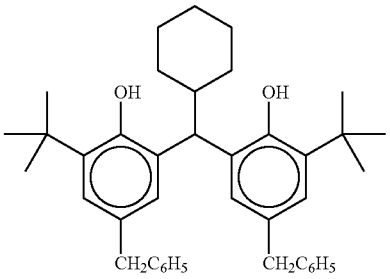

-continued
R1-57
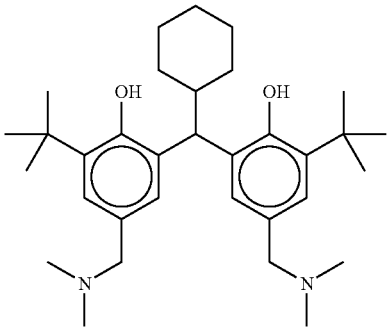
R1-58
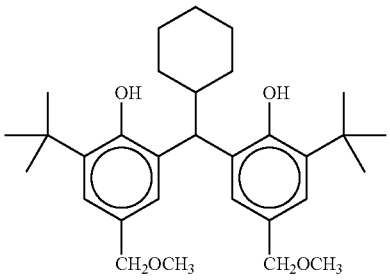
R1-59
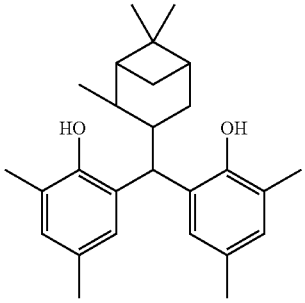
R1-60
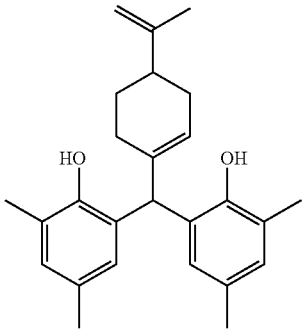
R1-61
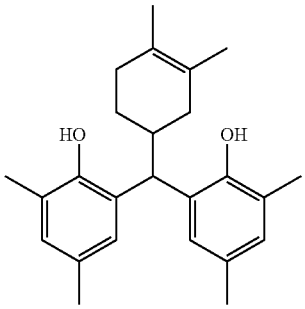
-continued
R1-62
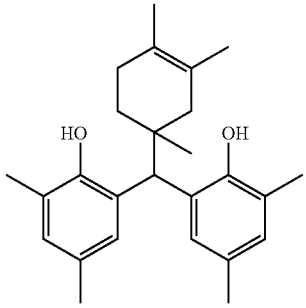
R1-63
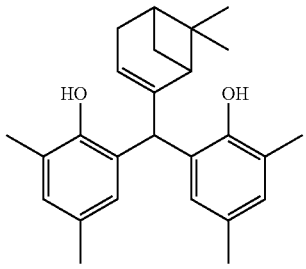
R1-64
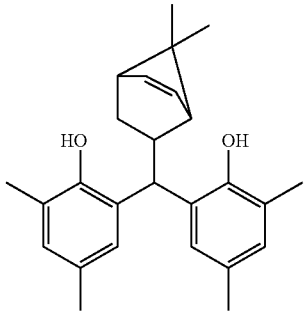
R1-65
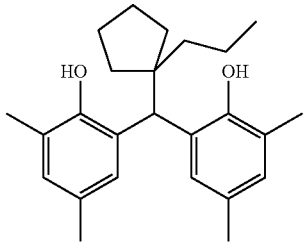
R1-66
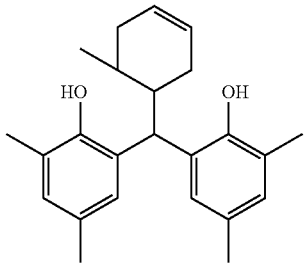

-continued
R1-67
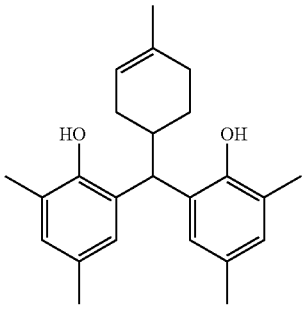
R1-68
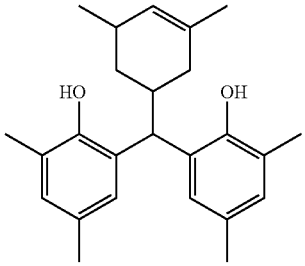
R1-69
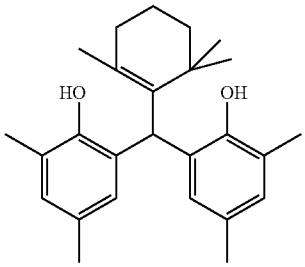
R1-70
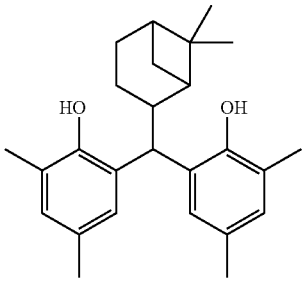
R1-71
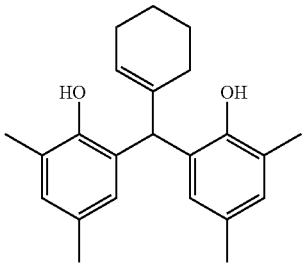
-continued
R1-72
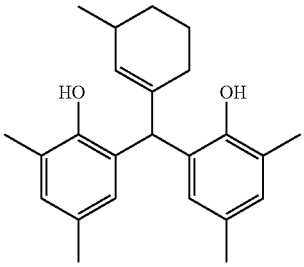
R1-73
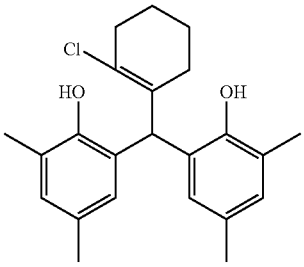
R1-74
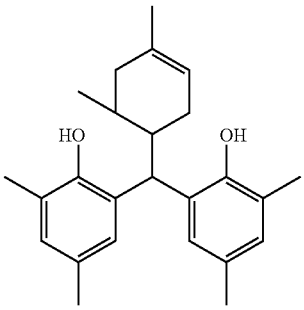
R1-75
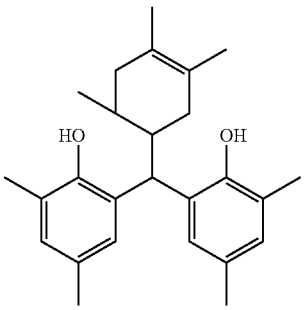
R1-76
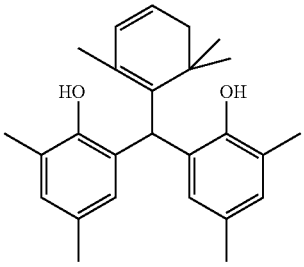

-continued
R1-77
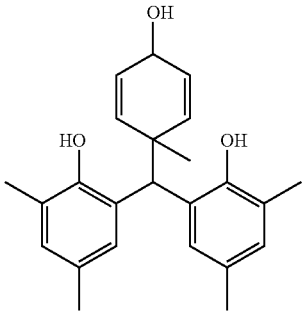
R1-78
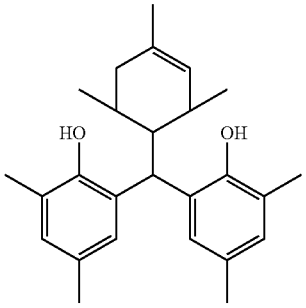
R1-79
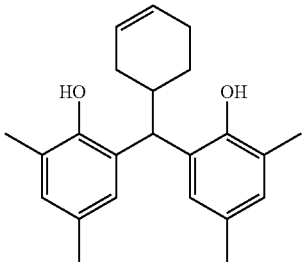
R1-80
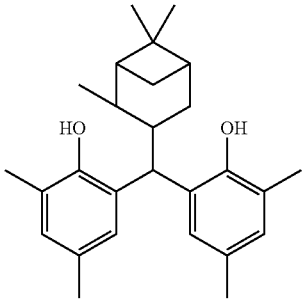
R1-81
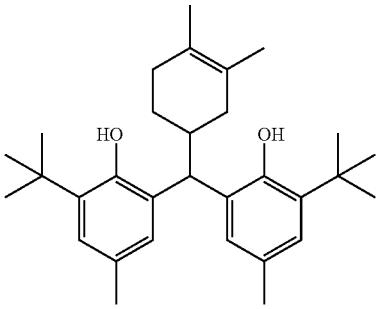
-continued
R1-82
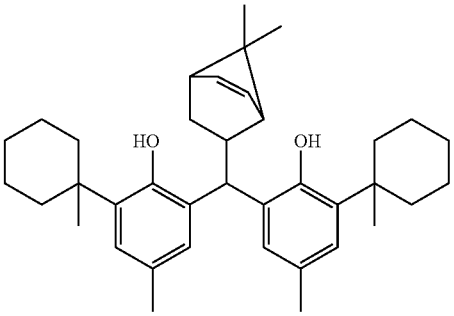
R1-83
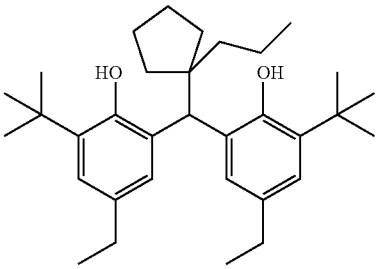
R1-84
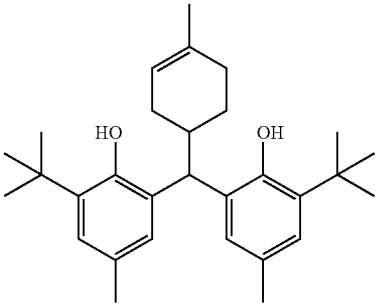
R1-85
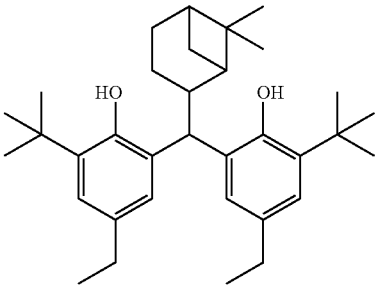
R1-86
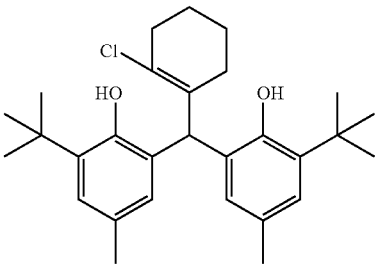

-continued
R1-87
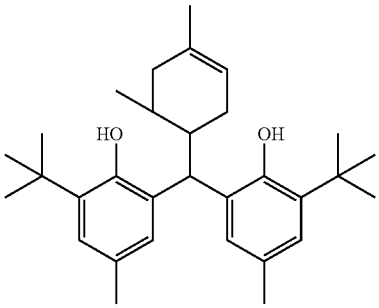
R1-88
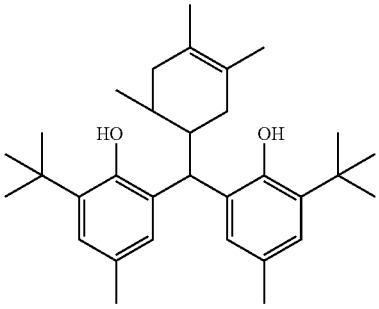
R1-89
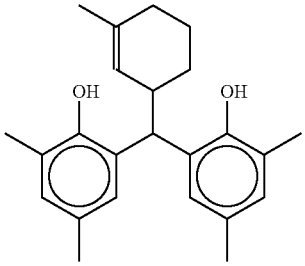
R1-90
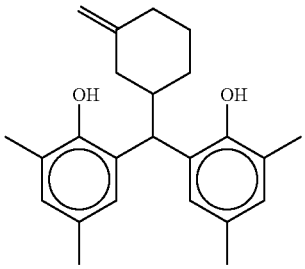
R1-91
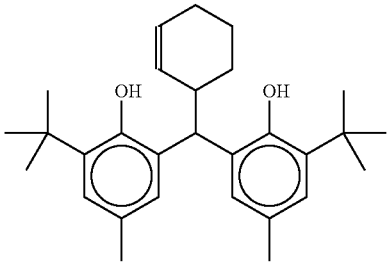
-continued
R1-92
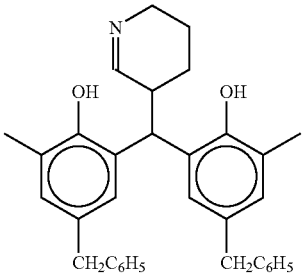
R1-93
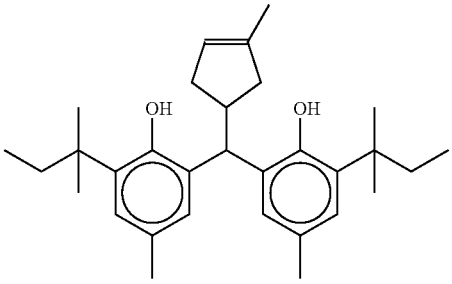
R1-94
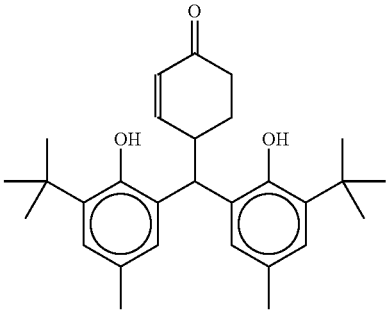
R1-95
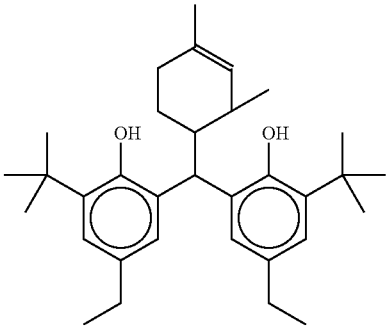
R1-96
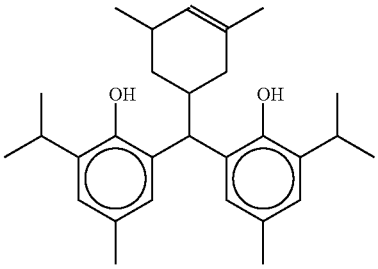

-continued
R1-97
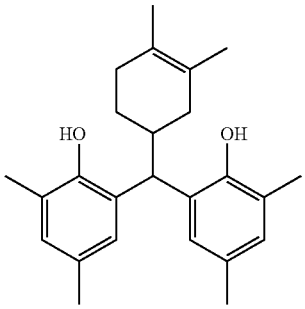
R1-98
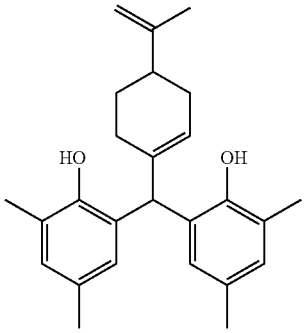
R1-99
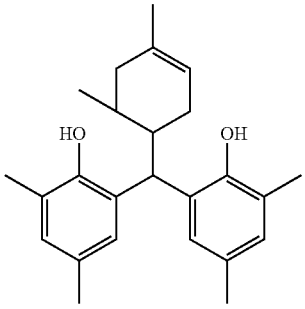
R1-100
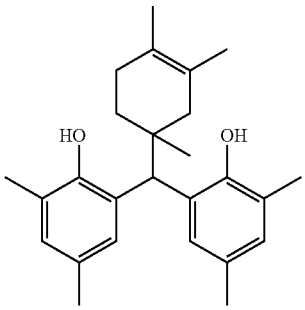
R1-101
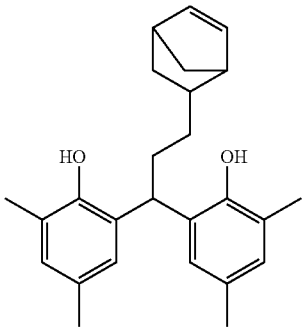
-continued
R1-102
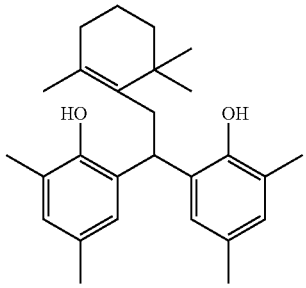
R1-103
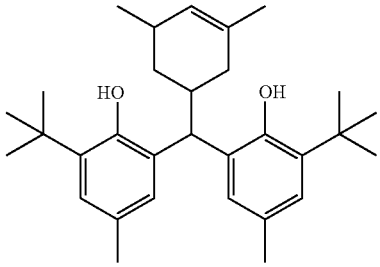
R1-104
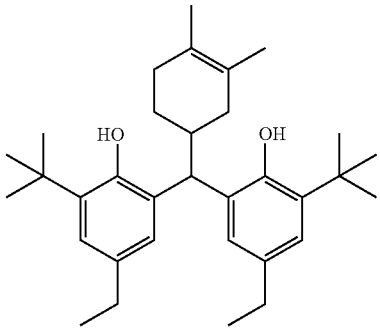
R1-105
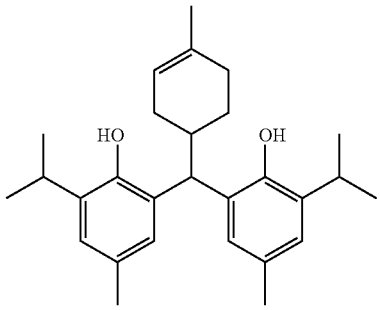
R1-106
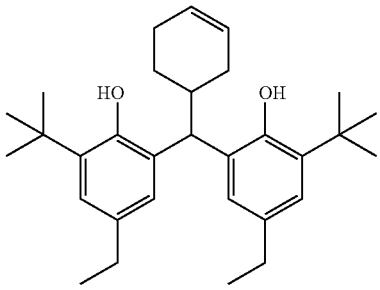
The reducing agent may be included in any layer at a side of the support having the image forming layer, however it is preferably included in the image forming layer or a layer adjacent thereto, and more preferably in the image forming layer.

In the invention, the reducing agent is preferably added in an amount of 0.1 to 3.0 g/m$^2$, more preferably 0.2 to 1.5 g/m$^2$, further preferably 0.3 to 1.0 g/m$^2$. It is preferably included in an amount of 5 to 50 mol % per 1 mole of silver on a surface having an image forming layer, more preferably 8 to 30 mol %, and further preferably 10 to 20 mol %.

The reducing agent may be contained in the coating liquid and in the photosensitive material by any method, for example in a state of a solution, an emulsified dispersion or a solid fine particle dispersion.

A well known method for preparing an emulsified dispersion is carried out by dissolution with an oil such as dibutyl phthalate, tricresyl phosphate, glyceryl triacetate or diethyl phthalate, or an auxiliary solvent such as ethyl acetate or cyclohexanone, followed by a mechanical preparation of an emulsified dispersion.

Also for dispersing solid fine particles, there may be employed a method of dispersing a powder of a reducing agent in a suitable solvent such as water using a ball mill, a colloid mill, a vibrating ball mill, a sand mill, a jet mill, a roller mill or ultrasonic wave to thereby obtain a solid dispersion. In such a method, there may be employed a protective colloid (such as polyvinyl alcohol) or a surfactant (for example, an anionic surfactant such as sodium triisopropylnaphthalenesulfonate (a mixture of compounds having different substituting positions of three isopropyl groups). In the above-mentioned mills, beads such as of zirconia are usually employed as a dispersion medium, and the dispersion may be contaminated with zirconium, etc. dissolved out from such beads. Its content, though dependent on the dispersing conditions, is usually within a range of 1 to 1000 ppm. Zr may be tolerated practically as long as its content in the photosensitive material is 0.5 mg or less per 1 g of silver. In an aqueous dispersion, it is preferable to include an antiseptic (such as sodium salt of benzothiazolinone).

A particularly preferable method is a method of dispersing solid particles of the reducing agent, and it is added in a state of fine particles having an average particle size of 0.01 to 10 μm, preferably 0.05 to 5 μm, more preferably 0.1 to 2 μm. In the invention, it is preferable to employ other solid dispersions also with a particle size within such a range.

2) Reducing Agent Represented by Formula (R2)

A reducing agent in the invention is a compound represented by the following formula (R2) and capable of reducing a silver ion into a developed silver upon thermal development.

Formula (R2)

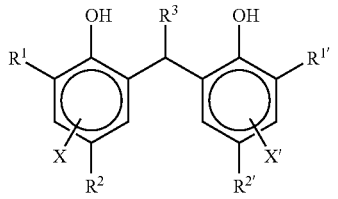

In formula (R2), $R^1$ and $R^{1'}$ each independently represents an alkyl group having 1 to 20 carbon atoms; $R^2$ and $R^{2'}$ each independently represents a hydrogen atom or a substituent for a benzene ring; $R^3$ represents an alkenyl group or an alkyl group having an unsaturated bond; and X and X' each independently represents a hydrogen atom or a substituent for a benzene ring.

A detailed explanation on formula (R2) will be given below.

1) $R^1$ and $R^{1'}$ $R^1$ and $R^{1'}$ each independently represents a substituted or unsubstituted alkyl group having 1 to 20 carbon. A substituent on the alkyl group is not particularly limited, but is preferably an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group or a halogen atom.

Each of $R^1$ and $R^{1'}$ is preferably a secondary or tertiary alkyl group with 3 to 15 carbon atoms, and specific examples include an isopropyl group, an isobutyl group, a t-butyl group, a t-amyl group, a t-octyl group, a cyclohexyl group, a cyclopentyl group, 1-methylcyclohexyl group and 1-methylcyclopropyl group. As $R^1$ and $R^{1''}$, more preferred are a tertiary alkyl group with 4 to 12 carbon atoms, among which a t-butyl group, a t-amyl group or a 1-methylcyclohexyl group is further preferable and a t-butyl group is most preferable.

(2) $R^2$, $R^{2'}$, X and X'

$R^2$ and $R^{2'}$ each independently represents a hydrogen atom or a group substitutable on a benzene ring, and X and X' also each independently represents a hydrogen atom or a substituent for a benzene ring. Each group substitutable on a benzene ring may preferably be an alkyl group, an aryl group, a halogen atom, an alkoxy group or an acylamino group.

Each of $R^2$ and $R^{2'}$ is preferably an alkyl group having 1 to 20 carbon atoms, and specific examples include a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, and a methoxyethyl group. It is more preferably a methyl group, an ethyl group, a propyl group, an isopropyl group or a t-butyl group.

Each of X and X' is preferably a hydrogen atom, a halogen atom, or an alkyl group, more preferably a hydrogen atom.

(3) $R^3$ $R^3$ represents an alkenyl group or an alkyl group having an unsaturated bond with 2 to 20 carbon atoms. The alkenyl group or the alkyl group may be unsubstituted or may have a substituent.

Examples of the substituent include a halogen atom, an alkyl group, an alkenyl group, an alkinyl group, a cycloalkyl group, an aryl group, an alkoxy group, an alkylthio group, an aryloxy group, an arylthio group, an acylamino group, a sulfonamide group, a sulfonyl group, a phosphoryl group, a carbonyl group, a hydroxyl group, an oxycarbonyl group, a carbamoyl group, a sulfamoyl group and a heterocyclic group.

The unsaturated bond is preferably a carbon-carbon unsaturated bond, or a carbon-nitrogen unsaturated bond, more preferably a carbon-carbon unsaturated bond. An alkyl group having an unsaturated bond is specifically an alkyl group having a carbon-carbon double bond, a carbon-carbon triple bond, a carbon-nitrogen double bond or a carbon-nitrogen triple bond, and more preferably an alkyl group having a carbon-carbon double bond.

Such a group is contained by at least one in the molecule. Such a group may be present by two or more in the molecule, and, in such case, the unsaturated bonds may be mutually conjugated or unconjugated, but are preferably unconjugated.

Specific examples of the compound represented by formula (R2) are shown below, however the invention is not limited thereto.

R2-1

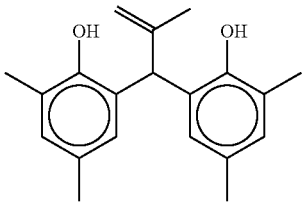

R2-2

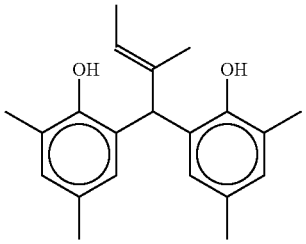

R2-3

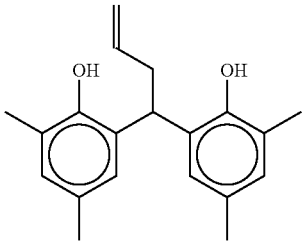

R2-4

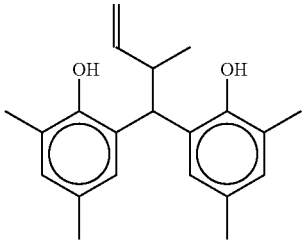

R2-5

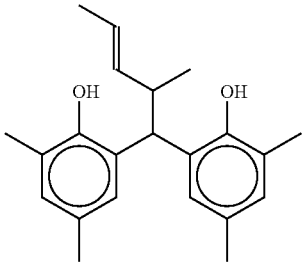

-continued

R2-6

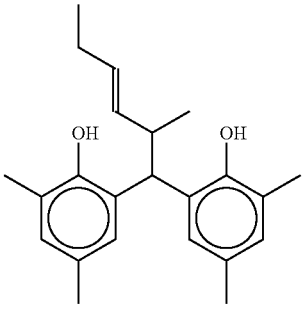

R2-7

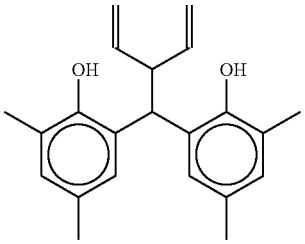

R2-8

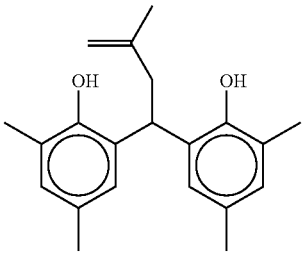

R2-9

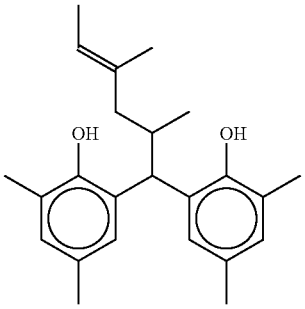

R2-10

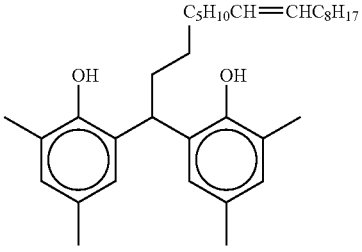

-continued
R2-11
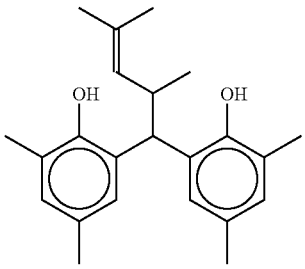
R2-12
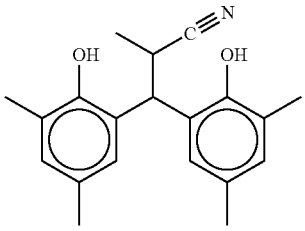
R2-13
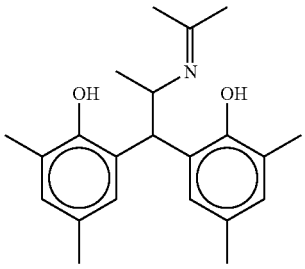
R2-14
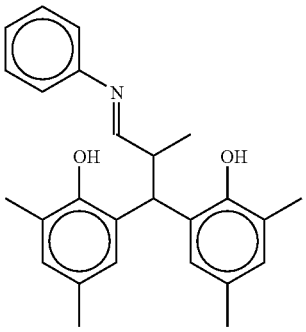
R2-15
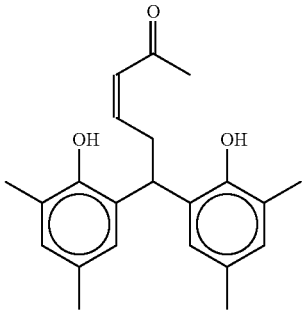
-continued
R2-16
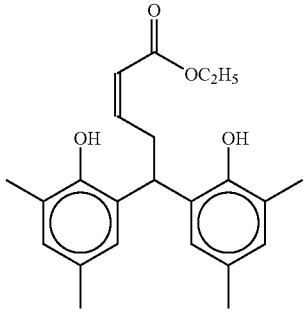
R2-17
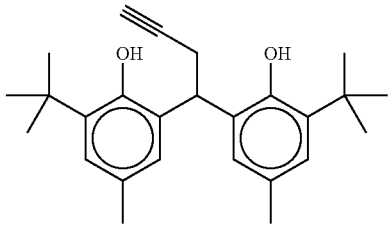
R2-18
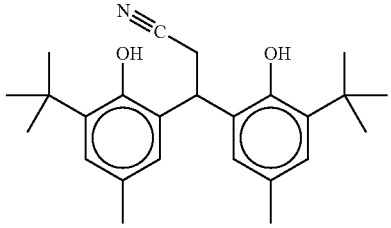
R2-19
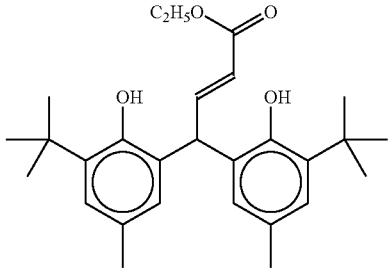
R2-20
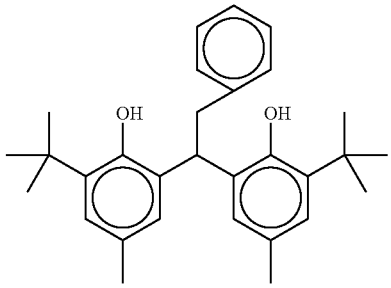
R2-21
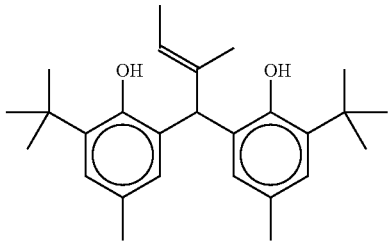

-continued
R2-22
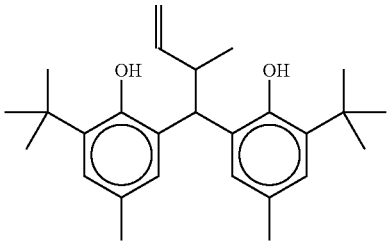
R2-23
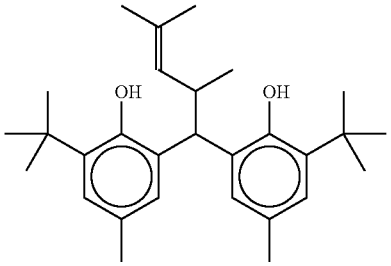
R2-24
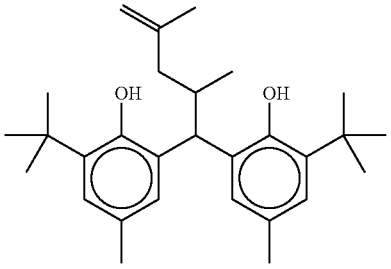
R2-25
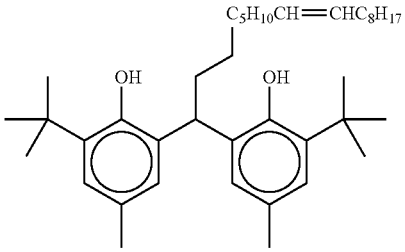
R2-26
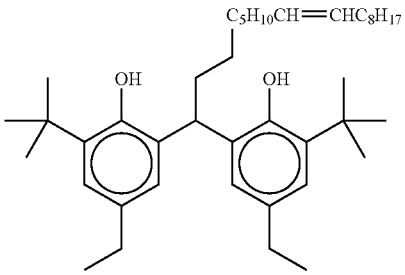
R2-27
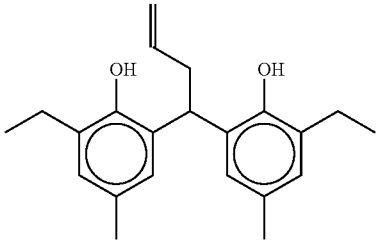
-continued
R2-28
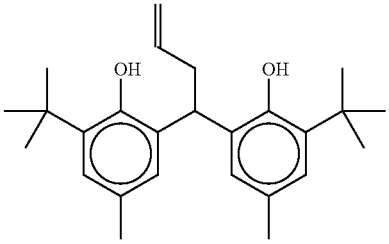
R2-29
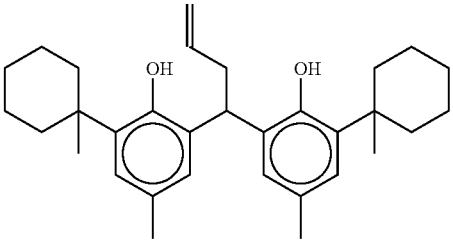
R2-30
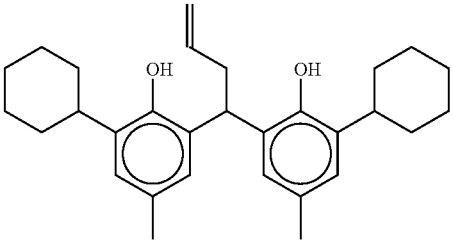
R2-31
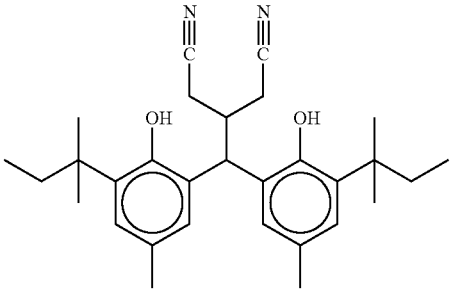
R2-32
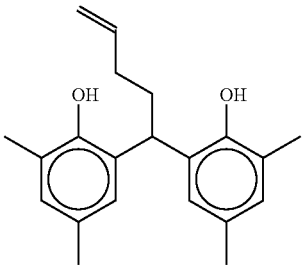
R2-33
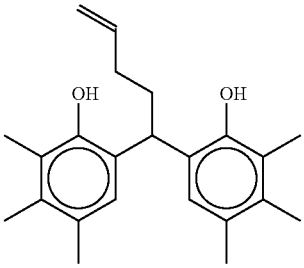

-continued
R2-34
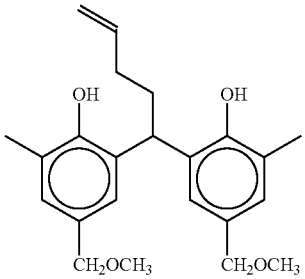
R2-35
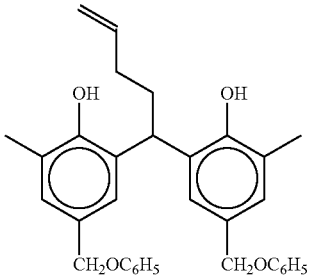
R2-36
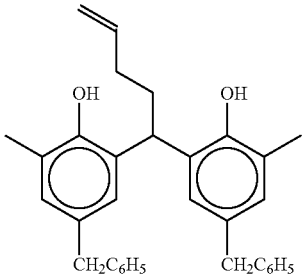
R2-37
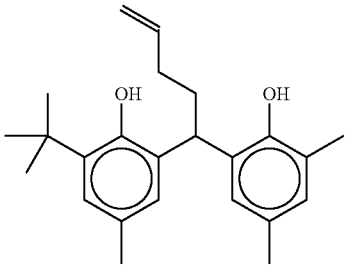
R2-38
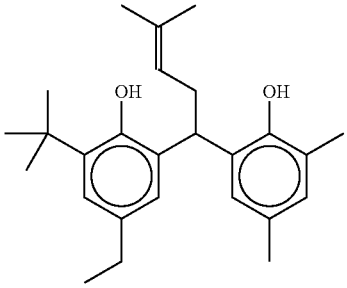
-continued
R2-39
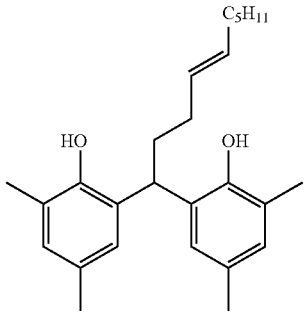
R2-40
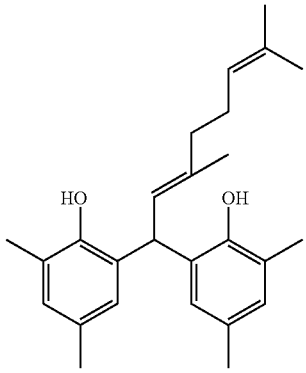
R2-41
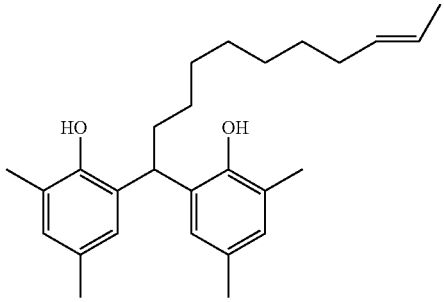
R2-42
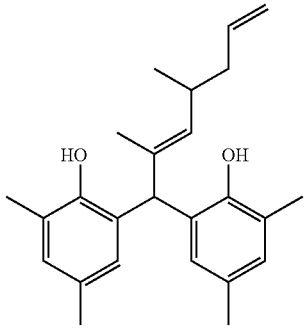

-continued
R2-43
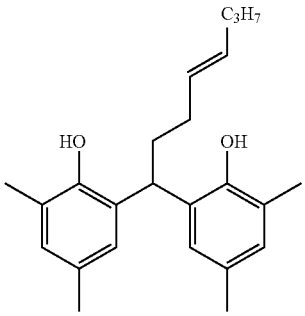
R2-44
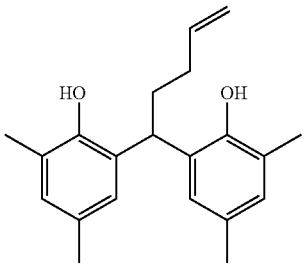
R2-45
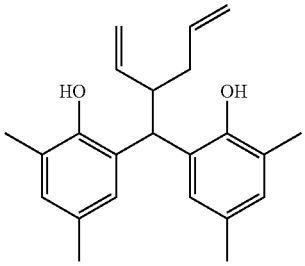
R2-46
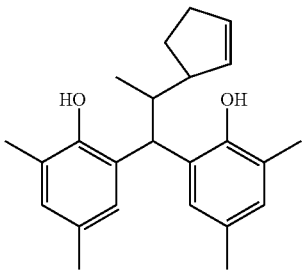
R2-47
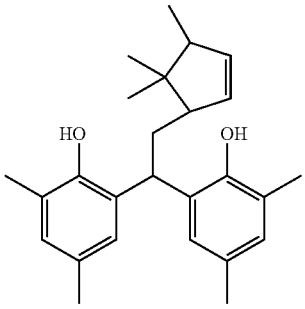
-continued
R2-48
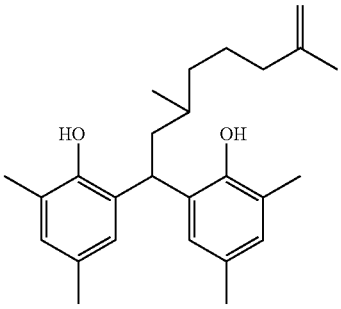
R2-49
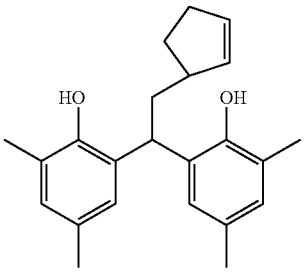
R2-50
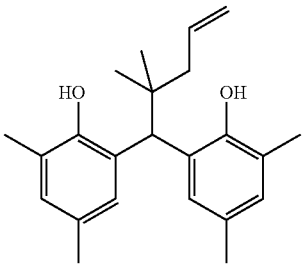
R2-51
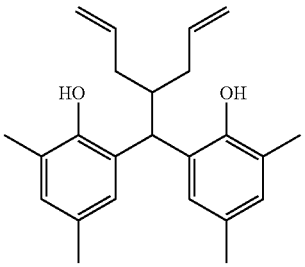
R2-52
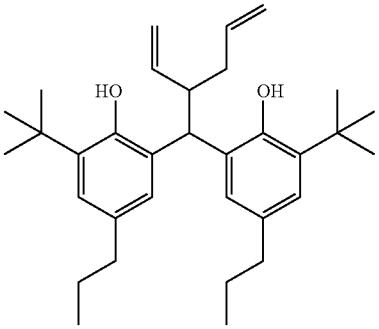

-continued

R2-53

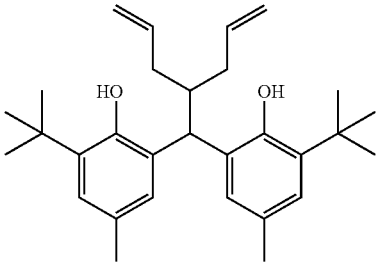

R2-54

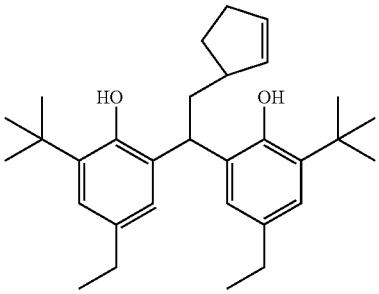

R2-55

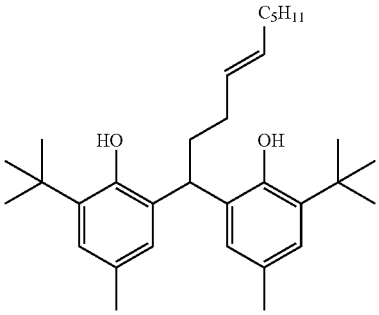

R2-56

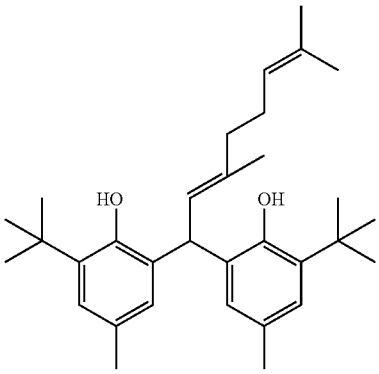

R2-57

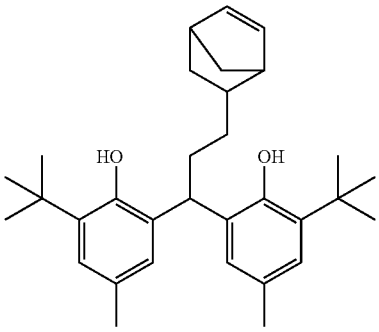

-continued

R2-58

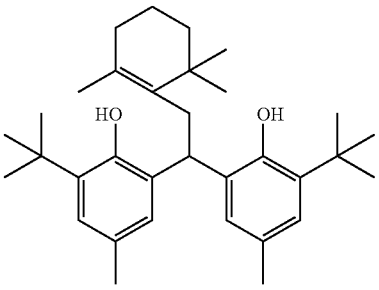

The reducing agent may be included in any layer at a side of the support having the image forming layer, however it is preferably included in the image forming layer or a layer adjacent thereto, and more preferably in the image forming layer.

The reducing agents R1 and R2 of the invention may be employed singly, or preferably in a combination of two or more kinds thereof for a purpose adjusting developability or color tone.

For example, a use ratio of the compound represented by formula (R1) and the compound represented by formula (R2) of the invention is 10/90 to 90/10, preferably 20/80 to 80/20.

In the invention, the reducing agent is preferably added in an amount of 0.1 to 3.0 g/m$^2$, more preferably 0.2 to 1.5 g/m$^2$, further preferably 0.3 to 1.0 g/m$^2$. It is preferably included in an amount of 5 to 50 mol % per mole of silver on a surface having an image forming layer, more preferably 8 to 30 mol %, and further preferably 10 to 20 mol %.

In case where a plurality of reducing agents are employed in combination, a total amount of the addition thereof is preferably within the above-mentioned range.

The reducing agent may be contained in the coating liquid and in the photosensitive material by any method, for example in a state of a solution, an emulsified dispersion or a dispersion of fine solid particles.

A well known method for preparing an emulsified dispersion is carried out by dissolution with an oil such as dibutyl phthalate, tricresyl phosphate, glyceryl triacetate or diethyl phthalate, or an auxiliary solvent such as ethyl acetate or cyclohexanone, followed by a mechanical preparation of an emulsified dispersion.

3) Other Reducing Agents Usable in Combination with Aforementioned Reducing Agent of the Invention In the invention, in addition to the compound represented by formulas (R1) and (R2), another reducing agent may be included.

The reducing agent usable in combination may be any substance (preferably, an organic substance) capable of reducing a silver ion into metallic silver. Examples of such reducing agents are described in JP-A No. 11-65021, paragraphs 0043–0045, and EP-A No. 0,803,764A1, page 7, line 34 to page 18, line 12.

The reducing agent usable in combination in the invention is preferably a so-called hindered phenol reducing agent having a substituent in an ortho-position of a phenolic hydroxyl group, or a bisphenol reducing agent, and more preferably a compound represented by the following formula (R):

Formula (R)

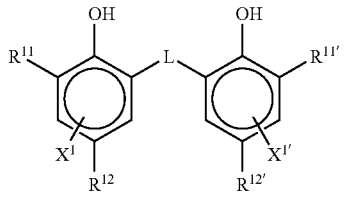

In formula (R), $R^{11}$ and $R^{11'}$ each independently represents an alkyl group having 1 to 20 carbon atoms; $R^{12}$ and $R^{12'}$ each independently represents a hydrogen atom or a substituent for a benzene ring; L represents an —S— group or —$CHR^{13}$— group; $R^{13}$ represents a hydrogen atom or an alkyl group having 1 to 20 carbon atoms; and $X^1$ and $X^{1'}$ each independently represents a hydrogen atom or a substituent for a benzene ring.

A detailed explanation on formula (R) will be given below.

(1) $R^{11}$ and $R^{11'}$ $R^{11}$ and $R^{11'}$ each independently represents a substituted or unsubstituted alkyl group having 1 to 20 carbon atoms. A substituent on the alkyl group is not particularly limited, but is preferably an aryl group, a hydroxy group, an alkoxy group, an aryloxy group, an alkylthio group, an arylthio group, an acylamino group, a sulfonamide group, a sulfonyl group, a phosphoryl group, an acyl group, a carbamoyl group, an ester group, an ureido group, an urethane group or a halogen atom.

(2) $R^{12}$ and $R^{12'}$, $X^1$ and $X^{1'}$ $R^{12}$ and $R^{2'}$ each independently represents a hydrogen atom or a substituent for a benzene ring, and $X^1$ and $X^{1'}$ also each independently represents a hydrogen atom or a substituent for a benzene ring. Each group substitutable on a benzene ring may preferably be an alkyl group, an aryl group, a halogen atom, an alkoxy group or an acylamino group.

(3) L

L represents an —S— group or a —$CHR^{13}$— group. $R^{13}$ represents a hydrogen atom or an alkyl group having 1 to 20 carbon atoms, and the alkyl group may have a substituent. Specific examples of the unsubstituted alkyl group for $R^{13}$ include a methyl group, an ethyl group, a propyl group, a butyl group, a heptyl group, an undecyl group, an isopropyl group, a 1-ethylpentyl group and a 2,4,4-trimethylpentyl group.

Examples of the substituent of the alkyl group are similar to the substituents of $R^{11}$, and include a halogen atom, an alkoxy group, an alkylthio group, an aryloxy group, an arylthio group, an acylamino group, a sulfonamide group, a sulfonyl group, a phosphoryl group, an oxycarbonyl group, a carbamoyl group and a sulfamoyl group.

(4) Preferred Substituent

Each of $R^{11}$ and $R^{11'}$ is preferably a secondary or tertiary alkyl group having 3 to 15 carbon atoms, and may specifically be an isopropyl group, an isobutyl group, a t-butyl group, a t-amyl group, a t-octyl group, a cyclohexyl group, a cyclopentyl group, a 1-methylcyclohexyl group or a 1-methylcyclopropyl group. Each of $R^{11}$ and $R^{11'}$ is more preferably a tertiary alkyl group with 4 to 12 carbon atoms, among which a t-butyl group, a t-amyl group or a 1-methylcyclohexyl group is more preferable, and a t-butyl group is most preferable.

Each of $R^{12}$ and $R^{12'}$ is preferably an alkyl group having 1 to 20 carbon atoms, and may specifically be a methyl group, an ethyl group, a propyl group, a butyl group, an isopropyl group, a t-butyl group, a t-amyl group, a cyclohexyl group, a 1-methylcyclohexyl group, a benzyl group, a methoxymethyl group, or a methoxyethyl group. It is more preferably a methyl group, an ethyl group, a propyl group, an isopropyl group or a t-butyl group.

Each of $X^1$ and $X^{11'}$ is preferably a hydrogen atom, a halogen atom or an alkyl group, and more preferably a hydrogen atom.

L is preferably a —$CHR^{13}$— group.

$R^{13}$ preferably represents a hydrogen atom or an alkyl group having 1 to 15 carbon atoms, and, as the alkyl group, preferred are a methyl group, an ethyl group, a propyl group, an isopropyl group or a 2,4,4-trimethylpentyl group. As $R^{13}$, particularly preferred are a hydrogen atom, a methyl group, an ethyl group, a propyl group or an isopropyl group.

In case where $R^{13}$ is a hydrogen atom, each of $R^{12}$ and $R^{12'}$ is preferably an alkyl group having 2 to 5 carbon atoms, more preferably an ethyl group or a propyl group, and most preferably an ethyl group.

In case where $R^{13}$ is a primary or secondary alkyl group having 1 to 8 carbon atoms, each of $R^{12}$ and $R^{12'}$ is preferably a methyl group. As the primary or secondary alkyl group having 1 to 8 carbon atoms for $R^3$, more preferred are a methyl group, an ethyl group, a propyl group or an isopropyl group, and further preferred is a methyl group, an ethyl group or a propyl group.

In case where $R^{11}$, $R^{11'}$, $R^{12}$ and $R^{12'}$ are all methyl groups, $R^{13}$ is preferably a secondary alkyl group. In such a case, the secondary alkyl group for $R^{13}$ is preferably an isopropyl group, an isobutyl group or a 1-ethylpentyl group, and more preferably an isopropyl group.

The aforementioned reducing agent shows difference thermal developability and different color tone of developed silver, etc. depending on a combination of $R^{11}$, $R^{11'}$, $R^{12}$, $R^{12'}$ and $R^{13}$. Since these properties may be regulated by a combination of two or more kinds of reducing agents, it is preferable to use two or more kinds of reducing agents in combination, depending on purposes.

Specific examples of the reducing agent including the compounds represented by formula (R) of the invention are shown below, but the invention is not limited thereto.

(Red-1)

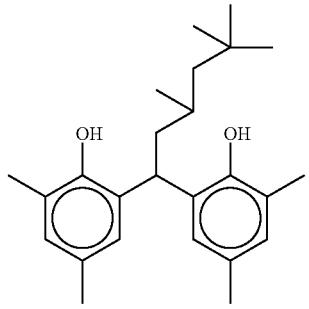

-continued
(Red-2)
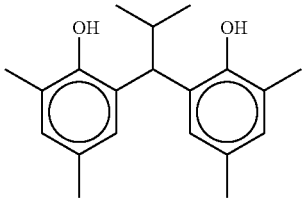
(Red-3)
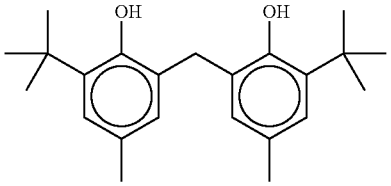
(Red-4)
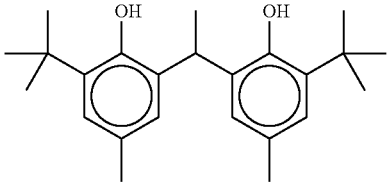
(Red-5)
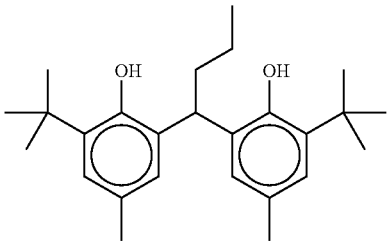
(Red-6)
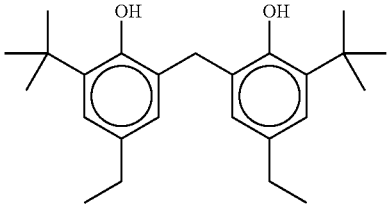
(Red-7)
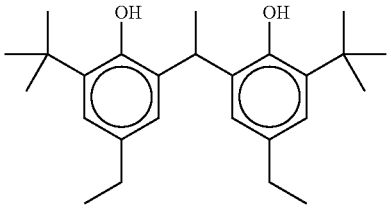
(Red-8)
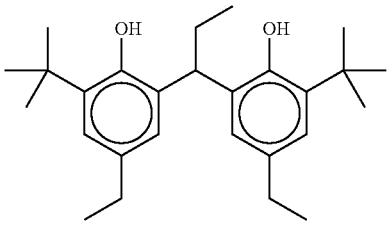
-continued
(Red-9)
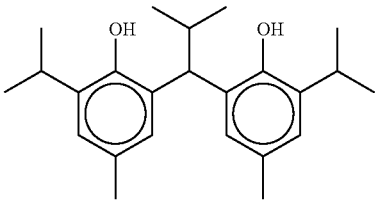
(Red-10)
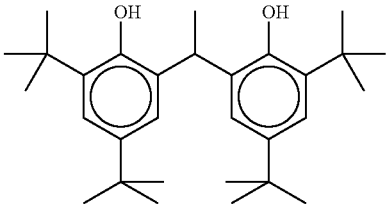
(Red-11)
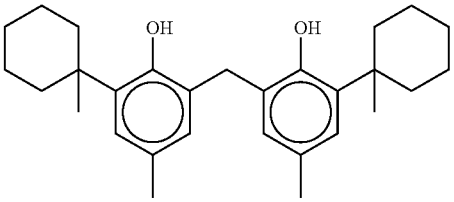
(Red-12)
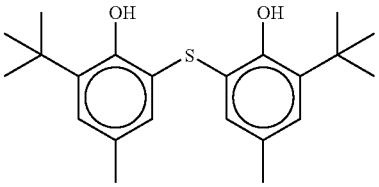
(Red-13)
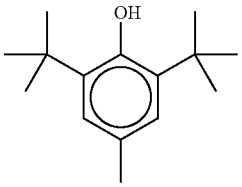
(Red-14)
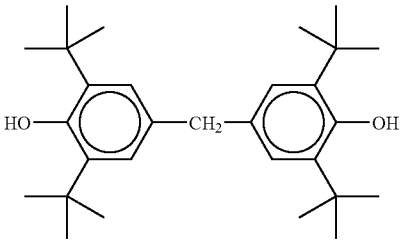
(Red-15)
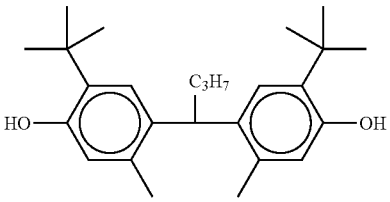

Examples of the reducing agent other than those described above are described in JP-A Nos. 2001-188314, 2001-209145, 2001-350235 and 2002-156727.

The compound of formula (R) may be dispersed and added in the photosensitive material by a method similar to that for the reducing agent of the invention.

A use ratio (R/(R1+R2)) of the compound represented by formula (R) and the compounds represented by formulas (R1) and (R2) of the invention is 90/10 to 0/100, preferably 70/30 to 0/100, and more preferably 50/50 to 0/100.

In case where the aforementioned reducing agent is used in combination with the reducing agent of the invention, a preferred use amount is such that a total amount is within the range described for the reducing agent of the invention.

1-2. Non-Photosensitive Organic Silver Salt

1) Composition

An organic silver salt employable in the invention is a non-photosensitive organic silver salt that is relatively stable to light but functions as a silver ion-supplying substance when heated to 80° C. or higher in the presence of an exposed photosensitive silver halide and a reducing agent, to thereby form a silver image. The organic silver salt may be an arbitrary organic substance that may be reduced by the reducing agent and can supply silver ions. Such non-photosensitive organic silver salt is described, for example, in JP-A No. 10-62899, paragraphs 0048–0049, EP-A No. 0,803,764A1, page 18, line 24 to page 19, line 37, EP-A No. 0,962,812A1, and JP-A Nos. 11-349591, 2000-7683 and 2000-72711. Among them, preferred is a silver salt of an organic acid, particularly a silver salt of a long-chain aliphatic carboxylic acid (having 10 to 30 carbon atoms, preferably 15 to 28 carbon atoms). Preferable examples of the aliphatic acid silver salt include silver lignocerate, silver behenate, silver arachidate, silver stearate, silver oleate, silver laurate, silver caproate, silver myristate, silver palmitate, silver erucate and a mixture thereof.

It is preferred, in the invention, among these aliphatic acid silver salts, to use an aliphatic acid silver salt having a silver behenate content of 50 to 100 mol %, more preferably 85 to 100 mol %, and further preferably 95 to 100 mol %. It is also preferable to use an aliphatic acid silver salt having a silver erucate content of 2 mol % or less, more preferably 1 mol % or less and further preferably 0.1 mol % or less. It is also preferable that a silver stearate content is 1 mol % or less. A silver stearate content of 1 mol % or less allows to obtain an organic acid silver salt having a low Dmin, a high sensitivity and an excellent image storability. The silver stearate content is more preferably 0.5 mol % or less and it is particularly preferable that silver stearate is substantially absent.

Also in case where the silver salt of organic acid includes silver arachidate, it is preferable to have a silver arachidate content of 6 mol % or less for obtaining an organic acid silver salt providing a low Dmin and an excellent image storability, more preferably 3 mol % or less.

2) Shape

The shape of particles of an organic silver salt usable in the present invention is not particularly limited, and may be a needle, rod, plate or flake shape.

Preferably, a flaky organic silver salt is used in the present invention. Herein, flaky organic silver salts are defined as follows. If the salt is examined through an electron microscope and the shape of the particles is considered to be approximately a rectangular parallelepiped, its sides are named "a", "b" and "c" in an order beginning with the shortest dimension ("c" may be equal to "b"), and the values of the two shortest sides "a" and "b" are used to calculate "x" by the following equation:

$$x=b/a$$

The value "x" is calculated for about 200 particles and if their mean value, x (mean)≧1.5, the particles are defined as flaky. Preferably, 30≧x (mean)≧1.5, and more preferably 20≧x (mean)≧2.0. Incidentally, the particles are needle-shaped if 1≦x (mean)<1.5.

Side "a" of a flaky particle can be regarded as the thickness of a plate-shaped particle having a principal face defined by sides "b" and "c". The mean value of "a" is preferably from 0.01 to 0.3 μm, and more preferably from 0.1 to 0.23 μm. The mean value of c/b is preferably from 1 to 9, more preferably from 1 to 6, still more preferably from 1 to 4, and particularly preferably from 1 to 3.

A sphere-corresponding diameter maintained within a range from 0.05 to 1 μm hinders coagulation in the photosensitive material and provides a satisfactory image storability. The sphere-corresponding diameter is preferably 0.1 to 1 μm. In the invention, the sphere-corresponding diameter may be determined by taking a photograph of a sample directly by an electron microscope and then executing an image processing on a negative.

In the aforementioned scale-shaped grains, a ratio of (sphere-corresponding diameter)/a of the grain is defined as an aspect ratio. The aspect ratio of the scale-shaped grain is preferably within a range from 1.1 to 30 in view of hindering coagulation in the photosensitive material and improving the image storability, more preferably from 1.1 to 15.

The particle sizes of the organic silver salt preferably have a monodispersed size distribution. In the monodispersed distribution, the standard deviation of the length of the minor axis or major axis of the particles divided by a length value of the minor axis or major axis, respectively, is preferably not more than 100%, more preferably not more than 80%, and still more preferably not more than 50%. The shape of particles of the salt can be determined from an observed image of a dispersion thereof through a transmission electron microscope.

The particle size distribution of the salt can alternatively be determined by employing the standard deviation of the volume weighted mean diameter of the particles, and is monodispersed if a percentage obtained by dividing the standard deviation of the volume weighted mean diameter by the volume weighted mean diameter (coefficient of variation) is not more than 100%, more preferably not more than 80%, and still more preferably not more than 50%. The particle size (volume weighted mean diameter) can be determined, for example, by applying laser light to the organic silver salt dispersed in a liquid and determining an autocorrelation function of the variation of fluctuation of scattered light with time.

3) Preparation

For manufacturing and dispersing the organic silver salt to be employed in the invention, a known method may be employed. For example, reference may be made to JP-A No. 10-62899, EP-A Nos. 0,803,763A1 and 0,962,812A1, JP-A Nos. 11-349591, 2000-7683, 2000-72711, 2001-163889, 2001-163890, 2001-163827, 2001-33907, 2001-188313, 2001-83652, 2002-6442, 2002-49117, 2002-31870 and 2002-107868.

Since the presence of a photosensitive silver salt when dispersing the organic silver salt causes an increase in the fog level and significantly decreases the sensitivity, it is preferable that the photosensitive silver salt is substantially absent upon dispersing. In the invention, the amount of the photosensitive silver salt in an aqueous dispersion in which dispersing is carried out is preferably 1 mol % or less per mole of organic silver salt in such dispersion, more preferably 0.1 mol % or less, and further preferably no positive addition of the photosensitive silver salt is carried out.

In the invention, the photosensitive material may be prepared by mixing an aqueous dispersion of the organic silver salt and an aqueous dispersion of the photosensitive silver salt, and a mixing ratio of the organic silver salt and the photosensitive silver salt may be selected depending on the purposes, however a proportion of the photosensitive silver salt to the organic silver salt is preferably within a range of 1 to 30 mol %, more preferably 2 to 20 mol %, and particularly preferably 3 to 15 mol %. Upon mixing, there is preferably employed a method of mixing two or more aqueous dispersions of the organic silver salt and two or more aqueous dispersions of the photosensitive silver salt, in order to regulate the photographic characteristics.

4) Addition amount

The organic silver salt of the invention may be employed in a desired amount, however, a total coated silver amount including silver halide is preferably within a range of 0.6 to 1.9 g/m$^2$, and, for improving the image storability, it is more preferably 1.0 to 1.6 g/m$^2$, and further preferably 1.0 to 1.5 g/m$^2$. An effect of the reducing agent of the invention is clearly exhibited at such a low silver coating amount.

1-3. Development Accelerator

In the photothermographic material of the invention, there is preferably employed, as a development accelerator, a sulfonamidephenol compound represented by formula (A) in JP-A Nos. 2000-267222 and 2000-330234, a hindered phenol compound represented by formula (II) in JP-A No.2001-92075, a hydrazine compound represented by formula (I) in JP-A Nos. 10-62895 and 11-15116, by formula (D) in JP-A No. 2002-156727 and by formula (1) in Japanese Patent Application No. 2001-074278, or a phenol or naphthol compound represented by formula (2) in JP-A No. 2001-264929. Such a development accelerator is used within a range of 0.1 to 20 mol % with respect to the reducing agent, preferably 0.5 to 10 mol %, and more preferably 1 to 5 mol %. It may be introduced into the photosensitive material by a method similar to that for the reducing agent, and it is particularly preferably added as a solid dispersion or an emulsified dispersion. In case of addition as an emulsified dispersion, the addition is preferably made as an emulsified dispersion prepared with a high-boiling solvent which is solid at the normal temperature and a low-boiling auxiliary solvent, or as so-called oilless emulsified dispersion without utilizing the high-boiling solvent.

In the invention, among the aforementioned development accelerators, a hydrazine compound represented by formula (D) in JP-A No. 2002-156727 and a phenol or naphthol compound represented by formula (2) in JP-A No. 2001-264929 are more preferable.

In the invention, a particularly preferred development accelerator is compounds represented by the following formulas (A-1) and (A-2).

$$Q_1\text{-NHNH-}Q_2 \qquad \text{Formula (A-1)}$$

In the formula, $Q_1$ represents an aromatic group or a heterocyclic group whose carbon atom bonds to —NHNH-$Q_2$; and $Q_2$ represents a carbamoyl group, an acyl group, an alkoxycarbonyl group, an aryloxycarbonyl group, a sulfonyl group or a sulfamoyl group.

In formula (A-1), the aromatic group or the heterocyclic group represented by $Q^1$ is preferably a 5- to 7-membered unsaturated ring. Preferred examples include a benzene ring, a pyridine ring, a pyrazine ring, a pyrimidine ring, a pyridazine ring, a 1,2,4-triazine ring, a 1,3,5-triazine ring, a pyrrole ring, an imidazole ring, a pyrazole ring, a 1,2,3-triazole ring, a 1,2,4-triazole ring, a tetrazole ring, a 1,3,4-thiadiazole ring, a 1,2,4-thiadiazole ring, a 1,2,5-thiadiazole ring, a 1,3,4-oxadiazole ring, a 1,2,4-oxadiazole ring, a 1,2,5-oxadiazole ring, a thiazole ring, an oxazole ring, an isothiazole ring, an isooxazole ring and a thiophene ring, and there is also preferred a condensed ring formed by mutual condensation of these rings.

These rings may have a substituent, and, in case where two or more substituents are present, such substituents may be mutually same or different. Examples of the substituent include a halogen atom, an alkyl group, an aryl group, a carbonamide group, an alkylsulfonamide group, an arylsulfonamide group, an alkoxy group, an aryloxy group, an alkylthio group, an arylthio group, a carbamoyl group, a sulfamoyl group, a cyano group, an alkylsulfonyl group, an arylsulfonyl group, an alkoxycarbonyl group, an aryloxycarbonyl group and an acyl group. In case where such a substituent is a substitutable group, it may further have a substituent, and examples of preferred substituent include a halogen atom, an alkyl group, an aryl group, a carbonamide group, an alkylsulfonamide group, an arylsulfonamide group, an alkoxy group, an aryloxy group, an alkylthio group, an arylthio group, an acyl group, an alkoxycarbonyl group, an aryloxycarbonyl group, a carbamoyl group, a cyano group, a sulfamoyl group, an alkylsulfonyl group, an arylsulfonyl group and an acyloxy group.

A carbamoyl group represented by $Q_2$ preferably has 1 to 50 carbon atoms, more preferably 6 to 40 carbon atoms, and may be, for example, non-substituted carbamoyl, methylcarbamoyl, N-ethylcarbamoyl, N-propylcarbamoyl, N-sec-butylcarbamoyl, N-octylcarbamoyl, N-cyclohexylcarbamoyl, N-tert-butylcarbamoyl, N-dodecylcarbamoyl, N-(3-dodecyloxypropyl)carbamoyl, N-octadecylcarbamoyl, N-{3-(2,4-tert-pentylphenoxy)propyl}carbamoyl, N-(2-hexyldecyl)carbamoyl, N-phenylcarbamoyl, N-(4-dodecyloxyphenyl)carbamoyl, N-(2-chloro-5-dodecyloxylcarbonylphenyl)carbamoyl, N-naphthylcarbamoyl, N-3-pyridylcarbamoyl, or N-benzylcarbamoyl.

An acyl group represented by $Q_2$ preferably has 1 to 50 carbon atoms, more preferably 6 to 40 carbon atoms, and may be, for example, formyl, acetyl, 2-methylpropanoyl, cyclohexylcarbonyl, octanoyl, 2-hexyldecanoyl, dodecanoyl, chloroacetyl, trifluoroacetyl, benzoyl, 4-dodecyloxybenzoyl, or 2-hydroxymethylbenzoyl. An alkoxycarbonyl group represented by $Q_2$ preferably has 2 to 50 carbon atoms, more preferably 6 to 40 carbon atoms, and may be, for example, methoxycarbonyl, ethoxycarbonyl, isobutyloxycarbonyl, cyclohexyloxycarbonyl, dodecyloxycarbonyl or benzyloxycarbonyl.

An aryloxycarbonyl group represented by $Q_2$ preferably has 7 to 50 carbon atoms, more preferably 7 to 40 carbon atoms, and may be, for example, phenoxycarbonyl, 4-octyloxyphenoxycarbonyl, 2-hydroxymethylphenoxycarbonyl, or 4-dodecyloxyphenoxycarbonyl. A sulfonyl group represented by $Q_2$ preferably has 1 to 50 carbon atoms, more preferably 6 to 40 carbon atoms, and may be, for example, methylsulfonyl, butylsulfonyl, octylsulfonyl, 2-hexadecylsulfonyl, 3-dodecyloxypropylsulfonyl, 2-octyloxy-5-tert-octylphenylsulfonyl or 4-dodecyloxyphenylsulfonyl.

A sulfamoyl group represented by $Q_2$ preferably has 0 to 50 carbon atoms, more preferably 6 to 40 carbon atoms, and may be, for example, non-substituted sulfamoyl, N-ethylsulfamoyl, N-(2-ethylhexyl)sulfamoyl, N-decylsulfamoyl, N-hexadecylsulfamoyl, N-{3-(2-ethylhexyloxy)propyl}sulfamoyl, N-(2-chloro-5-dodecyloxycarbonylphenyl)sulfamoyl, or N-(2-tetradecyloxyphenyl)sulfamoyl. A group represented by $Q_2$ may further have, in a substitutable position, a group cited before as a substituent group for a 5- to 7-membered unsaturated ring represented by $Q_1$, and, in case two or more substituents are present, they may be mutually same or different.

Preferred compounds represented by the formula (A-1) are shown below. For $Q_1$, preferred is a 5- or 6-membered unsaturated ring, and more preferred is a benzene ring, a pyrimidine ring, a 1,2,3-triazole ring, a 1,2,4-triazole ring, a tetrazole ring, a 1,3,4-thiadiazole ring, a 1,2,4-thiadiazole ring, a 1,3,4-oxadiazole ring, a 1,2,4-oxadiazole ring, a thiazole ring, an oxazole ring, an isothiazole ring, an isooxazole ring or a ring formed by a condensation of the aforementioned ring with a benzene ring or an unsaturated hetero ring. Also $Q_2$ is preferably a carbamoyl group, particularly preferably a carbamoyl group having a hydrogen atom on a nitrogen atom.

Formula (A-2)

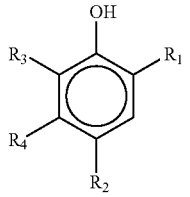

In formula (A-2), $R_1$ represents an alkyl group, an acyl group, an acylamino group, a sulfonamide group, an alkoxycarbonyl group, or a carbamoyl group. $R_2$ represents a hydrogen atom, a halogen atom, an alkyl group, an alkoxy group, an aryloxy group, an alkylthio group, an arylthio group, an acyloxy group or a carbonate ester group. $R_3$ and $R_4$ each represents a substituent for a benzene ring, as cited in the examples of the substituent for formula (A-1). $R_3$ and $R_4$ may be mutually bonded to form a condensed ring.

$R_1$ is preferably an alkyl group having 1 to 20 carbon atoms (such as a methyl group, an ethyl group, an isopropyl group, a butyl group, a tert-octyl group, or a cyclohexyl group), an acylamino group (such as an acetylamino group, a benzoylamino group, a methylureide group or a 4-cyanophenylureide group), or a carbamoyl group (such as an n-butylcarbamoyl group, an N,N-diethylcarbamoyl group, a phenylcarbamoyl group, a 2-chlorophenylcarbamoyl group, or a 2,4-dichlorophenylcarbamoyl group), and more preferably an acylamino group (including an ureide group and an urethane group). $R_2$ is preferably a halogen atom (more preferably, a chlorine atom or a bromine atom), an alkoxy group (such as a methoxy group, a butoxy group, an n-hexyloxy group, an n-decyloxy group, a cyclohexyloxy group, or a benzyloxy group), or an aryloxy group (such as a phenoxy group or a naphthoxy group).

$R_3$ is preferably a hydrogen atom, a halogen atom or an alkyl group having 1 to 20 carbon atoms, and a halogen atom is most preferable. $R_4$ is preferably a hydrogen atom, an alkyl group, or an acylamino group, and an alkyl group or an acylamino group is more preferable. Preferred examples of such a substituent are similar to those for $R_1$. In case where $R_4$ is an acylamino group, it is also preferable that $R_4$ is bonded with $R_3$ to form a carbostyryl ring.

In formula (A-2), in case where $R_3$ and $R_4$ are mutually bonded to form a condensed ring, a naphthalene ring is particularly preferable as such condensed ring. The naphthalene ring may have substituent examples of which are the same as those of the substituent for formula (A-1). In case where formula (A-2) represents a naphthol compound, $R_1$ is preferably a carbamoyl group, and particularly a benzoyl group. $R_2$ is preferably an alkoxy group or an aryloxy group, particularly an alkoxy group.

Specific preferred examples of the development accelerator of the invention are shown below, however, the invention is not limited thereto.

(A-1)

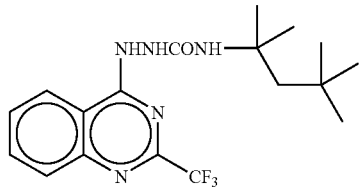

(A-2)

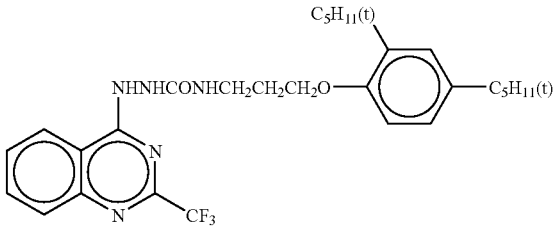

(A-3)

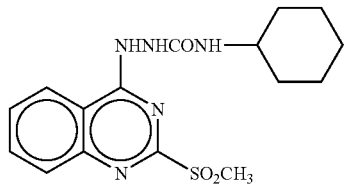

(A-4)

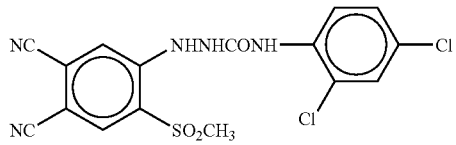

(A-5)

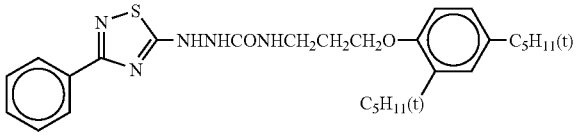

(A-6)

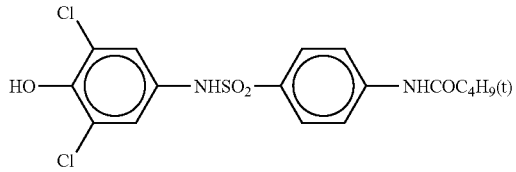

-continued (A-7)

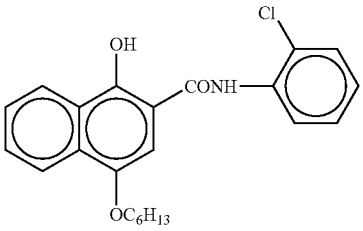

(A-8)

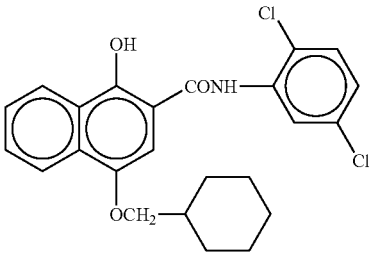

(A-9)

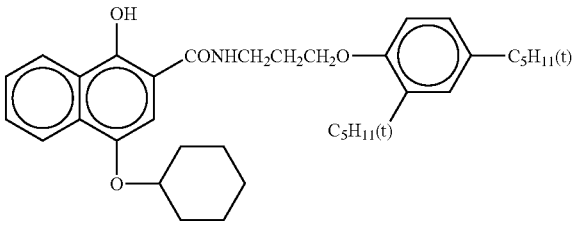

(A-10)

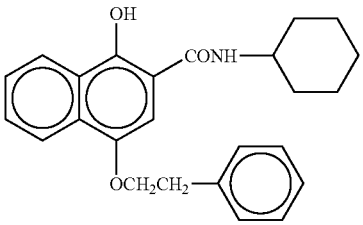

(A-11)

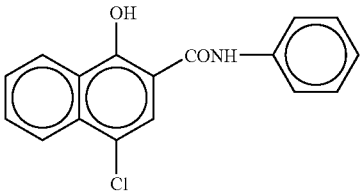

(A-12)

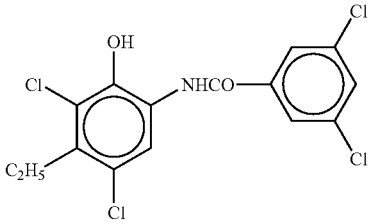

1-4. Hydrogen Bond-forming Compound

In the invention, in case where the reducing agent has an aromatic hydroxyl group (—OH) or an amino group (—NHR, R being a hydrogen atom or an alkyl group), particularly in case where it is an aforementioned bisphenol, it is preferable to also employ a non-reducing compound having a group capable of forming a hydrogen bond with such a group.

A group capable of forming a hydrogen bond with a hydroxyl group or an amino group may be, for example, a phosphoryl group, a sulfoxide group, a sulfonyl group, a carbonyl group, an amide group, an ester group, an urethane group, an ureide group, a tertiary amino group or a nitrogen-containing aromatic group. Among these, preferred are a compound having a phosphoryl group, a sulfoxide group, an amide group (not having >N—H group but blocked like >N—Ra, in which Ra is a substituent except H), an urethane group (not having >N—H group but blocked like >N—Ra, in which Ra is a substituent except H), or an ureide group (not having >N—H group but blocked like >N—Ra, in which Ra is a substituent except H).

In the invention, a particularly preferred hydrogen bond-forming compound is represented by the following formula (D):

Formula (D)

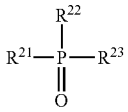

In formula (D), $R^{21}$ to $R^{23}$ each independently represents an alkyl group, an aryl group, an alkoxy group, an aryloxy group, an amino group or a heterocyclic group, which may be unsubstituted or may have a substituent.

In case where any of $R^{21}$ to $R^{23}$ has a substituent, such a substituent may be a halogen atom, an alkyl group, an aryl group, an alkoxy group, an amino group, an acyl group, an acylamino group, an alkylthio group, an arylthio group, a sulfonamide group, an acyloxy group, an oxycarbonyl group, a carbamoyl group, a sulfamoyl group, a sulfonyl group or a phosphoryl group, among which preferred is an alkyl group or an aryl group such as a methyl group, an ethyl group, an isopropyl group, a t-butyl group, a t-octyl group, a phenyl group, a 4-alkoxyphenyl group or a 4-acyloxyphenyl group.

Specific examples of an alkyl group constituting any of $R^{21}$ to $R^{23}$ include a methyl group, an ethyl group, a butyl group, an octyl group, a dodecyl group, an isopropyl group, a t-butyl group, a t-amyl group, a t-octyl group, a cyclohexyl group, a 1-methylcyclohexyl group, a benzyl group, a phenetyl group, and a 2-phenoxypropyl group.

Specific examples of the aryl group include a phenyl group, a cresyl group, a xylyl group, a naphthyl group, a 4-t-butylphenyl group, a 4-t-octylphenyl group, a 4-anisidyl group and a 3,5-dichlorophenyl group.

Specific examples of the alkoxy group include a methoxy group, an ethoxy group, a butoxy group, an octyloxy group, a 2-ethylhexyloxy group, a 3,5,5-trimethylhexyloxy group, a dodecyloxy group, a cyclohexyloxy group, a 4-methylcyclohexyloxy group and a benzyloxy group.

Specific examples of the aryloxy group include a phenoxy group, a cresyloxy group, an isopropylphenoxy group, a 4-t-butylphenoxy group, a naphthoxy group and a biphenyloxy group.

Specific examples of the amino group include a dimethylamino group, a diethylamino group, a dibutylamino group, a dioctylamino group, an N-methyl-N-hexylamino group, a dicyclohexylamino group, a diphenylamino group and an N-methyl-N-phenylamino group.

Each of $R^{21}$ to $R^{23}$ is preferably an alkyl group, an aryl group, an alkoxy group, or an aryloxy group. For exerting the effect of the invention, it is preferable that at least one or more of $R^{21}$ to $R^{23}$ is an alkyl group or an aryl group, and more preferable that each of two or more is an alkyl group or an aryl group. It is also preferred that $R^{21}$ to $R^{23}$ are the same groups, in consideration of availability in view of costs.

Specific examples of the hydrogen bond-forming compound, including the compounds represented by formula (D) of the invention are shown below, but the invention is not limited thereto.

(D-1)

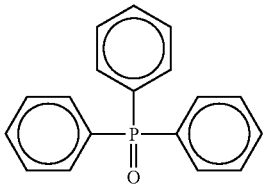

(D-2)

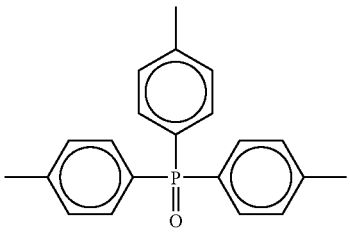

(D-3)

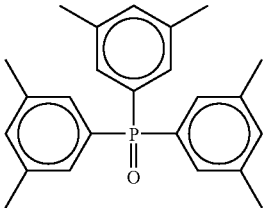

(D-4)

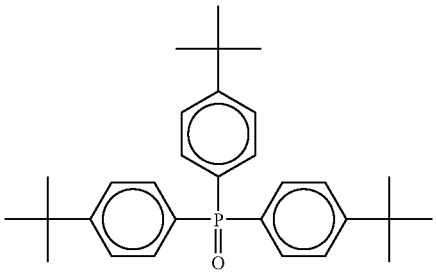

(D-5)

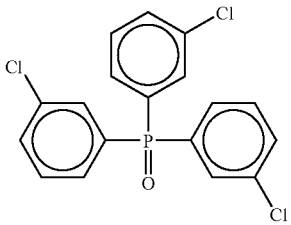

-continued (D-6)

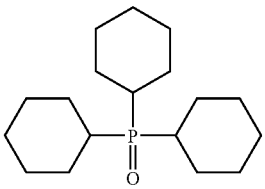

(D-7)

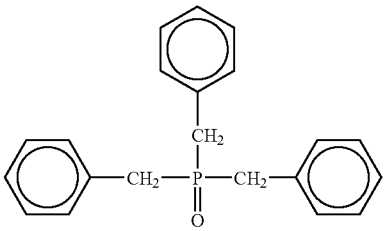

(D-8)

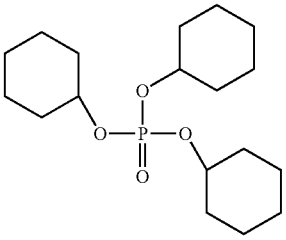

(D-9)

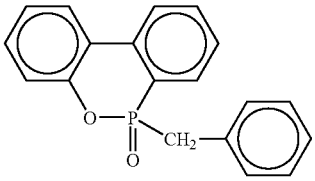

(D-10)

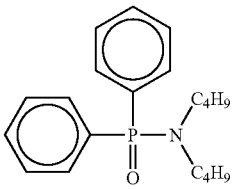

(D-11)

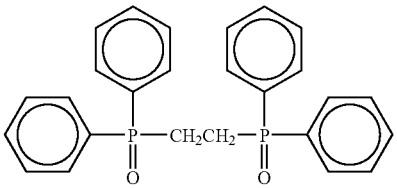

(D-12)

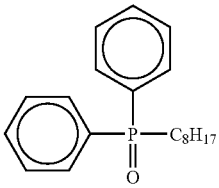

(D-13)

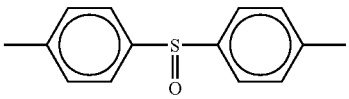

-continued (D-14)

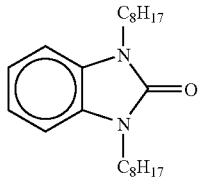

(D-15)

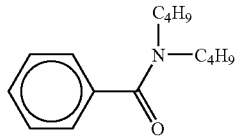

Specific examples of the hydrogen bond-forming compound, other than those listed in the foregoing, are described in European Patent No. 1096310, JP-A No. 2002-156727 and Japanese Patent Application No. 2001-124796.

The compound of formula (D) of the invention, like the reducing agent, may be contained in the coating liquid and used in the photosensitive material, for example, in a form of a solution, an emulsified dispersion or a dispersion of fine solid particles, however is preferably used as a solid dispersion. The compound of the invention forms, in a solution state, a complex by a hydrogen bonding with a compound having a phenolic hydroxyl group or an amino group, and may be isolated as a complex in a crystalline state depending on a combination of the reducing agent and the compound of formula (D) of the invention.

It is particularly preferable, for obtaining a stable performance, to use the thus isolated crystalline powder in a dispersion of fine solid particles. There is also preferably employed a method of mixing the reducing agent and the compound of formula (D) of the invention in a powder state, and forming a complex at the dispersion in a sand grinder mill or the like with a suitable dispersant.

The compound of formula (D) of the invention is preferably employed within a range 1 to 200 mol % with respect to the reducing agent, more preferably within a range of 10 to 150 mol % and further preferably 20 to 100 mol %.

1-5. Photosensitive Silver Halide

1) Halogen Composition

The halogen composition of the photosensitive silver halide grains for use in the present invention is not specifically limited, and there may be used silver chloride, silver chlorobromide, silver bromide, silver iodobromide, silver iodochlorobromide. Regarding the halide distribution in individual grains, the halide may be uniformly distributed throughout the grain, or may stepwise distributed, or may continuously distributed. Silver halide grains having a core/shell structure are preferably used. Preferably, the core/shell structure of the grains has 2 to 5 layers, more preferably 2 to 4 layers. Also a technique to localize silver bromide on the surface of silver chloride or silver chlorobromide grains is preferably employed.

2) Grain Forming Method

Methods of forming photosensitive silver halides are well known in the art and may be employed in the present invention, for example, as described in *Research Disclosure* No.17029 (June 1978), and U.S. Pat. No. 3,700,458. More specifically, a silver source-supplying compound and a halogen source-supplying compound are added to a solution of gelatin or any other polymer to prepare a photosensitive silver halide, followed by admixing with an organic silver salt. Further, the method described in JP-A No.11-119374, paragraphs [0217] to [0244]; and the methods described in JP-A Nos. 11-352627 and 2000-347335 are also preferable.

3) Grain Size

The photosensitive silver halide grains preferably have a smaller size in order to prevent the formed images from becoming cloudy. Specifically, the size is preferably at most 0.20 μm, more preferably falling between 0.01 μm and 0.15 μm, and even more preferably between 0.02 μm and 0.12 μm. The grain size as used herein refers to the diameter of the circular image having the same area as the projected area of each silver halide grain (for tabular grains, the main face of each grain is projected to determine the projected area of the grain).

4) Grain Shape

Silver halide grains may have various shapes including, for example, cubic grains, octahedral grains, tetradeca grains, dodeca grains, tabular grains, spherical grains, rod-like grains, and potato-like grains. Cubic silver halide grains are especially preferred for use in the present invention. Also preferred are roundish silver halide grains with their corners rounded. The surface index (Miller index) of the outer surface of the photosensitive silver halide grains for use in the present invention is not specifically limited, but it is preferred that the proportion of {100} plane, which ensures higher spectral sensitization when it has adsorbed a color-sensitizing dye, in the outer surface is large. Preferably, the proportion of {100} plane is at least 50%, more preferably at least 65%, and even more preferably at least 80%. The Miller index expressed by the proportion of {100} plane can be obtained according to the method described in *J. Imaging Sci.*, written by T. Tani, 29, 165 (1985), based on the adsorption dependency of {111} plane and {100} plane for sensitizing dyes.

5) Heavy Metal

The photosensitive silver halide grains for use in the present invention may contain a metal or metal complex of Groups VIII to X of the Periodic Table (including Groups I to XVIII). As the metal or the central metal of metal complex of Groups VIII to X, preferably used is rhodium, ruthenium or iridium. In the present invention, one metal complex may be used alone, or two or more metal complexes of the same species or different species of metals may be used in combination. The metal or metal complex content of the grains preferably falls between $1\times10^{-9}$ mols and $1\times10^{-3}$ mols per mol of silver. Such heavy metals and metal complexes, and methods of adding them to silver halide grains are described in, for example, JP-A No.7-225449, JP-A No.11-65021, paragraphs [0018] to [0024], and JP-A No. 11-119374, paragraphs [0227] to [0240].

Silver halide grains having a hexacyano-metal complex in their outermost surface are preferred for use in the present invention. The hexacyano-metal complex includes, for example, $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$, and $[Re(CN)_6]^{3-}$. The hexacyano-Fe complexes are preferably used in the present invention.

As hexacyano-metal complexes exist in the form of ions in their aqueous solutions, their counter cations are of no importance. However, it is preferable to use as the counter cation any of alkali metal ions such as sodium ion, potassium ion, rubidium ion, cesium ion and lithium ion; ammonium ion, and alkylammonium ion (e.g., tetramethylammonium ion, tetraethylammonium ion, tetrapropylammonium ion and tetra(n-butyl)ammonium ion) due to good water miscibility and easy handling of silver halide emulsion sedimentation.

The hexacyano-metal complex may be added in the form of a solution thereof in water or in a mixed solvent of water and an organic solvent miscible with water (for example, alcohols, ethers, glycols, ketones, esters, amides), or in the form of a mixture with gelatin.

The amount of the hexacyano-metal complex to be added preferably falls between $1\times10^{-5}$ mols and $1\times10^{-2}$ mols, per mol of silver, and more preferably between $1\times10^{-4}$ mols and $1\times10^{-3}$ mols.

In order to make the hexacyano-metal complex exist in the outermost surface of silver halide grains, addition of the complex is conducted in the charging step, i.e., after an aqueous silver nitrate solution to form silver halide grains has been added to a reaction system but before the grains having formed are subjected to chemical sensitization such as chalcogen sensitization with sulfur, selenium or tellurium or noble metal sensitization with gold or the like, or alternatively the complex is directly added to the grains in the step of rinsing, dispersing or prior to conducting chemical sensitization. In order to prevent the silver halide grains from excessively growing, it is desirable to add the hexacyano-metal complex to the grains immediately after they are formed, and preferably before the charging step is completed.

The hexacyano-metal complex, when added to silver halide grains after an aqueous solution of silver nitrate has been added to the reaction system but just before the grains are completely formed, can be adsorbed by the grains formed to exist on the outermost surface thereof. Most of the complex thus added can form hardly-soluble salts with the silver ions present on the surface of the grains. Since the silver salt of hexacyano-iron(II) is more hardly soluble than AgI, fine grains are prevented from re-dissolving. Consequently, fine silver halide grains having a small grain size can be produced.

The addition of the hexacyano metal complex may be started after 96 mass % of the total silver nitrate for grain formation is added, preferably after 98 mass % and particularly preferably after 99 mass %.

Such hexacyano metal complex, in case of addition after the addition of aqueous silver nitrate solution but immediately before the completion of grain formation, may be adsorbed on the outermost surface of silver halide grains, and mostly forms a low-soluble salt with silver ions on the surface of the grains. Such silver salt of hexacyano ferrate (II), being less soluble than AgI, can avoid re-dissolution of small grains, thereby enabling to produce fine silver halide grains of a smaller grain size.

Also metal atoms (for example $[Fe(CN)_6]^{4-}$) that may be included in the silver halide grains to be employed in the invention, a desalting method and a chemical sensitizing method of the silver halide emulsion are described in JP-A Nos. 11-84574, paragraphs 0046–0050, 11-65021, paragraphs 0025–0031, and 11-119374, paragraphs 0242–0250.

6) Gelatin

Various gelatins may be used as gelatin contained in the photosensitive silver halide emulsion to be employed in the invention. It is necessary to maintain a satisfactory dispersion state of the photosensitive silver halide emulsion in a coating liquid containing an organic silver salt, and it is preferable to use gelatin having a molecular weight of 10,000 to 1,000,000. It is also preferable to execute a phthalation process on a substituent of gelatin. Such gelatin may be used at grain formation or at dispersion after desalting process, however it is preferably used at the grain formation.

7) Sensitizing Dye

For use in the invention, there may be advantageously selected a sensitizing dye that can spectrally sensitize the silver halide grains in a desired wavelength region upon adsorption thereon and has a spectral sensitivity matching the spectral characteristics of an exposure light source. Examples of sensitizing dye and a method of addition thereof includes a description in JP-A No. 11-65021, paragraphs 0103–0109, a compound represented by formula (II) in JP-A No. 10-186572, a dye represented by formula (I) and a description of a paragraph 0106 in JP-A No. 11-119374, a description in U.S. Pat. No. 5,510,236, a dye described in an example 5 of U.S. Pat. No. 3,871,887, dyes disclosed in JP-A Nos. 2-96131 and 59-48753, and descriptions in EP-A No. 0,803,764A1, page 19, line 38 to page 20, line 35, and JP-A Nos. 2001-272747, 2001-290238 and 2002-23306. These sensitizing dyes may be used singly or in combination of two or more kinds. In the invention, the sensitizing dye is added to the silver halide emulsion preferably in a period from the end of a desalting process to a coating, and more preferably in a period from the end of the desalting process to the end of a chemical ripening process.

An amount of the sensitizing dye in the invention may be selected according to a desired sensitivity or a desired fog level, however it is preferably within a range of $10^{-6}$ to 1 mole per mole of silver halide in the photosensitive layer, more preferably $10^{-4}$ to x $10^{-1}$ moles.

In the invention, in order to improve the spectral sensitizing efficiency, there may be employed a super-sensitizer. Examples of the super-sensitizer employable in the invention includes compounds described in EP-A No. 587,338, U.S. Pat. Nos. 3,877,943 and 4,873,184 and JP-A Nos. 5-341432, 11-109547 and 10-111543.

8) Chemical Sensitization

The photosensitive silver halide grains to be employed in the invention are preferably chemically sensitized by a sulfur sensitizing method, a selenium sensitizing method or a tellurium sensitizing method. For the sulfur sensitization, the selenium sensitization and the tellurium sensitization, a known compound may be advantageously employed such as one described in JP-A No. 7-128768. In the invention, the tellurium sensitization is preferable, and a compound described in JP-A No. 11-65021, paragraph 0030 and those represented by formulas (II), (III) and (IV) in JP-A No. 5-313284 are more preferable.

The photosensitive silver halide grains of the invention are preferably chemically sensitized by a gold sensitization method either in combination with the aforementioned chalcogen sensitization or singly. A gold sensitizer with monovalent or trivalent gold is preferable, and is preferably an ordinarily employed gold sensitizer. Representative examples include chloroauric acid, bromoauric acid, potassium chloroaurate, potassium bromoaurate, auric trichloride, potassium aurithiocyanate, potassium iodoaurate, tetracyanoauric acid, ammonium aurothiocyanate, and pyridyl trichlorogold. In addition, there may also be advantageously employed gold sensitizers described in U.S. Pat. No. 5,858,637 and Japanese Patent Application No. 2001-79450.

In the invention, the chemical sensitization may be executed any time after grain formation and before coating, and may be executed, after desalting, (1) before spectral sensitization, (2) simultaneous with spectral sensitization, (3) after spectral sensitization, or (4) immediately before coating.

An amount of the sulfur, selenium or tellurium sensitizer employed in the invention is variable depending on the silver halide grains to be used and chemical ripening conditions, however it is within a range of $10^{-8}$ to $10^{-2}$ moles per 1 mole of silver halide, preferably $10^{-7}$ to $10^{-3}$ moles.

An amount of the gold sensitizer is variable depending on various conditions, however it is generally within a range of $10^{-7}$ to $10^{-3}$ moles per 1 mole of silver halide, preferably $10^{-6}$ to $5\times10^{-4}$ moles.

The chemical sensitization in the invention is not particularly restricted in conditions, but there are generally selected a pH of 5 to 8, a pAg value of 6 to 11 and a temperature of 40 to 95° C.

In the silver halide emulsion to be employed in the invention, a thiosulfonic acid compound may be added by a method described in EP-A No. 293,917.

In the photosensitive silver halide grains of the invention, a reducing agent is preferably employed. As a specific compound for the reduction sensitization, ascorbic acid or thiourea dioxide is preferable, and there may also be advantageously employed stannous chloride, aminoiminomethane sulfinic acid, a hydrazine derivative, a borane compound, a silane compound, or a polyamine compound. The reduction sensitizer may be added in any step in the photosensitive emulsion preparing process from a crystal growing step to an adjusting step immediately before coating. It is also preferred to execute the reduction sensitization by ripening the emulsion at a pH value of 7 or higher or at a pAg value of 8.3 or lower, or by introducing a single addition part of silver ions in the course of grain formation.

9) Compound of which a 1-Electron Oxidized Member, Formed by a 1-electron Oxidation, is Capable of Releasing 1 or More Electrons The photothermographic material of the invention preferably includes a compound of which a 1-electron oxidized member, formed by a 1-electron oxidation, is capable of releasing 1 or more electrons. Such compound is employed either singly or in combination with various aforementioned chemical sensitizers and can provide an increase in the sensitivity of silver halide.

The compound of which a 1-electron oxidized member, formed by a 1-electron oxidation, is capable of releasing 1 or more electrons, to be included in the photothermographic material of the invention is a compound selected from following types 1 to 5.

(Type 1)

A compound of which a 1-electron oxidized member, formed by a 1-electron oxidation, is capable of causing an ensuing bond cleaving reaction thereby further releasing two or more electrons.

(Type 2)

A compound of which a 1-electron oxidized member, formed by a 1-electron oxidation, is capable of causing an ensuing bond cleaving reaction thereby further releasing one electron, and which has, within a same molecule, two or more groups adsorbable to the silver halide.

(Type 3)

A compound of which a 1-electron oxidized member, formed by a 1-electron oxidation, is capable, after an ensuing bond forming process, of further releasing one or more electrons.

(Type 4)

A compound of which a 1-electron oxidized member, formed by a 1-electron oxidation, is capable, after an ensuing intramolecular ring-opening reaction, of further releasing one or more electrons.

(Type 5)

A compound represented by X—Y in which X represents a reducing group while Y is a releasable group, and a 1-electron oxidized member, formed by a 1-electron oxidation of the reducing group represented by X, causes an ensuing X—Y bond cleaving reaction to release Y and to form an X radical, thereby further releasing therefrom one electron.

Among the aforementioned compounds of types 1 and 3 to 5, either "a compound having, within the molecule, a group adsorbable to silver halide" or "a compound having, within the molecule, a partial structure of a spectral sensitizing dye" is preferable, and "a compound having, within the molecule, a group adsorbable to silver halide" is more preferable. Among the compounds of the types 1 to 4, "a compound having, as an adsorbable group, a nitrogen-containing heterocyclic group substituted with two or more mercapto groups".

In the following, a detailed explanation will be given on the compounds of the types 1 to 5.

In the compound of the type 1, "a bond-cleaving reaction" specifically means a cleaving of a carbon-carbon, carbon-silicon, carbon-hydrogen, carbon-boron, carbon-tin or carbon-germanium interatomic bond, and a cleaving of a carbon-hydrogen bond may further be associated. The compound of the type 1, only after it is subjected to a 1-electron oxidation thereby forming a 1-electron oxidized member, can undergo a bond cleaving reaction thereby further releasing two or more (preferably three or more) electrons.

Among the compounds of the type 1, preferred ones are represented by formula (A), (B), (1), (2) or (3).

Formula (A)

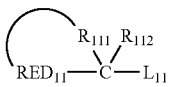

Formula (B)

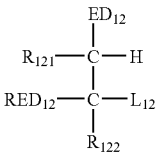

In formula (A), $RED_{11}$, represents a reducing group that may be subjected to a 1-electron oxidation; $L_{11}$ represents a releasable group; $R_{112}$ represents a hydrogen atom or a substituent; and $R_{111}$ represents a non-metal atomic group capable of forming, together with a carbon atom (C) and $RED_{11}$, a cyclic structure corresponding to a tetrahydro member, a hexahydro member or an octahydro member of a 5- or 6-membered aromatic ring (including an aromatic heterocycle).

In formula (B), $RED_{12}$ represents a reducing group that may be subjected to a 1-electron oxidation; $L_{12}$ represents a releasable group; $R_{121}$, and $R_{122}$ each represents a hydrogen atom or a substituent; and $ED_{12}$ represents an electron donating group. In formula (B), $R_{121}$, and $RED_{12}$, $R_{121}$, and $R_{122}$, or $ED_{12}$ and $RED_{12}$ may be mutually bonded to form a ring structure.

The compound represented by formula (A) or formula (B) is capable, after the reducing group represented by $RED_{11}$ or $RED_{12}$ is subjected to a 1-electron oxidation, of spontaneously releasing $L_{11}$ or $L_{12}$ by a bond cleaving reaction, thereby releasing further two or more, preferably three or more, electrons.

Formula (1)

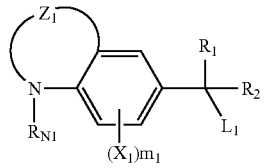

Formula (2)

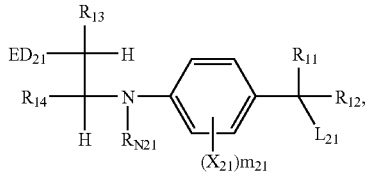

Formula (3)

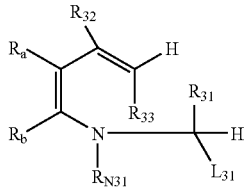

In formula (1), $Z_1$ represents an atomic group capable of forming a 6-membered ring together with a nitrogen atom and two carbon atoms of a benzene ring; $R_1$, $R_2$ and $R_{N1}$ each represents a hydrogen atom or a substituent; $X_1$ represents a substituent substitutable on the benzene ring; ml represents an integer from 0 to 3; and $L_1$ represents a releasable group. In formula (2), $ED_2$, represents an electron donating group; $R_{11}$, $R_{12}$, $R_{N21}$, $R_{13}$ and $R_{14}$ each represents a hydrogen atom or a substituent; $X_2$, represents a substituent substitutable on a benzene ring; $m_{21}$ represents an integer from 0 to 3; and $L_{21}$ represents a releasable group. $R_{N21}$, $R_{13}$, $R_{14}$, $X_{21}$ and $ED_{21}$ may be mutually bonded to form a ring structure. In formula (3), $R_{32}$, $R_{33}$, $R_{31}$, $R_{N31}$, $R_a$ and $R_b$ each represents a hydrogen atom or a substituent; and $L_{31}$ represents a releasable group. However, in case $R_{N31}$ represents a group other than an aryl group, $R_a$ and $R_b$ are mutually bonded to form an aromatic ring.

These compounds are capable, after being subjected to a 1-electron oxidation, of spontaneously releasing $L_1$, $L_{21}$ or $L_{31}$ by a bond cleaving reaction, thereby releasing further two or more, preferably three or more, electrons.

In the following, a detailed explanation will be given on the compound represented by formula (A).

In formula (A), the reducing group represented by $RED_{11}$ that may be subjected to a 1-electron oxidation is a group capable of forming a specific ring by bonding with $RED_{111}$ to be explained later, and can more specifically be a divalent group formed by eliminating one hydrogen atom, in a position suitable for ring formation, from a following monovalent group, which can for example be an alkylamino group, an arylamino group (such as an anilino group or a naphthylamino group), a heterocyclic amino group (such as benzothiazolylamino group or a pyrolylamino group), an alkylthio group, an arylthio group (such as a phenylthio group), a heterocyclic thio group, an alkoxy group, an arylxoy group (such as a phenoxy group), a heterocyclic oxy group, an aryl group (such as a phenyl group, a naphthyl group or an anthranyl group), or an aromatic or non-aromatic heterocyclic group (a 5- to 7-membered, single-ringed or condensed-ringed heterocyclic group containing at least one hetero atom among a nitrogen atom, a sulfur atom, an oxygen atom and a selenium atom, such as a tetrahydroquinoline ring, a tetrahydroisoquinoline ring, a tetrahydroquinoxaline ring, a tetrahydroquinazoline ring, an indoline ring, an indole ring, an indazole ring, a carbazole ring, a phenoxadine ring, a phenothiazine ring, a benzothiazoline ring, a pyrrole ring, an imidazole ring, a thiazoline ring, a piperidine ring, a pyrrolidine ring, a morpholine ring, a benzoimidazole ring, a benzoimidazoline ring, a benzoxazoline ring or a methylenedioxyphenyl ring) (hereinafter $RED_{11}$ being represented by a name of a monovalent group for the purpose of convenience). The $RED_{11}$ may also have a substituent.

In the invention, a substituent means one selected from following groups, unless otherwise specified: a halogen atom, an alkyl group (including an araylkyl group, a cycloalkyl group, an active methine group etc.), an alkenyl group, an alkinyl group, an aryl group, a heterocyclic group (in any substituting position), a heterocyclic group containing a quaternary nitrogen atom (such as a pyridinio group, an imidazolio group, a quinolinio group or a isoquinolinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a carbonimidoyl group, a thiocarbamoyl group, a hydroxy group, an alkoxy group (including a group containing an ethyleneoxy group or a propyleneoxy group in repetition), an aryloxy group, a heterocyclic oxy group, an acyloxy group, an (alkoxy or aryloxy)carbonyloxy group, a carbamoyloxy group, a sulfonyloxy group, an amino group, an (alkyl, aryl or heterocyclic)amino group, an acylamino group, a sulfonamide group, an ureido group, a thioureido group, an imide group, an (alkoxy or aryloxy)carbonylamino group, a sulfamoylamino group, a semicarbazide group, a thiosemicarbazide group, a hydrazino group, an ammonio group, an oxamoylamino group, an (alkyl or aryl)sulfonylureido group, an acylureido group, an acylsulfamoylamino group, a nitro group, a mercapto group, an (alkyl, aryl or heterocyclic)thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, and a group including a phosphoric acid amide or a phosphoric acid ester structure. Such substituent may be further substituted with these substituents.

$RED_{11}$ is preferably an alkylamino group, an arylamino group, a heterocyclic amino group, an aryl group, or an aromatic or non-aromatic heterocyclic group, and more preferably an arylamino group (particularly anilino group) or an aryl group (particularly phenyl group). In case such group has a substituent, the substituent is preferably a halogen atom, an alkyl group, an alkoxy group, a carbamoyl group, a sulfamoyl group, an acylamino group or a sulfonamide group.

However, in case $RED_{11}$ represents an aryl group, the aryl group preferably includes at least one "electron donating group". The "electron donating group" means a hydroxyl group, an alkoxy group, a mercapto group, a sulfonamide group, an acylamino group, an alkylamino group, an arylamino group, a heterocyclic amino group, an active methine group, a 5-membered, single-ringed or condensed-ringed electron-excessive aromatic heterocyclic group containing at least one nitrogen atom in the ring (such as an indolyl group, a pyrrolyl group, an imidazolyl group, a benzimidazolyl group, a thiazolyl group, a benzothiazolyl group, or an indazolyl group), or a non-aromatic nitrogen-containing heterocyclic group substituted at a nitrogen atom (such as a pyrrolidinyl group, an indolinyl group, a piperidinyl group, piperadinyl group or a morpholino group which may also be called a cyclic amino group). An active methine group means a methine group substituted with two "electron attracting groups", each meaning an acyl group, an alkoxycarbonyl group, an aryloxycarbonyl group, a carbamoyl group, an alkylsulfonyl group, an arylsulfonyl group, a sulfamoyl group, a trifluoromethyl group, a cyano group, a nitro group or a carbonimidoyl group. The two electron attracting groups may be mutually bonded to form a cyclic structure.

In formula (A), $L_{11}$ specifically represents a carboxy group or a salt thereof, a silyl group, a hydrogen atom, a triarylboron anion, a trialkylstannyl group, a trialkylgermyl group or —$CR_{C1}R_{C2}R_{C3}$. The silyl group specifically represents a trialkylsilyl group, an aryldialkylsilyl group, a triarylsilyl group etc. and may have an arbitrary substituent.

In case $L_{11}$ represents a salt of a carboxy group, a counter ion constituting the salt may be, for example, an alkali metal ion, an alkali earth metal ion, a heavy metal ion, an ammonium ion, or a phosphonium ion, preferably is an alkali metal ion or an ammonium ion and most preferably an alkali metal ion (particularly $Li^+$, $Na^+$ or $K^+$ ion).

In case $L_{11}$ represents —$CR_{C1}R_{C2}R_{C3}$ $R_{C1}$, $R_{C2}$ and $R_{C3}$ each independently represents a hydrogen atom, an alkyl group, an aryl group, a heterocyclic group, an alkylthio group, an arylthio group, an alkylamino group, an arylamino group, a heterocyclic amino group, an alkoxy group, an aryloxy group or a hydroxyl group, which may be mutually bonded to form a cyclic structure or may have an arbitrary substituent. However, in case one of $R_{C1}$, $R_{C2}$ and $R_{C3}$ represents a hydrogen atom or an alkyl group, the remaining two do not represent a hydrogen atom nor an alkyl group. Preferably, $R_{C1}$, $R_{C2}$ and $R_{C3}$ each independently represents an alkyl group, an aryl group (particularly phenyl group), an alkylthio group, an arylthio group, an alkylamino group, an arylamino group, a heterocyclic group, an alkoxy group, or a hydroxy group, of which specific examples include a phenyl group, a p-dimethylaminophenyl group, a p-methoxyphenyl group, a 2,4-dimethoxyphenyl group, a p-hydroxyphenyl group, a methylthio group, a phenylthio group, a phenoxy group, a methoxy group, an ethoxy group, a dimethylamino group, an N-methylanilino group, a diphenylamino group, a morpholino group, a thiomorpholino group and a hydroxy group. Also examples of a cyclic structure formed by mutual bonding of these groups include a 1,3-dithiolan-2-yl group, a 1,3-dithian-2-yl group, an N-methyl-1,3-thiazolidin-2-yl group and an N-benzyl-benzothiazolin-2-yl group.

There is also preferred a case where, as a result of selection of $R_{C1}$, $R_{C2}$ and $R_{C3}$ within the aforementioned ranges, —$CR_{C1}R_{C2}R_{C3}$ represents a group same as a residue obtained by eliminating $L_{11}$ from formula (A).

In formula (A), $L_{11}$ preferably represents a carboxy group or a salt thereof, or a hydrogen atom, more preferably a carboxy group or a salt thereof.

In case $L_{11}$ represents a hydrogen atom, the compound represented by formula (A) preferably has a base part present within the molecule. An action of such base part causes, after an oxidation of the compound represented by formula (A), a deprotonation of the hydrogen atom represented by $L_{11}$ thereby further releasing an electron therefrom.

The base mentioned above is more specifically a conjugate base of an acid having a pKa of about 1 to about 10. It may be, for example, a nitrogen-containing heterocyclic compound (such as a pyridine, an imidazole, a benzimidazole or a thiazole), an aniline, a trialkylamine, an amino group, a carbonic acid (such as an active methylene anion), a thioacetate anion, a carboxylate (—$COO^-$), a sulfate (—$SO_3^-$) or an aminoxide (>$N^+(O^-)$—). It is preferably a conjugate base of an acid having a pKA of about 1 to about 8, more preferably a carboxylate, a sulfate or an aminoxide, and particularly preferably a carboxylate. In case such base has an anion, a counter cation may be present, which may be, for example, an alkali metal ion, an alkali earth metal ion, a heavy metal ion, an ammonium ion or a phosphonium ion. Such base is bonded at an arbitrary position to the compound represented by formula (A). As to the bonding position, such base part may be bonded to any of $RED_{11}$, $R_{111}$ and $R_{112}$ of formula (A), or may be bonded to a substituent of such groups.

In formula (A), $R_{112}$ represents a hydrogen atom or a substituent substitutable on a carbon atom. However, $R_{112}$ and $L_{11}$ do not represent a same group.

$R_{112}$ preferably represents a hydrogen atom, an alkyl group, an aryl group (such as phenyl group), an alkoxy group (such as methoxy group, ethoxy group, or benzyloxy group), a hydroxy group, an alkylthio group (such as methylthio group or butylthio group), an amino group, an alkylamino group, an arylamino group, or a heterocyclic amino group, and more preferably a hydrogen atom, an alkyl group, an alkoxy group, a hydroxy group, a phenyl group or an alkylamino group.

In formula (A), a ring structure formed by $R_{111}$ is a ring structure corresponding to a tetrahydro member, a hexahydro member or an octahydro member of a 5- or 6-membered aromatic ring (including an aromatic hetero ring), wherein a hydro member means a ring structure in which carbon-carbon double bonds (or carbon-nitrogen double bonds) present in the aromatic ring (including an aromatic hetero ring) are partially hydrogenated, and a tetrahydro member, a hexahydro member or an octahydro member respectively means a structure in which two, three or four carbon-carbon double bonds (or carbon-nitrogen double bonds) are hydrogenated. By such hydrogenation, the aromatic ring becomes a partially hydrogenated non-aromatic ring structure.

Specific examples of the ring structure include a pyrrolidine ring, an imidazolidine ring, a thiazolidine ring, a pyrazolidine ring, an oxazolidine ring, a piperidine ring, a tetrahydropyridine ring, a tetrahydropyrimidine ring, a piperadine ring, a tetraline ring, a tetrahydroquinoline ring, a tetrahydroisoquinoline ring, a tetrahydroquinazoline ring, a tetrahydroquinoxaline ring, a tetrahydrocarbazole ring, or an octahydrophenanthridine ring. Such ring structures may have an arbitrary substituent.

A ring structure formed by $R_{111}$ is more preferably a pyrrolidine ring, an imidazolidine ring, a piperidine ring, a tetrahydropyridine ring, a tetrahydropyrimidine ring, a piperadine ring, a tetrahydroquinoline ring, a tetrahydroisoquinoline ring, a tetrahydroquinazoline ring, a tetrahydroquinoxaline ring, or a tetrahydrocarbazole ring, and particularly preferably a pyrrolidine ring, a piperidine ring, a piperadine ring, a tetrahydropyridine ring, a tetrahydroquinoline ring, a tetrahydroisoquinoline ring, a tetrahydroquinazoline ring, or a tetrahydroquinoxaline ring, and most preferably a pyrrolidine ring, a piperidine ring, a tetrahydropyridine ring, a tetrahydroquinoline ring, or a tetrahydroisoquinoline ring.

In formula (B), $RED_{12}$ and $L_{12}$ represent groups of respectively same meanings as in $RED_{11}$ and $L_{11}$ in formula (A), and have same preferable ranges. However $RED_{12}$ is a monovalent group except for a case of forming a following cyclic structure, and can specifically be monovalent groups described for $RED_{11}$. $R_{121}$ and $R_{122}$ represent groups of a same meaning as in $R_{112}$ in formula (A), and have a same preferable range. $ED_{12}$ represents an electron donating group. $R_{121}$ and $RED_{12}$, $R_{121}$ and $R_{122}$, or $ED_{12}$ and $RED_{12}$ may be mutually bonded to form a cyclic structure.

In formula (B), an electron donating group represented by $ED_{12}$ is same as the electron donating group explained as a substituent in case $RED_{11}$ represents an aryl group. $ED_{12}$ is preferably a hydroxy group, an alkoxy group, a mercapto group, a sulfonamide group, an alkylamino group, an arylamino group, an active methine group, a 5-membered, single-ringed or condensed-ringed electron-excessive aromatic heterocyclic group containing at least one nitrogen atom in the ring, a non-aromatic nitrogen-containing heterocyclic group substituted at a nitrogen atom, or a phenyl group substituted with such electron donating group, and more preferably a hydroxy group, a mercapto group, a sulfonamide group, an alkylamino group, an arylamino group, an active methine group, a non-aromatic nitrogen-containing heterocyclic group substituted at a nitrogen atom, or a phenyl group substituted with such electron donating group (for example a p-hydroxyphenyl group, a p-dialkylaminophenyl group, an o,p-dialkoxyphenyl group etc.).

In formula (B), $R_{121}$ and $RED_{12}$, $R_{122}$ and $R_{121}$, or $ED_{12}$ and $RED_{12}$ may be mutually bonded to form a cyclic structure. The cyclic structure thus formed is a non-aromatic carbon or hetero ring, having a 5- to 7-membered, single-ringed or condensed-ringed, substituted or non-substituted cyclic structure. In case $R_{121}$ and $RED_{12}$ form a cyclic structure, specific examples thereof include, in addition to the examples of the cyclic structure formed by $R_{111}$ in formula (A), a pyroline ring, an imidazoline ring, a thiazoline ring, a pyrrazoline ring, an oxazoline ring, an indane ring, a morpholine ring, an indoline ring, a tetrahydro-1,4-oxazine ring, a 2,3-dihydrobenzo-1,4-oxazine ring, a tetrahydro-1,4-thiazine ring, a 2,3-dihydrobenzo-1,4-thiazine ring, a 2,3-dihydrobenzofuran ring, and a 2,3-dihydrobenzothiophene ring. In case $ED_{12}$ and $RED_{12}$ form a cyclic structure, $ED_{12}$ preferably represents an amino group, an alkylamino group, or an arylamino group, and specific examples of the formed cyclic structure include a tetreahydropyrazine ring, a piperadine ring, a tetrahydroquinoxaline ring, and a tetrahydroisoquinoline ring. In case $R_{122}$ and $R_{121}$ form a cyclic structure, specific examples thereof include a cyclohexane ring and a cyclopentane ring.

In the following an explanation will be given on formulas (1) to (3).

In formulas (1) to (3), $R_1$, $R_2$, $R_{11}$, $R_{12}$ and $R_{31}$ represent groups of a same meaning as in $R_{112}$ in formula (A) and have a same preferable range. $L_1$, $L_{21}$ and $L_{31}$ each represents a releasable group same as that cited as specific examples for $L_{11}$ in formula (A), and has a same preferable range. A substituent represented by $X_1$ or $X_{21}$ is same as the substituent in case $RED_{11}$ of formula (A) has a substituent, and has a same preferable range. Each of $m_1$ and $m_{21}$ is preferably an integer from 0 to 2, more preferably 0 or 1.

In case any of $R_{N1}$, $R_{N<}$and $R_{N31}$ represents a substituent, such substituent is preferably an alkyl group, an aryl group or a heterocyclic group, which may further have an arbitrary substituent. Each of $R_{N1}$, $R_{N21}$ and $R_{N31}$ is preferably a hydrogen atom, an alkyl group or an aryl group, more preferably a hydrogen atom or an alkyl group.

In case any of $R_{13}$, $R_{14}$, $R_{33}$, $R_a$ and $R_b$ represents a substituent, such substituent is preferably an alkyl group, an aryl group, an acyl group, an alkoxycarbonyl group, a carbamoyl group, a cyano group, an alkoxy group, an acylamino group, a sulfonamide group, an ureido group, a thioureido group, an alkylthio group, an arylthio group, an alkylsulfonyl group, an arylsulfonyl group or a sulfamoyl group.

In formula (1), a 6-membered ring formed by $Z_1$ is a non-aromatic hetero ring condensed with the benzene ring of formula (1), and is more specifically, as a ring structure including the condensed benzene ring, a tetrahydroquinoline ring, a tetrahydroquinoxaline ring, or a tetrahydroquinazoline ring, and preferably a tetrahydroquinoline ring, or a tetrahydrdoquinoxaline ring. Such rings may have a substituent.

In formula (2), $ED_{21}$ represents a group of a same meaning as $ED_{12}$ in formula (B), and has a same preferable range.

In formula (2), any two of $R_{N21}$, $R_{13}$, $R_{14}$, $X_{21}$ and $ED_{21}$ may be mutually bonded to form a cyclic structure. A cyclic structure formed by a bonding of $R_{N21}$ and $X_{21}$ is preferably a 5- to 7-membered non-aromatic carbon ring or hetero ring condensed with a benzene ring, and specific examples include a tetrahydroquinoline ring, a tetrahydroquinoxaline ring, an indoline ring, a 2,3-dihydro-5,6-benzo-1,4-thiazine ring, preferably a tetrahydrdoquinoline ring, a tetrahydroquinoxaline ring or an indoline ring.

In formula (3), in case $R_{N31}$ represents a group other than an aryl group, $R_a$ and $R_b$ are mutually bonded to form an aromatic ring. The aromatic ring may be an aryl group (for example phenyl group or naphthyl group), or an aromatic heterocyclic group (for example a pyridine ring group, a pyrrole ring group, a quinoline ring group or an indol ring group), and is preferably an aryl group. Such aromatic ring group may have an arbitrary substituent.

In formula (3), $R_a$ and $R_b$ are preferably mutually bonded to form an aromatic ring (particularly a phenyl group).

In formula (3), $R_{32}$ is preferably a hydrogen atom, an alkyl group, an aryl group, a hydroxy group, an alkoxy group, a mercapto group, or an amino group, and, when $R_{32}$ represents a hydroxy group, there is also preferred a case where $R_{33}$ simultaneously represents an "electron attracting group". The "electron attracting group" is same as that explained before and is preferably an acyl group, an alkoxycarbonyl group, a carbamoyl group or a cyano group.

In the following, the compound of the type 2 will be explained.

In the compound of the type 2, "a bond-cleaving reaction" means a cleaving of a carbon-carbon, carbon-silicon, carbon-hydrogen, carbon-boron, carbon-tin or carbon-germanium interatomic bond, and a cleaving of a carbon-hydrogen bond may further be involved.

The compound of the type 2 is a compound having two or more (preferably two to six and more preferably two to four) groups adsorbable to silver halide in the molecule. More preferably it is a compound having, as an adsorbable group, a nitrogen-containing heterocyclic group substituted with two or more mercapto groups. A number of the adsorbable groups is preferably 2 to 6, more preferably 2 to 4. The adsorbable group will be explained later.

Among the compound of the type 2, a preferred compound is represented by formula (C).

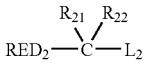

Formula (C)

A compound represented by formula (C) is a compound capable, after a 1-electron oxidation of a reducing group represented by $RED_2$, of spontaneously releasing $L_2$ by a bond cleaving reaction, thereby further releasing one electron.

In formula (C), $RED_2$ represents a group of a same meaning as in $RED_{12}$ in formula (B), and has a same preferable range. $L_2$ represents a group of the same meaning as in $L_{11}$ in formula (A), and has the same preferable range. In case $L_2$ represents a silyl group, the compound has, within the molecule, a nitrogen-containing heterocyclic group substituted with two or more mercapto groups as an adsorbable group. $R_{21}$ and $R_{22}$, each representing a hydrogen atom or a substituent, represent groups of a same meaning as in $R_{112}$ in formula (A), and have a same preferable range. $RED_2$ and $R_{21}$ may be mutually bonded to form a cyclic structure.

The above-mentioned cyclic structure is a 5- to 7-membered, single-ringed or condensed-ringed, non-aromatic carbon or hetero ring structure, which may have a substituent. However, such ring structure does not become a ring structure corresponding to a tetrahydro member, a hexahydro member or an octahydro member of an aromatic ring or an aromatic hetero ring. Such ring structure preferably corresponds to a dihydro member of an aromatic ring or an aromatic hetero ring, and specific examples thereof include a 2-pyrroline ring, a 2-imidazoline ring, a 2-thiazoline ring, a 1,2-dihydropyridine ring, a 1,4-dihydropyridine ring, an indoline ring, a benzoimidazoline ring, a benzothiazoline ring, a benzoxazoline ring, a 2,3-dihydrobenzothiophene ring, a 2,3-dihydrobenzofuran ring, a benzo-α-pyran ring, a 1,2-dihydroquinoline ring, a 1,2-dihydroquinazoline ring, and a 1,2-dihydroquinoxaline ring. It is preferably a 2-imidazoline ring, a 2-thiazoline ring, an indoline ring, a benzoimidazoline ring, a benzothiazoline ring, a benzoxazoline ring, a 1,2-dihydropyridine ring, a 1,2-dihydroquinoline ring, a 1,2-dihydroquinazoline ring or a 1,2-dihydroquinoxaline ring, more preferably an indoline ring, a benzoimidazoline ring, a benzothiazoline ring, or a 1,2-dihydroquinoline ring, and particularly preferably an indoline ring.

In the following, a compound of the type 3 will be explained.

In the compound of the type 3, a "bond forming process" means formation of an interatomic bond such as a carbon-carbon, carbon-nitrogen, carbon-sulfur or carbon-oxygen bond.

The compound of the type 3 is preferably a compound characterized in that a 1-electron oxidized member, formed by a 1-electron oxidation, is capable of further releasing one or more electrons, after ensuing forming a bond by reacting with a reactive group site (a carbon-carbon double bond site, a carbon-carbon triple bond site, an aromatic group site or a non-aromatic heterocyclic group site of a benzo condensed ring) existing in the molecule.

More specifically, the compound of the type 3 is characterized in that a 1-electron oxidized member thereof (cation radical species, or neutral radical species generated therefrom by a proton liberation), formed by a 1-electron oxidation, reacts with the above-mentioned reactive group present in the same molecule to form a bond, thereby generating new radical species having a cyclic structure within the molecule, and that a second electron is released from such radical species, either directly or with a proton liberation. In a certain compound of the type 3, a 2-electron oxidized member thus generated may thereafter be subjected a hydrolysis reaction in a certain case or directly in a certain case to cause a tautomeric reaction involving a proton transfer, thereby further releasing one or more electrons, usually two or more electrons. There is also included a compound capable, without going through such tautomeric reaction, of releasing one or more electrons, usually two or more electrons directly from the 2-electron oxidized member.

The compound of the type 3 is preferably represented by formula (D):

$$RED_3—L_3—Y_3 \qquad \text{Formula (D)}$$

In formula (D), $RED_3$ represents a reducing group that may be subjected to a 1-electron oxidation; $Y_3$ represents a reactive group site which reacts after $RED_3$ is 1-electron oxidized, and specifically represents an organic group including a carbon-carbon double bond site, a carbon-carbon triple bond site, an aromatic group site or a non-aromatic heterocyclic group site of a benzo condensed ring; and $L_3$ represents a connecting group which connects $RED_3$ and $Y_3$.

$RED_3$ represents a group of a same meaning as in $RED_{12}$ in formula (B), and is preferably an arylamino group, a heterocyclic amino group, an aryloxy group, an arylthio group, an aryl group, an aromatic or non-aromatic heterocyclic group (particularly preferably a nitrogen-containing heterocyclic group), and is further preferably an arylamino group, a heterocyclic amino group, an aryl group or an aromatic or non-aromatic heterocyclic group. Among these, the heterocyclic group is preferably a tetrahydroquinoline ring group, a tetrahydroquinoxaline ring group, a tetrahydroquinazoline ring group, an indoline ring group, an indole ring group, a carbazole ring group, a phenoxazine ring group, a phenothiazine ring group, a benzothiazoline ring group, a pyrrol ring group, an imidazole ring group, a thiazole ring group, a benzoimidazole ring group, a benzoimidazoline ring group, a benzothiazoline ring group, or a 3,4-methyleneoxyphenyl-1-yl group.

$RED_3$ is particularly preferably an arylamino group (particularly anilino group), an aryl group (particularly phenyl group), or an aromatic or non-aromatic heterocyclic group.

In case $RED_3$ represents an aryl group, the aryl group preferably includes at least one "electron donating group". The "electron donating group" is same as explained in the foregoing.

In case $RED_3$ represents an aryl group, a substituent of the aryl group is more preferably an alkylamino group, a hydroxy group, an alkoxy group, a mercapto group, a sulfonamide group, an active methine group, or a non-aromatic nitrogen-containing heterocyclic group substituted at a nitrogen atom, further preferably an alkylamino group, a hydroxy group, an active methine group, or a non-aromatic nitrogen-containing heterocyclic group substituted at a nitrogen atom, and most preferably an alkylamino group or a non-aromatic nitrogen-containing heterocyclic group substituted at a nitrogen atom.

In case the organic group including a carbon-carbon double bond site (for example, vinyl group) represented by $Y_3$ has a substituent, such substituent is preferably an alkyl group, a phenyl group, an acyl group, a cyano group, an alkoxycarbonyl group, a carbamoyl group, or an electron donating group, and such electron donating group is preferably an alkoxy group, a hydroxy group (which may be protected with a silyl group and can for example be a trimethylsilyloxy group, a t-butyldimethylsilyloxy group, a triphenylsilyloxy group, a triethylsilyloxy group, or a phenyldimethylsilyloxy group), an amino group, an alkylamino group, an arylamino group, a sulfonamide group, an active methine group, a mercapto group, an alkylthio group or a phenyl group having such electron donating group as a substituent.

In case the organic group including a carbon-carbon double bond site has a hydroxy group as a substituent, $Y_3$ includes a partial structure: $>C_1{=}C_2(-OH)-$, which may also assume by a tautomerism a partial structure: $>C_1H-C_2(=O)-$. Also in such case, it is also preferable that a substituent substituted on the carbon $C_1$ is an electron attracting group, and, in such case, $Y_3$ has a partial structure of "an active methylene group" or "an active methine group". An electron attracting group capable of providing such partial structure of an active methylene group or an active methine group is same as that explained in the foregoing description of the "active methine group".

In case the organic group including a carbon-carbon triple bond site (for example, ethynyl group) represented by $Y_3$ has a substituent, such substituent is preferably an alkyl group, a phenyl group, an alkoxycarbonyl group, a carbamoyl group, or an electron donating group.

In case $Y_3$ represents an organic group including an aromatic group site, such aromatic group is preferably an aryl group (particularly preferably a phenyl group) having an electron donating group as a substituent, or an indole ring group, and such electron donating group is preferably a hydroxy group (which may be protected with a silyl group), an alkoxy group, an amino group, an alkylamino group, an active methine group, a sulfonamide group or a mercapto group.

In case $Y_3$ represents an organic group including a non-aromatic heterocyclic group site of a benzo condensed ring, the non-aromatic heterocyclic group of a benzo condensed ring is preferably a group incorporating an aniline structure as a partial structure, such as an indoline ring group, a 1,2,3,4-tetrahydroquinoline ring group, a 1,2,3,4-tetrahydroquinoxaline ring group or a 4-quinolone ring group.

The reactive group represented by $Y_3$ is more preferably an organic group including a carbon-carbon double bond site, an aromatic group site, or a non-aromatic heterocyclic group site of a benzo condensed ring. It is further preferably a carbon-carbon double bond site, a phenyl group having an electron donating group as a substituent, an indole ring group, or a non-aromatic heterocyclic group of a benzo condensed ring incorporating an aniline structure as a partial structure. It is further preferred that the carbon-carbon double bond site has at least one electron donating group as a substituent.

A case where the reactive group represented by $Y_3$, as a result of selection within the aforementioned range, has a partial structure same as the reducing group represented by $RED_3$ is also a preferred example of the compound represented by formula (D).

$L_3$ represents a connecting group which connects $RED_3$ and $Y_3$, and more specifically represents a group formed by a single bond, an alkylene group, an arylene group, a heterocyclic group, —O—, —S—, $-NR_N-$, —C(=O)—, $-SO_2-$, —SO—, and —P(=O)— either singly or in combination. $R_N$ represents a hydrogen atom, an alkyl group, an aryl group, or a heterocyclic group. The connecting group represented by $L_3$ may have an arbitrary substituent. The connecting group represented by $L_3$ may be connected in an arbitrary position of the groups represented by $RED_3$ and $Y_3$, by substituting one arbitrary hydrogen atom in each thereof.

Preferred examples of $L_3$ include a single bond, an alkylene group (particularly a methylene group, an ethylene group or a propylene group), an arylene group (particularly a phenylene group), —C(=O)—, —O—, —NH—, an —N(alkyl)-group, and a divalent connecting group formed by a combination of these groups.

The group represented by $L_3$ is preferably such that, when cation radical species ($X^{+}\bullet$) generated by an oxidation of $RED_3$ or radical species ($X\bullet$) generated by a proton liberation therefrom react with the reactive group represented by $Y_3$ to form a bond, the atomic groups involved therein can form a 3- to 7-membered ring structure including $L_3$. For this purpose, it is preferred that the radical species ($X^{+}\bullet$ or $X\bullet$), the reactive group represented by Y, and L are connected by an atomic group of 3 to 7 atoms.

In the following, a compound of the type 4 will be explained.

The compound of the type 4 is a compound having a cyclic structure substituted with a reducing group, and undergoing a ring-opening reaction after a 1-electron oxidation of such reducing group, thereby releasing one or more electrons. The ring-opening reaction of the cyclic structure means a type indicated in the following:

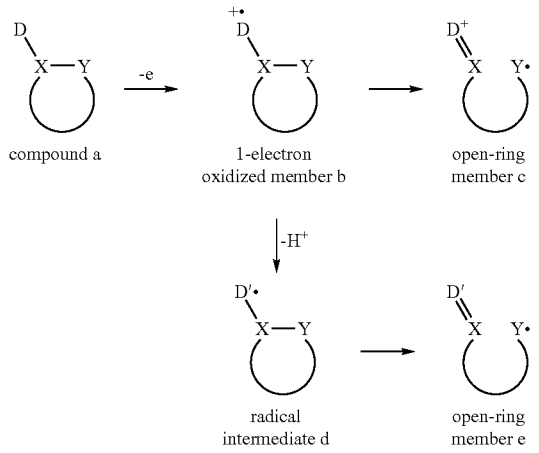

In the formula, a compound a represents the compound of the type 4. In the compound a, D represents a reducing group, and X and Y represent atoms constituting a bond in the cyclic structure, to be opened after the 1-electron oxidation. At first the compound a is subjected to a 1-electron oxidation to generate a 1-electron oxidized member b. Then a single bond D-X becomes a double bond and a bond X—Y is simultaneously opened to generate an open-ring member c. Otherwise, there may be assumed a path where the 1-electron oxidized member b causes a proton liberation to generate a radical intermediate d, from which an open-ring member e is generated in a similar manner. The compound of the invention is characterized in that thus generated open-ring member c or e further releases one or more electrons.

The cyclic structure of the compound of the type 4 is a 3- to 7-membered carbon or hetero ring, which is a single-ringed or condensed-ringed, saturated or unsaturated non-aromatic ring. It is preferably a saturated ring structure, and more preferably a 3-membered ring or 4-membered ring.

Preferred examples of the cyclic structure include a cyclopropane ring, a cyclobutane ring, an oxylane ring, a oxetane ring, an aziridine ring, azetidine ring, an episulfide ring and a thietane ring. It is more preferably a cyclopropane ring, a cyclobutane ring, an oxylane ring, a oxetane ring, or an azetidine ring, and particularly preferably a cyclopropane ring, a cyclobutane ring, or an azetidine ring. The cyclic structure may have an arbitrary substituent.

The compound of the type 4 is preferably represented by formula (E) or (F).

Formula (E)

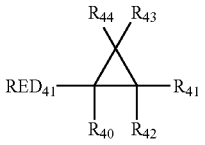

Formula (F)

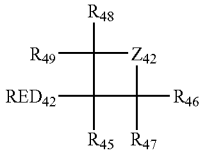

In formulas (E) and (F), $RED_{41}$ and $RED_{42}$ each represents a group of a same meaning as in $RED_{12}$ in formula (B), and have a same preferably range. $R_{40}$ to $R_{44}$ and $R_{45}$ to $R_{49}$ each represents a hydrogen atom or a substituent. In formula (F), $Z_{42}$ represents —$CR_{420}R_{421}$—, —$NR_{423}$—, or —O—. $R_{420}$ and $R_{421}$ each represents a hydrogen atom or a substituent, and $R_{423}$ represents a hydrogen atom, an alkyl group, an aryl group or a heterocyclic group.

In formulas (E) and (F), $R_{40}$ and $R_{45}$ each preferably represents a hydrogen atom, an alkyl group, an aryl group, or a heterocyclic group, more preferably a hydrogen atom, an alkyl group, or an aryl group. $R_{41}$ to $R_{44}$ and $R_{46}$ to $R_{49}$ each preferably represents a hydrogen atom, an alkyl group, an alkenyl group, an aryl group, a heterocyclic group, an arylthio group, an alkylthio group, an acylamino group, or a sulfonamide group, more preferably a hydrogen atom, an alkyl group, an aryl group or a heterocyclic group.

For $R_{41}$ to $R_{44}$, there are preferred a case where at least one thereof is a donor group and a case where $R_{41}$ and $R_{42}$, or $R_{43}$ and $R_{44}$ are both electron attracting groups. There is more preferred a case where at least one of $R_{41}$ to $R_{44}$ is a donor group. There is further preferred a case where at least one of $R_{41}$ to $R_{44}$ is a donor group and a non-donor group in $R_{41}$ to $R^{44}$ is a hydrogen atom or an alkyl group.

The aforementioned donor group means an "electron donating group", or an aryl group substituted with at least one "electron donating group". The donor group is preferably an alkylamino group, an arylamino group, a heterocyclic amino group, a 5-membered, single-ringed or condensed-ringed, electron-excessive aromatic heterocyclic group containing at least one nitrogen atom in the ring, a non-aromatic nitrogen-containing heterocyclic group substituting at the nitrogen atom, or a phenyl group substituted with at least an electron donating group. It is more preferably an alkylamino group, an arylamino group, a 5-membered, single-ringed or condensed-ringed, electron-excessive aromatic heterocyclic group containing at least one nitrogen atom in the ring (such as an indole ring, a pyrrole ring or a carbazole ring), or a phenyl group substituted with an electron donating group (such as a phenyl group substituted with three or more alkoxy groups, or a phenyl group substituted with a hydroxy group, an alkylamino group or an arylamino group). Particularly preferably it is an arylamino group, a 5-membered, single-ringed or condensed-ringed, electron-excessive aromatic heterocyclic group containing at least one nitrogen atom in the ring (particularly 3-indolyl group), or a phenyl group substituted with an electron donating group (particularly a trialkoxyphenyl group, or a phenyl group substituted with an alkylamino group or an arylamino group).

$Z_{42}$ is preferably —$CR_{420}R_{421}$— or —$NR_{423}$—, and more preferably —$NR_{423}$—. Each of $R_{420}$ and $R_{421}$ is preferably a hydrogen atom, an alkyl group, an aryl group, a heterocyclic group, an acylamino group, or a sulfonamino group, and more preferably a hydrogen atom, an alkyl group, an aryl group, or a heterocyclic group. $R_{423}$ preferably represents a hydrogen atom, an alkyl group, an aryl group or an aromatic heterocyclic group, more preferably a hydrogen atom, an alkyl group or an aryl group.

In case each of $R_{40}$ to $R_{49}$, $R_{420}$, $R_{421}$ and $R_{423}$ represents a substituent, it preferably has a total number of 40 carbon atoms or less, more preferably 30 carbon atoms or less, and particularly preferably 15 carbon atoms or less. Also these substituents may be bonded mutually, or bonded with another site ($RED_{41}$, $RED_{42}$ or $Z_{42}$) in the molecule to form a ring.

In the compounds of the types 1 to 4 of the invention, an adsorbable group to silver halide means a group directly adsorbable to silver halide or a group capable of accelerating an adsorption to silver halide, and is specfically a mercapto group (or a salt thereof), a thion group (—C(═S)—), a heterocyclic group containing at least one atom selected from a nitrogen atom, a sulfur atom, a selenium atom and a tellurium atom, a sulfide group, a cationic group, or an ethinyl group. However, in the compound of the type 2 of the invention, a sulfide group is not included as an adsorbable group.

A mercapto group (or a salt thereof as the adsorbable group means not only a mercapto group (or a salt thereof itself but also, more preferably, a heterocyclic group, an aryl group or an alkyl group substituted with at least one mercapto group (or a salt thereof. The heterocyclic group is a 5- to 7-membered, single-ringed or condensed-ringed, aromatic or non-aromatic heterocyclic group such as an imidazole ring group, a thiazole ring group, an oxazole ring group, a benzimidazole ring group, a benzothiazole ring group, a benzoxazole ring group, a triazole ring group, a thiadiazole ring group, an oxadiazole ring group, a tetrazole ring group, a purine ring group, a pyridine ring group, a quinoline ring group, an isoquinoline group, a pyrimidine ring group or a triazine ring group. It can also be a heterocyclic group including a quaternary nitrogen atom, and, in such a case, a substituted mercapto group may be dissociated to form a meso ion. Examples of such heterocyclic group include an imidazolium ring group, a pyrazolium ring group, a thiazolium ring group, a triazolium ring group, a tetrazolium ring group, a thiadiazolium ring group, a pyridinium ring group, a pyrimidinium ring group, and a triazinium ring group, among which a triazolium ring group (such as 1,2,4-triazolium-3-thiolate ring group) is preferable. An aryl group may be a phenyl group or a naphthyl group. Also an alkyl group may be a straight, ramified or cyclic alkyl group with 1 to 30 carbon atoms. In case where the mercapto group forms a salt, a counter ion may be a cation of an alkali metal, an alkali earth metal or a heavy metal ($Li^+$, $Na^+$, $K^+$, $Mg^{2+}$, $Ag^+$, $Zn^{2+}$ etc.), an ammonium ion, a heterocyclic group containing a quaternary nitrogen atom, or a phosphonium ion.

The mercapto group as the adsorbable group may become a thion group by a tautomerism, and can specifically be a thioamide group (—C(═S)—NH— in this case) or a group including a partial structure of such thioamide group, namely a linear or cyclic thioamide group, a thioureido group, a thiourethane group, or a dithiocarbamate ester group. Examples of the cyclic group include a thiazolidine-2-thion group, an oxyazolidine-2-thion group, a 2-thiohidantoin group, a rhodanin group, an isorhodanin group, a thiobarbituric acid group, and a 2-thioxo-oxazolidin-4-one group.

The thion group as the adsorbable group includes not only the aforementioned thion group formed by a tautomerism from a mercapto group, but also a linear or cyclic thioamide group, a thioureido group, a thiourethane group and a dithiocarbamate ester group, which cannot be converted to a mercapto group by a tautomerism (not having a hydrogen atom in α-position of thion group).

The heterocyclic group containing at least one atom selected from a nitrogen atom, a sulfur atom, a selenium atom and a tellurium atom, as the adsorbable group, is a nitrogen-containing heterocyclic group having an —NH— group capable of forming an imino silver (>NAg) as a partial structure of the hetero ring, or a heterocyclic group having —S—, —Se—, —Te— or ═N— capable of coordinating with a silver ion by a coordinate bond as a partial structure of the hetero ring. Examples of the former include a benzotriazole group, a triazole group, an indazole group, a pyrrazole group, a tetrazole group, a benzimidazole group, an imidazole group and a purine group, while examples of the latter include a thiophene group, a thiazole group, an oxazole group, a benzothiazole group, a benzoxazole group, thiadiazole group, an oxadiazole group, a triazine group, a selenoazole group, a benzselenoazole group, a tellurazole group and a benztellurazole group. The former is preferable.

A sulfide group as the adsorbable group may be any group having an —S— partial structure, and is preferably a group having a partial structure of alkyl(or alkylene)-S-alkyl(or alkylene), aryl(or arylene)-S-alkyl(or alkylene), or aryl(or arylene)-S-aryl(or arylene). Also such sulfide group may form a cyclic structure or may form a —S—S— group. Specific examples in case of forming a cyclic structure include a group containing a thiolan ring, a 1,3-dithiolan ring, a 1,2-dithiolan ring, a thian ring, a dithian ring, or a tetrahydro-1,4-thiazine ring (a thiomorpholine ring). A sulfide group is particularly preferably a group having a partial structure of alkyl(or alkylene)-S-alkyl(or alkylene).

A cationic group as the adsorbable group means a group containing a quaternary nitrogen atom, and is specifically a group including an ammonio group or a nitrogen-containing heterocyclic group containing a quaternary nitrogen atom. However, such cationic group does not become a part of an atomic group constituting a dye structure (for example a cyanine chromophore). The ammonio group is for example a trialkylammonio group, a dialkylarylammonio group or an alkyldiarylammonio group, and may be, for example, benzyldimethylammonio group, trihexylammonio group or phenyldiethylammonio group. A nitrogen-containing heterocyclic group including a quaternary nitrogen atom may be, for example, pyridinio group, quinolinio group, isoquinolinio group or imiazolio group. It is preferably a pyridinio group or an imidazolio group, and particularly preferably a pyridinio group. Such nitrogen-containing heterocyclic group including a quaternary nitrogen atom may have an arbitrary substituent, however, in case of pyridinio group or imidazolio group, the substituent is preferably an alkyl group, an aryl group, an acylamino group, a chlorine atom, an alkoxycarbonyl group or a carbamoyl group, and, in case of a pyridinio group, the substituent is particularly preferably a phenyl group.

An ethinyl group as the adsorbable group means —C≡CH, in which the hydrogen atom may be substituted.

Such adsorbable group mentioned in the foregoing may have an arbitrary substituent.

Specific examples of the adsorbable group also include those described in JP-A No. 11-95355, pages 4 to 7.

In the invention, the adsorbable group is preferably a mercapto-substituted nitrogen-containing heterocyclic group (such as a 2-mercaptothiadiazole group, a 3-mercapto-1,2,4-triazole group, a 5-mercaptotetrazole group, a 2-mercapto-1,3,4-oxadiazole group, a 2-mercaptobenzoxazole group, a 2-mercaptobenzothiazole group, or a 1,5-dimethyl-1,2,4-triazolium-3-thiolate group), or a nitrogen-containing heterocyclic group having an —NH— group capable of forming imino silver (>NAg) as a partial structure of the hetero ring (such as a benzotriazole group, a benzimidazole group, or an indazole group). It is particularly preferably a 5-mercaptotetrazole group, a 3-mercapto-1,2,4-triazole group, or a benzotriazole group, and most preferably a 3-mercapto-1,2,4-triazole group or a 5-mercaptotetrazole group.

Among the compounds of the invention, there is also preferred a compound having two or more mercapto groups as a partial structure within the molecule. The mercapto group (—SH) may become a thion group in case a tautomerism is possible. Such compound may be a compound having, within the molecule, two or more adsorbable groups having the aforementioned mercapto or thion group as a partial structure (such as a ring-forming thioamide group, an alkylmercapto group, an arylmercapto group or a heterocyclic mercapto group), or may have, within the adsorbable groups, at least one adsorbable group including two or more mercapto or thion groups as a partial structure (for example, a dimercapto-substituted nitrogen-containing heterocyclic group).

Examples of the adsorbable group having two or more mercapto groups as a partial structure (such as a dimercapto-substituted nitrogen-containing heterocyclic group) include a 2,4-dimercaptopyrimidine group, a 2,4-dimercaptotriazine group, a 3,5-dimercapto-1,2,4-triazole group, a 2,5-dimercapto-1,3-thiazole group, a 2,5-dimercapto-1,3-oxazole group, 2,7-dimercapto-5-methyl-s-triazolo(1,5-A)-pyrimidine, 2,6,8-trimercaptopurine, 6,8-dimercaptopurine, 3,5,7-trimercapto-s-triazolotriazine, 4,6-dimercaptopyrazolopyrimidine, and 2,5-dimercaptoimidazole, and particularly preferably a 2,4-dimercaptopyrimidine group, a 2,4-dimercaptotriazine group or a 3,5-dimercapto-1,2,4-triazole group.

The adsorbable group may be substituted in any position in formulas (A) to (F) and formulas (1) to (3), but it is preferably substituted on $RED_{11}$, $RED_{12}$, $RED_2$ or $RED_3$ in formulas (A) to (D), on $RED_{41}$, $R_{41}$, $RED_{42}$ or $R_{46}$ to $R_{48}$ in formula (E) or (F), or on an arbitrary position excluding $R_1$, $R_2$, $R_{11}$, $R_{12}$, $R_{31}$, $L_1$, $L_{21}$ and $L_{31}$ in formulas (1) to (3), and is more preferably substituted, in all formulas (A) to (F), on $RED_{11}$ to $RED_{42}$.

A partial structure of a spectral sensitizing dye is a group including a chromophore of the spectral sensitizing dye, and is a residue obtained by eliminating a hydrogen atom or a substituent in an arbitrary position from the spectral sensitizing dye compound. The partial structure of the spectral sensitizing dye may be substituted in any position in formulas (A) to (F) and formulas (1) to (3), but is preferably substituted on $RED_{11}$, $RED_{12}$, $RED_2$ or $RED_3$ in formulas (A) to (D), on $RED_{41}$, $R_{41}$, $RED_{42}$ or $R_{46}$ to $R_{48}$ in formula (E) or (F), or on an arbitrary position excluding $R_1$, $R_2$, $R_{11}$, $R_{12}$, $R_{31}$, $L_1$, $L_{21}$ and $L_{31}$ in formulas (1) to (3), and is more preferably substituted, in all formulas (A) to (F), on $RED_{11}$ to $RED_{42}$. A preferred spectral sensitizing dye is a spectral sensitizing dye typically employed in the color sensitizing technology, and includes, for example, a cyanine dye, a complex cyanine dye, a melocyanine dye, a complex melocyanine dye, a homopolar cyanine dye, a styryl dye and a hemicyanine dye. Representative spectral sensitizing dyes are described in Research Disclosure, item 36544, September 1994. These dyes may be synthesized by those skilled in the art according to procedures described in such Research Disclosure and in F. M. Hamer, The Cyanine dyes and Related Compounds (Interscience Publishers, New York, 1964). Also all the dyes described in JP-A No. 11-95355 (U.S. Pat. No. 6,054,260), pages 7 to 14, may be applied.

The compound of the types 1 to 4 of the invention preferably has a total number of carbon atoms within a range of 10 to 60, more preferably 15 to 50, further preferably 18 to 40 and particularly preferably 18 to 30.

The compound of the types 1 to 4 of the invention is subjected to a 1-electron oxidation which is triggered by a light exposure of a silver halide photosensitive material employing such compound, and, after an ensuing reaction, is oxidized by releasing one electron, or two or more electrons depending on the type of the compound, and an oxidation potential for such first electron is preferably about 1.4 V or less, and more preferably 1.0 V or less. Such oxidation potential is preferably 0 V or higher and more preferably 0.3 V or higher. Therefore, the oxidation potential is preferably within a range from about 0 to about 1.4 V, more preferably from about 0.3 to about 1.0 V.

The oxidation potential may be measured by a cyclic voltammetry method, more specifically by dissolving a sample in a solution of acetonitrile:water (containing 0.1 M lithium perhydrochlorate)=80%: 20% (vol. %), passing nitrogen gas for 10 minutes, and executing a measurement with a potential scanning rate of 0.1 V/sec at 25° C., utilizing a glass-like carbon disk as an operating electrode, a platinum wire as a counter electrode and a calomel electrode (SCE) as a reference electrode. An oxidation potential pair SCE is taken at a peak potential of a cyclic voltammetry wave.

In case the compound of the types 1 to 4 of the invention is a compound which, after a 1-electron oxidation and an ensuing reaction, further releases 1 electron, an oxidation potential of such later stage is preferably from −0.5 to −2 V, more preferably from −0.7 to −2 V and further preferably from −0.9 to −1.6 V.

In case the compound of the types 1 to 4 of the invention is a compound which, after a 1-electron oxidation and an ensuing reaction, is oxidized by further releasing two or more electrons, an oxidation potential of such later stage is not particularly restricted. This is because an oxidation potential for a second electron and an oxidation potential for a third electron cannot be clearly distinguished and it is often difficult to actually measure and distinguish these values exactly.

In the following, a compound of the type 5 will be explained.

The compound of the type 5 is represented by X—Y, in which X represents a reducing group and Y represents a releasable group, wherein a 1-electron oxidized member, generated by a 1-electron oxidation of the reducing group represented by X, causes a ensuing cleaving reaction of X—Y bond thereby releasing Y and generating an X radical, thus further releasing one electron therefrom. A reaction of such compound of the type 5, when oxidized, may be represented by the following formula:

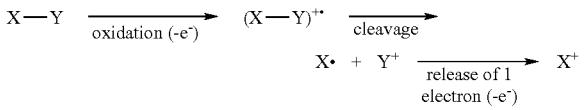

The compound of the type 5 preferably has an oxidation potential from 0 to 1.4 V, more preferably 0.3 to 1.0 V. Also the radical X• generated in the foregoing reaction formula preferably has an oxidation potential from −0.7 to −2.0 V, more preferably from −0.9 to −1.6 V.

The compound of the type 5 is preferably represented by formula (G).

Formula (G)

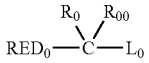

In formula (G), $RED_0$ represents a reducing group; $L_0$ represents a relesable group; $R_0$ and $R_{00}$ each represents a hydrogen atom or a substituent. $RED_0$ and $R_0$, or $R_0$ and $R_{00}$ may be mutually bonded to form a cyclic structure. $RED_0$ represents a group of a same meaning as in $RED_2$ in formula (C), and has a same preferable range. $R_0$ and $R_{00}$ represent groups of same meanings as $R_{21}$ and $R_{22}$ in formula (C), and have a same preferable ranges. However, each of $R_0$ and $R_{00}$ does not represent a group same as $L_0$, except for a hydrogen atom. $RED_0$ and $R_0$ may be mutually bonded to form a cyclic structure, of which examples are same as those of the cyclic structure formed by a bonding of $RED_2$ and $R_{21}$ in formula (C) and which has a same preferable range. Examples of the cyclic structure formed by mutual bonding of $R_0$ and $R_{00}$ include a cyclopentane ring and a tetrahydrofuran ring. In formula (G), $L_0$ represents a group of a same meaning as in $L_2$ in formula (C), and has a same preferable range.

The compound represented by formula (G) preferably has an adsorbable group to silver halide, or a partial structure of a spectral sensitizing dye in the molecule, however, in case $L_0$ represents a group other than a silyl group, it does not have two or more adsorbable groups at the same time within the molecule. However, a sulfide group as an adsorbable group may be present in two or more units regardless of $L_0$.

Examples of an adsorbable group to silver halide, in the compound represented by formula (G), may be the same as those of the adsorbable group that may be present in the compound of the types 1 to 4 of the invention, and also include all described as "adsorbable group to silver halide" in JP-A No. 11-95355, pages 4 to 7, and a preferable range is also same.

A partial structure of a spectral sensitizing dye which may be provided in the compound represented by formula (G) is the same as the partial structure of the spectral sensitizing dye which may be provided in the compound of the types 1 to 4 of the invention, however it includes also all described as "light absorbing groups" in JP-A No. 11-95355, pages 7 to 14, and a preferable range is also the same.

In the following, specific examples of the compound of the types 1 to 5 of the invention are shown, but the invention is not limited to such examples.

1
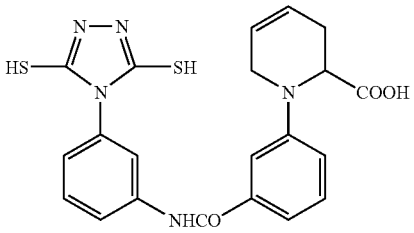
2
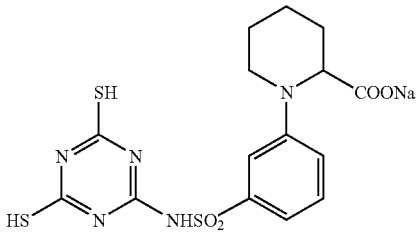
3
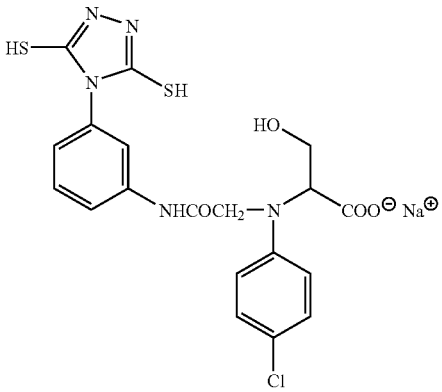
4
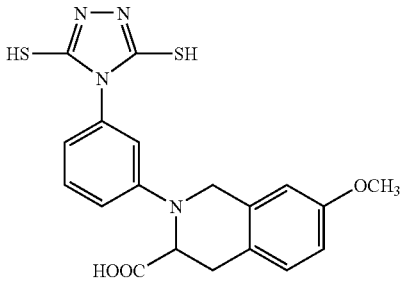
5
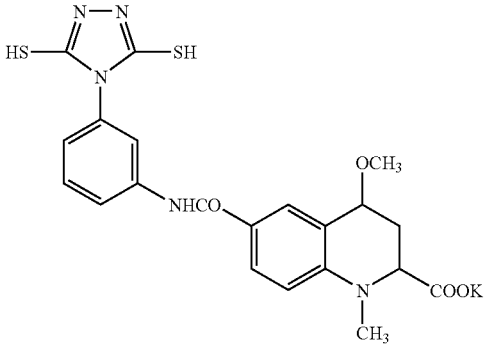
6
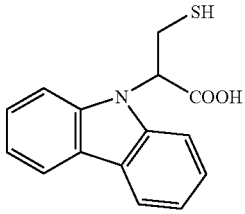
7
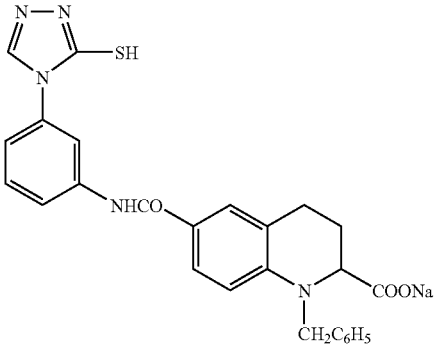
8
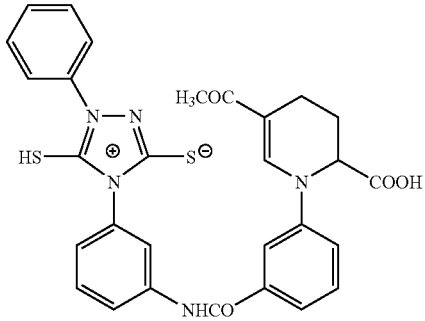
9
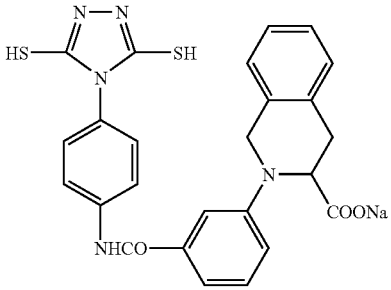
10
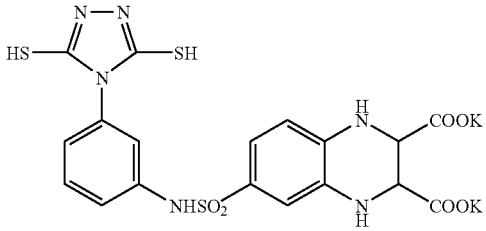

-continued
11
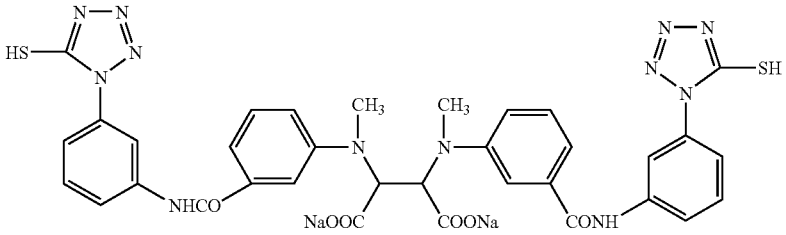
12
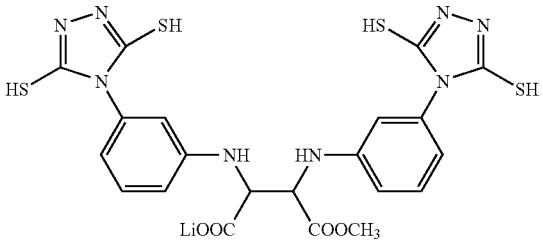
13
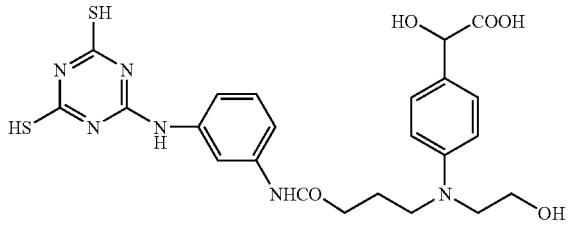
14
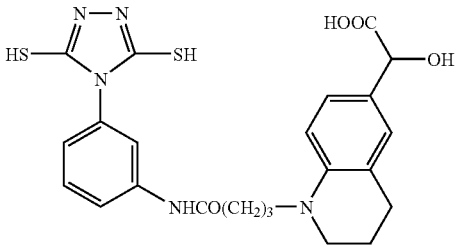
15
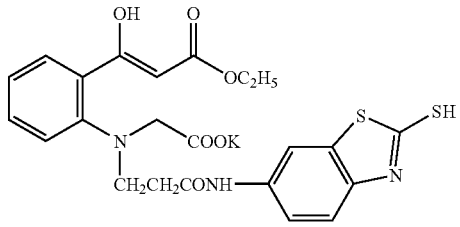
16
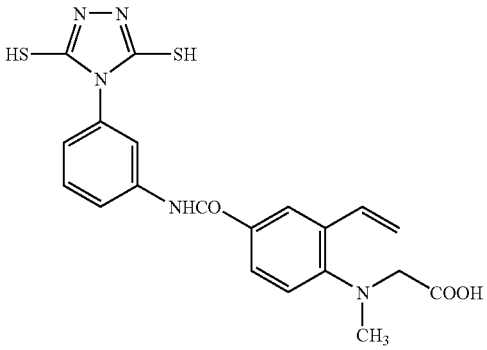
17
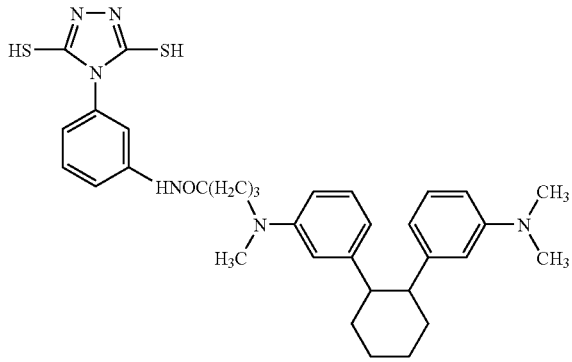
18
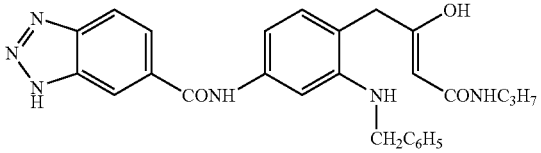
19
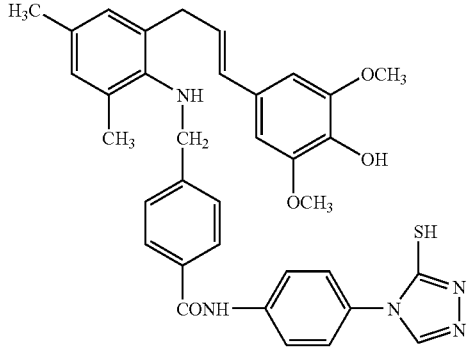

-continued
20
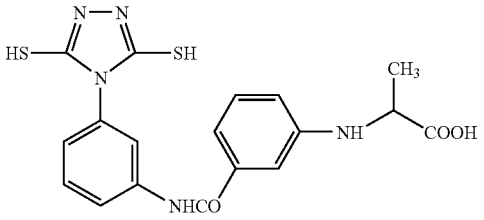
21
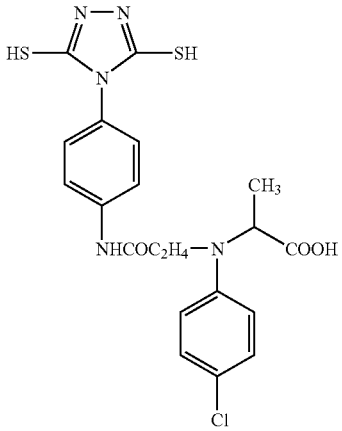
22
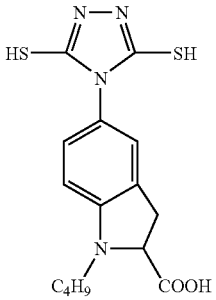
23
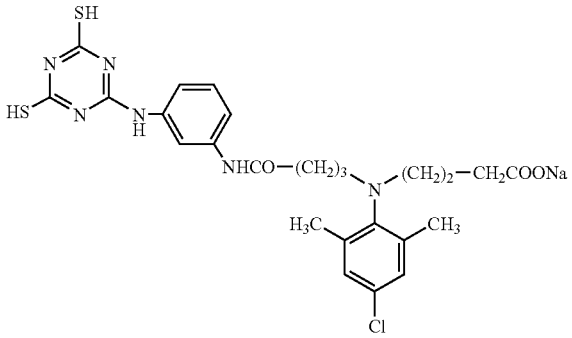
24
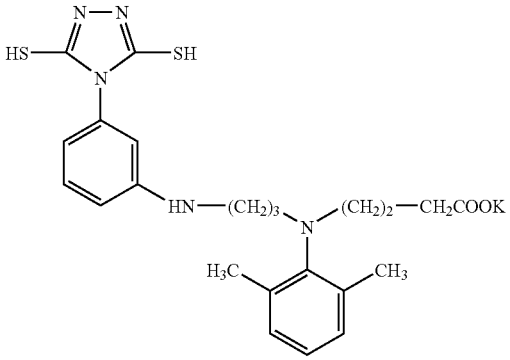
25
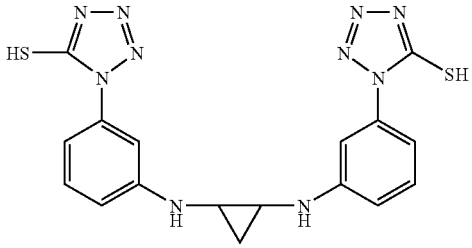
26
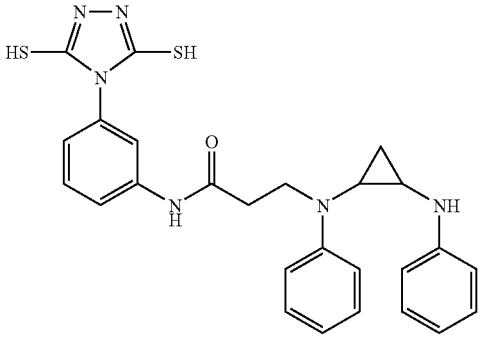
27
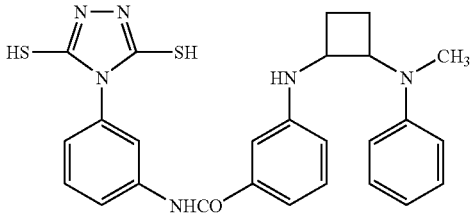

-continued
28
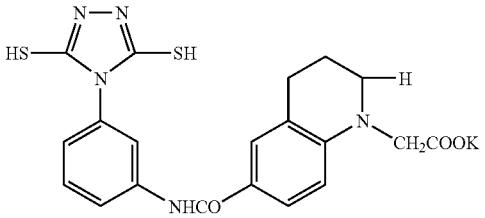
29
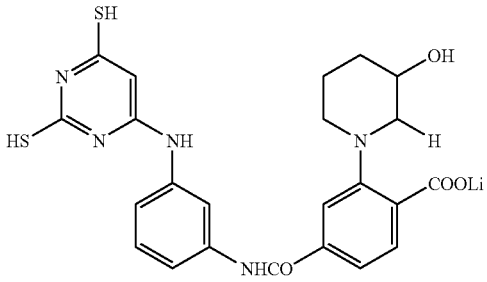
30
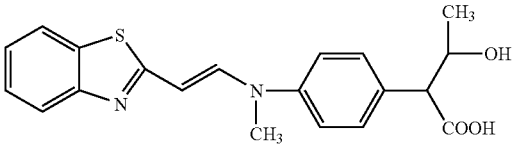
31
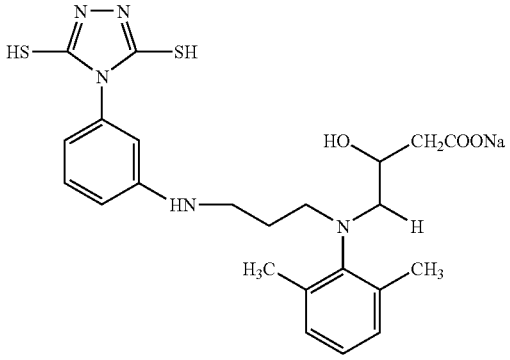
32
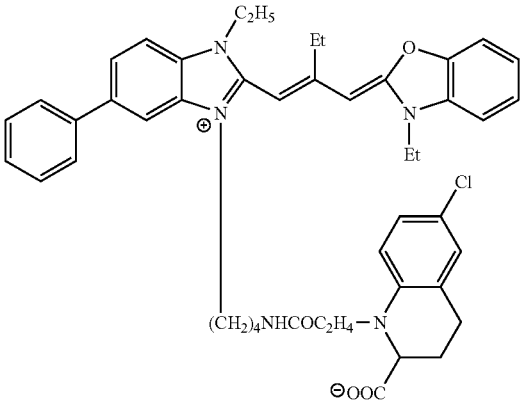
33
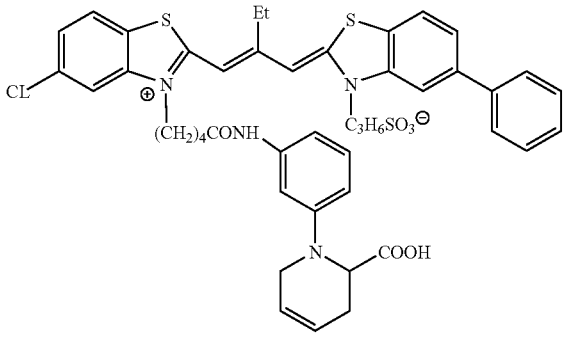
34
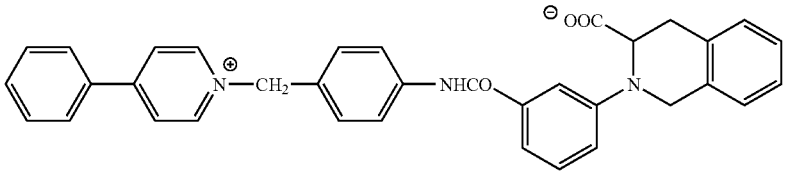
35
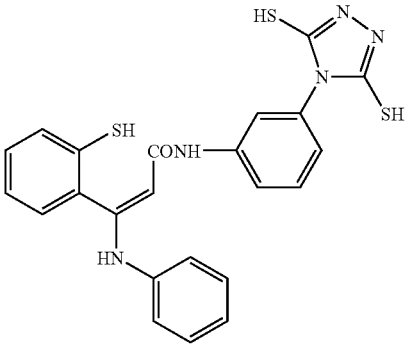
G-1
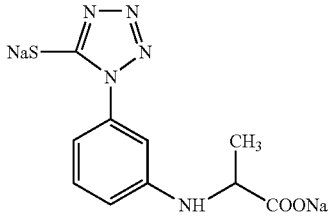

-continued

G-2

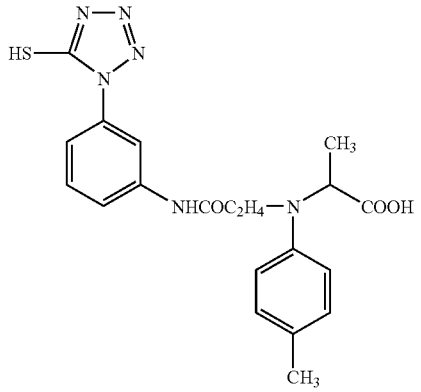

G-3

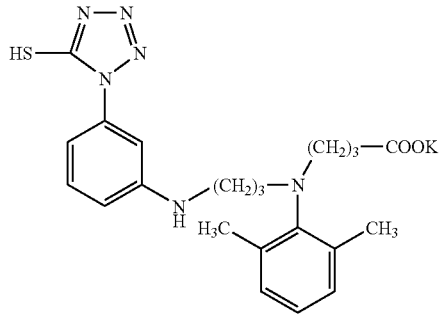

G-4

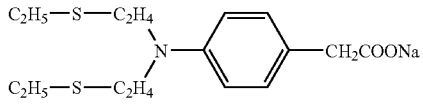

G-5

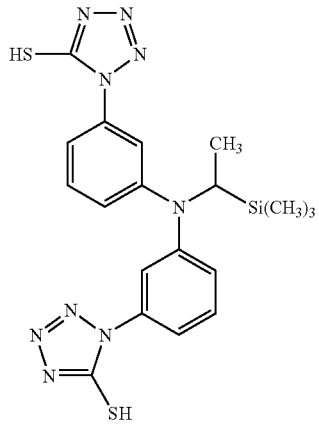

The compounds of the types 1 to 4 of the invention are same as compounds explained in detail in Japanese Patent Applications Nos. 2002-192373, 2002-188537, 2002-188536, 2001-272137 and 2002-192374. The specific examples of the compounds described in these patent applications can also be included as specific examples of the compounds of the types 1 to 4 of the invention. Also synthesis examples of the compounds of the types 1 to 4 of the invention are same to those described in these patent applications.

Specific examples of the compound of the type 5 of the invention includes compounds described as "1-photon 2-electron sensitizer" or "deprotonation electron donating sensitizer" in JP-A No. 9-211769 (compounds PMT-1 to S-37 described in Tables E and F in pages 28 to 32), JP-A No. 9-211774, JP-A No. 11-95355 (compounds INV1–36), JP-T No. 2001-500996 (compound 1–74, 80–87, 92–122), U.S. Pat. Nos. 5,747,235 and 5,747,236, EP No. 786,692A1 (compounds INV1–35), EP No. 893,732A1, U.S. Pat. Nos. 6,054,260 and 5,994,051.

The compound of the types 1 to 5 of the invention may be used in any stage in a preparation of a photosensitive silver halide emulsion or in a producing process of a photothermographic material. For example it may be used in a formation of photosensitive silver halide grains, in a desalting step, at a chemical sensitization or before coating. It may also be added in a divided manner in plural times in such process. A timing of addition is preferably within a period from an end of photosensitive silver halide grain formation but before a desalting step, or at a chemical sensitization (from immediately before the start of chemical sensitization to immediately after the end of chemical sensitization), or prior to a coating, and more preferably within a period from the chemical sensitization to a timing before a mixing with a non-photosensitive organic silver halide.

The compound of the types 1 to 5 of the invention is added preferably by dissolving in water, or a water-soluble solvent such as methanol or ethanol, or a mixture thereof. In case of dissolving in water, a compound showing a higher solubility at a higher or lower pH may be dissolved under a higher or lower pH.

The compound of the types 1 to 5 of the invention is preferably used in an emulsion layer including a photosensitive silver halide and a non-photosensitive organic silver halide, however it may be added in a protective layer or an intermediate layer in addition to an emulsion layer including a photosensitive silver halide and a non-photosensitive organic silver halide, and may be diffused at the coating. The compound of the invention may be added before or after an addition of a sensitizing dye, and is included in the silver halide emulsion layer in an amount of preferably $1\times10^{-9}$ to $5\times10^{-1}$ moles per 1 mole of silver halide, more preferably $1\times10^{-8}$ to $5\times10^{-2}$ moles.

10) Combined use of Plural Silver Halides

A photosensitive silver halide emulsion to be used in the photosensitive material of the invention may be formed by a single type, or by a combination of two or more types (for example types different in an average grain size, in a halogen composition, in a crystallizing tendency, or in chemical sensitizing conditions). A gradation may be regulated by employing photosensitive silver halides of plural types of different sensitivities. Technologies relating thereto are described for example in JP-A Nos. 57-119341, 53-106125, 47-3929, 48-55730, 46-5187, 50-73627 and 57-150841. As to a difference in sensitivity, there is preferred a difference of 0.2 logE or larger between the emulsions.

11) Coating Amount

An addition amount of the photosensitive silver halide, in terms of a coated silver amount per 1 $m^2$ of the photosensitive material, is preferably 0.03 to 0.6 $g/m^2$, more preferably 0.05 to 0.4 $g/m^2$, and most preferably 0.07 to 0.3 $g/m^2$. With respect to 1 mole of organic silver salt, the photosensitive silver halide is preferably present within a range of 0.01 to 0.5 moles, more preferably 0.02 to 0.3 moles and further preferably 0.03 to 0.2 moles.

12) Mixing of Photosensitive Silver Halide and Organic Silver Salt

As to a method and conditions of mixing the photosensitive silver halide and the organic silver salt, prepared separately, there may be employed a method of mixing the silver halide grain and the organic silver salt, prepared respectively, using a high-speed agitator, a ball mill, a sand mill, a colloid mill, a vibration mill or a homogenizer, or a method of mixing the already prepared photosensitive silver halide at any timing in the course of preparation of the organic silver salt, thereby preparing the organic silver salt, but no particular limitation exists as long as the effect of the invention may be sufficiently exhibited. It is also preferred, for regulating the photographic characteristics, to mix two or more aqueous dispersions of organic silver salts and two or more aqueous dispersions of photosensitive silver salts.

13) Mixing of Silver Halide to Coating Liquid

A preferred timing of addition of the silver halide of the invention to a coating liquid for an image forming layer is in a period from 180 minutes before coating to immediately before coating, preferably from 60 minutes to 10 seconds before coating, however a mixing method and a mixing condition are not particularly restricted as long as the effect of the invention may be sufficiently exhibited. Specific examples of the mixing method include a mixing method in a tank, so as to obtain a desired average stay time calculated from a flow rate of addition and a liquid supply rate to a coater, and a method of using a static mixer described for example in N. Harnby, M. F. Edwards and A. W. Nienow, "Liquid mixing technology", translated by Koji Takahashi and published by Nikkan Kogyo Shimbun, 1989, Chapter 8.

1-6. Binder

As a binder for an organic silver salt-containing layer of the invention, any polymer may be employed, and a preferable binder is transparent or semi-transparent and generally colorless, and may be a natural resin, polymer or copolymer, a synthetic resin, polymer or copolymer, or another film-forming material, such as a gelatin, a rubber, a poly(vinyl alcohol), a hydroxyethyl cellulose, a cellulose acetate, a cellulose acetate butyrate, a poly(vinylpyrrolidone), casein, starch, a poly(acrylic acid), a poly(methylmethacrylic acid), a poly(vinyl chloride), a poly(methacrylic acid), a styrene-maleic anhydride copolymer, a styrene-acrylonitrile copolymer, a styrene-butadiene copolymer, a poly(vinylacetal) (such as poly(vinylformal) or poly(vinylbutyral)), a poly(ester), a poly(urethane), a phenoxy resin, a poly(vinylidene chloride), a poly(epoxide), a poly(carbonate), a poly(vinyl acetate), a poly(olefin), a cellulose ester or a poly(amide). The binder may be formed by coating from water, an organic solvent or an emulsion.

In the invention, the binder usable in a layer containing an organic silver salt preferably has a glass transition temperature (Tg) within a range from 0 to 80° C. (hereinafter called also as a high Tg binder), more preferably 10 to 70° C. and further preferably 15 to 60° C.

In the present specification, the glass transition temperature (Tg) is calculated from a following equation:

$$1/Tg=\Sigma(Xi/Tgi)$$

It is assumed that the polymer is formed by a copolymerization of n monomer components (i=1−n); Xi represents a weight fraction of an i-th monomer (ΣXi=1), and Tgi represents a glass transition temperature (absolute temperature) of a homopolymer of the i-th monomer. Σ indicates a summation from i=1 to n. The glass transition temperature (Tgi) of a homopolymer of each monomer was obtained from Polymer Handbook (3rd edition) (J. Brandrup, E. H. Immergut (Wiley-Interscience, 1989)).

The binder may be used, if necessary, in combination of two or more kinds. It is also possible to employ a binder having a glass transition temperature equal to or higher than 20° C. and a binder having a glass transition temperature less than 20° C. In case of blending two or more polymers with different Tgs, it is preferred that a weight-averaged Tg is contained within the above-mentioned range.

In the invention, an organic silver salt-containing layer is formed into a film by preferably coating and drying a coating liquid in which 30 mass % or more of a solvent is water.

In the invention, in case the organic silver salt-containing layer is formed by coating and drying a coating liquid in which 30 mass % or more of the solvent is water, and in case a binder of the organic silver salt-containing layer is soluble or dispersible in an aqueous solvent (water solvent), the performance is improved when the binder is formed by a latex of a polymer showing an equilibrated water content of 2 mass % or less in an environment of 25° C. and 60% RH. In a most preferable embodiment, the binder is so prepared that an ion conductivity becomes 2.5 mS/cm or less, and such preparation may be achieved for example by a purification with a separating membrane after a polymer synthesis.

The aforementioned aqueous solvent in which the polymer is soluble or dispersible is water or a mixture of water and a water-miscible organic solvent in an amount of 70 mass % or less. Examples of the water-miscible organic solvent include an alcohol such as methyl alcohol, ethyl alcohol or propyl alcohol, a cellosolve such as methyl cellosolve, ethyl cellosolve or butyl cellosolve, ethyl acetate and dimethylformamide.

The term "aqueous solvent" is used herein also in a system in which the polymer is not thermodynamically dissolved but is present in so-called dispersion state.

The "equilibrated water content in an environment of 25° C. and 60% RH" may be represented, with a polymer weight W1 in a moisture equilibrium state in an environment of 25° C. and 60% RH and a polymer weight W0 in an absolute dry state at 25° C., as follows:

$$\text{equilibrated water content in an environment of 25° C., 60\% RH}=[(W1-W0)/W0]\times 100\ (\text{mass \%})$$

For the definition of the water content and the measuring method therefor, reference may be made for example to *Kobunshi Kogaku Koza* 14, *Kobunshi Zairyo Shikenho* (edited by Society of Polymer Science, published by Chijinshokan).

The binder polymer of the invention preferably has an equilibrated water content in an environment of 25° C., 60%

RH of 2 mass % or less, more preferably 0.01 to 1.5 mass %, and further preferably 0.02 to 1 mass %.

In the invention, a polymer dispersible in an aqueous solvent is particularly preferable. Such dispersion state may be a latex in which a water-insoluble hydrophobic polymer is dispersed in fine particles or a dispersion in which polymer molecules are dispersed in a molecular state or forming micelles, however particles dispersed as a latex are more preferable. The dispersed particles have an average particle size of 1 to 50,000 nm, preferably 5 to 1,000 nm, more preferably 10 to 500 nm and further preferably 50 to 200 nm. A particle size distribution of the dispersed particles is not particularly limited, and may be a wide particle size distribution or a mono-dispersed particle size distribution. For controlling physical properties of the coating liquid, it is also preferable to use two or more dispersions, each having a mono-dispersed particle size distribution, as a mixture.

As a preferred embodiment of the polymer dispersible in the aqueous solvent in the invention, there may be preferably employed a hydrophobic polymer such as an acrylic polymer, a poly(ester), a rubber (such as SBR resin), a poly (urethane), a poly(vinyl chloride), a poly(vinyl acetate), a poly(vinylidene chloride) or a poly(olefin). Such polymer may be a linear, ramified or crosslinked polymer, or may be so-called homopolymer formed by polymerizing a single monomer or a copolymer formed by polymerizing two or more monomers. In case of a copolymer, it may be a random copolymer or a block copolymer. Such polymer has a number-averaged molecular weight of 5,000 to 1,000,000, preferably 10,000 to 200,000. An excessively small molecular weight results in an insufficient mechanical strength of the image forming layer, while an excessively large molecular weight provides an undesirably inferior film forming property. Also a crosslinkable polymer latex is particularly preferably employed.

(Specific Examples of Latex)

Specific examples of the preferable polymer latex include those listed in the following. Following examples are represented by monomers used as the raw material, with a parenthesized number indicating mass % and a molecular weight represented by a number-averaged molecular weight. In an example employing a polyfunctional monomer, since the concept of molecular weight is not applicable because of a crosslinked structure, it is represented as crosslinking and the description of the molecular weight is omitted. Tg indicates a glass transition temperature:

P-1: latex of -MMA(70)-EA(27)-MAA(3)- (molecular weight 37000, Tg 61° C.)

P-2: latex of -MMA(70)-2EHA(20)-St(5)-AA(5)- (molecular weight 40000, Tg 59° C.)

P-3: latex of -St(50)-Bu(47)-MAA(3)- (crosslinking, Tg -17° C.)

P-4: latex of -St(68)-Bu(29)-AA(3)- (crosslinking, Tg 17° C.)

P-5: latex of -St(71)-Bu(26)-AA(3)- (crosslinking, Tg 24° C.)

P-6: latex of -St(70)-Bu(27)-IA(3)- (crosslinking)

P-7: latex of -St(75)-Bu(24)-AA(1)- (crosslinking, Tg 29° C.)

P-8: latex of -St(60)-Bu(35)-DVB(3)-MAA(2)-(crosslinking)

P-9: latex of -St(70)-Bu(25)-DVB(2)-AA(3)- (crosslinking)

P-10: latex of -VC(50)-MMA(20)-EA(20)-AN(5)-AA(5)-(molecular weight 80,000)

P-11: latex of -VDC(85)-MMA(5)-EA(5)-MAA(5)- (molecular weight 67,000)

P-12: latex of -Et(90)-MAA(10)- (molecular weight 12,000)

P-13: latex of -St(70)-2EHA(27)-AA(3)- (molecular weight 130,000, Tg 43° C.)

P-14: latex of -MMA(63)-EA(35)-AA(2)- (molecular weight 33,000, Tg 47° C.)

P-15: latex of -St(70.5)-Bu(26.5)-AA(3)- (crosslinking, Tg 23° C.)

P-16: latex of -St(69.5)-Bu(27.5)-AA(3)- (crosslinking, Tg 20.5° C.)

In the foregoing, the abbreviations represent following monomers: MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

The polymer latexes mentioned in the foregoing are also commercially available, and following ones may be utilized. Examples of acrylic polymer include Cebien A-4635, 4718, 4601 (foregoing manufactured by Daicel Chemical Industries, Ltd.), Nipol Lx 811, 814, 821, 820, 857 (foregoing manufactured by Zeon Corp.) etc.; examples of poly(ester) include FINETEX ES 650, 611, 675, 850 (foregoing manufactured by Dainippon Ink and Chemicals Inc.), WD-size, WMS (foregoing manufactured by Eastman Chemical Co.) etc.; examples of poly(urethane) include HYDRAN AP 10, 20, 30, 40 (foregoing manufactured by Dainippon Ink and Chemicals Inc.) etc.; examples of rubber include LACSTAR 7310K, 3307B, 4700H, 7132C (foregoing manufactured by Dainippon Ink and Chemicals Inc.), Nipol Lx 416, 410, 438C, 2507 (foregoing manufactured by Zeon Corp.) etc.; examples of poly(vinyl chloride) include G351, G576 (foregoing manufactured by Zeon Corp.) etc.; examples of poly (vinylidene chloride) include L502, L513 (foregoing manufactured by Asahi Chemical Industries Ltd.) etc.; and examples of poly(olefin) include Chemipar S120, SA100 (foregoing manufactured by Mitsui Chemical Co.), etc.

These polymer latexes may be employed singly or in a blend of two or more kinds according to the necessity.

(Preferable Latex)

The polymer latex to be employed in the invention is particularly preferably a latex of a styrene-butadiene copolymer. In the styrene-butadiene copolymer, a weight ratio of a styrene monomer unit and a butadiene monomer unit is preferably 40:60 to 95:5. Also the styrene monomer unit and the butadiene monomer unit preferably occupy a proportion, in the copolymer, within a range of 60 to 99 mass %. Also the polymer latex of the invention preferably includes acrylic acid or methacrylic acid in an amount of 1 to 6 mass % with respect to a sum of styrene and butadiene, more preferably 2 to 5 mass %. The polymer latex of the invention preferably includes acrylic acid. A preferred range of the molecular weight is same as described in the foregoing.

Preferred examples of a styrene-butadiene acid copolymer latex employable in the invention include P-3 to P-8, and P-15 mentioned in the foregoing and LACSTAR 3307B, 7132C and Nipol Lx 416 which are commercially available.

In the organic silver salt-containing layer of the photosensitive material of the invention, there may be added, if necessary, a hydrophilic polymer such as gelatin, polyvinyl alcohol, methyl cellulose, hydroxypropyl cellulose, or carboxymethyl cellulose. An amount of addition of such hydrophilic polymer is preferably 30 mass % or less with respect to the total binder in the organic silver salt-containing layer, more preferably 20 mass % or less.

The organic silver salt-containing layer (namely image forming layer) of the invention is preferably formed by employing a polymer latex. An amount of the binder in the organic silver salt-containing layer is, in a weight ratio of total binder/organic silver salt, preferably within a range from 1/10 to 10/1, more preferably 1/3 to 5/1, and further preferably 1/1 to 3/1.

Such organic silver salt-containing layer is usually also a photosensitive layer (emulsion layer) including a photosensitive silver halide which is a photosensitive silver salt, and, in such case, a weight ratio of total binder/silver halide is preferably within a range of 400 to 5, more preferably 200 to 10.

In the image forming layer of the invention, an amount of total binder is preferably 0.2 to 30 g/m$^2$, more preferably 1 to 15 g/m$^2$, and further preferably 2 to 10 g/m$^2$. In the image forming layer of the invention, there may be added a crosslinking agent for crosslinking, or a surfactant for improving the coating property.

(Preferable Solvent for Coating Liquid)

In a coating liquid for the organic silver salt-containing layer of the photosensitive material of the invention, a solvent (indicating solvent and dispersant collectively, for the purpose of simplicity) is preferably an aqueous solvent containing water by 30 mass % or higher. A component other than water may be any water-miscible organic solvent, such as methyl alcohol, ethyl alcohol, isopropyl alcohol, methyl cellosolve, ethyl cellosolve, dimethylformamide or ethyl acetate. The water content of the solvent is preferably 50 mass % or higher, and more preferably 70 mass % or higher. Examples of the preferred solvent composition (number in mass %) include water, water/methyl alcohol=90/10, water/methyl alcohol=70/30, water/methyl alcohol/dimethylformamide=80/15/5, water/methyl alcohol/ethyl cellosolve=85/10/5, and water/methyl alcohol/isopropyl alcohol=85/10/5.

1-7. Antifogging Agent

An antifogging agent, a stabilizer and a stabilizer precursor employable in the invention may be compounds described in JP-A No. 10-62899, paragraph 0070, EP-A No. 0,803,764A1, page 20, line 57 to page 21, line 7, JP-A Nos. 9-281637 and 9-329864, U.S. Pat. No. 6,083,681, and European Patent No. 1048975. Also an antifogging agent advantageously employed in the invention is an organic halogen compound, which may be compounds described in JP-A No. 11-65021, paragraphs 0111–0112. There are particularly preferred an organic halogen compound represented by a formula (P) in JP-A No. 2000-284399, an organic polyhalogen compound represented by formula (II) in JP-A No. 10-339934, and an organic polyhalogen compound described in JP-A Nos. 2001-31644 and 2001-33911.

1) Polyhalogen Compound

In the following an organic polyhalogen compound preferable in the invention will be explained in detail.

A polyhalogen compound preferred in the invention is represented by a following formula (H).

$$Q\text{-}(Y)_n\text{—}C(Z_1)(Z_2)X \qquad \text{Formula (H)}$$

In formula (H), Q represents an alkyl group, an aryl group or a heterocyclic group; Y represents a divalent connecting group; n represents 0 or 1; $Z_1$ and $Z_2$ each represents a halogen atom; and X represents a hydrogen atom or an electron attracting group.

In formula (H), Q is preferably an aryl group or a heterocyclic group. In case Q is a heterocyclic group in formula (H), there is preferred a nitrogen-containing heterocyclic group including 1 or 2 nitrogen atoms, and particularly preferably a 2-pyridyl group or a 2-quinolyl group.

In case where Q is an aryl group in formula (H), Q preferably represents a phenyl group substituted with an electron attracting group of which a Hammett's substituent constant up assumes a positive value. As to the Hammett's substituent constant, reference may be made for example to Journal of Medicinal Chemistry, 1973, Vol.16, No.11, 1207–1216. Such electron attracting group may be, for example, a halogen atom (such as fluorine atom (σp: 0.06), a chlorine atom (σp: 0.23), a bromine atom (σp: 0.23) or an iodine atom (σp: 0.18)), a trihalomethyl group (such as tribromomethyl (σp: 0.29), trichloromethyl (σp: 0.33) or trifluoromethyl (σp: 0.54)), a cyano group (σp: 0.66), a nitro group (σp: 0.78), an aliphatic, aryl or heterocyclic sulfonyl group (such as methanesulfonyl (σp: 0.72)), an aliphatic, aryl or heterocyclic acyl group (such as acetyl (σp: 0.50) or benzoyl (σp: 0.43)), an alkinyl group (such as C≡CH (σp: 0.23)), an aliphatic, aryl or heterocyclic oxycarbonyl group (such as methoxycarbonyl (σp: 0.45) or phenoxycarbonyl (σp: 0.44)), a carbamoyl group (σp: 0.36), a sulfamoyl group (σp: 0.57), a sulfoxide group, a heterocyclic group or a phosphoryl group. The σp value is preferably within a range of 0.2 to 2.0, more preferably 0.4 to 1.0. The electron attracting group is particularly preferably a carbamoyl group, an alkoxycarbonyl group, an alkylsulfonyl group, or an alkylphosphoryl group, and most preferably a carbamoyl group.

X is preferably an electron attracting group, more preferably a halogen atom, an aliphatic, aryl or heterocyclic sulfonyl group, an aliphatic, aryl or heterocyclic acyl group, an aliphatic, aryl or heterocyclic oxycarbonyl group, a carbamoyl group or a sulfamoyl group, and particularly preferably a halogen atom. The halogen atom is preferably a chlorine atom, a bromine atom or an iodine atom, further preferably a chlorine atom or a bromine atom and particularly preferably a bromine atom.

Y preferably represents —C(=O)—, —SO— or —$SO_2$—, more preferably —C(=O)— or —$SO_2$—, and particularly preferably —$SO_2$—, and n represents 0 or 1, preferably 1.

In the following, specific examples of the compound of formula (H) of the invention are shown, but the invention is not limited to such examples.

(H-1)

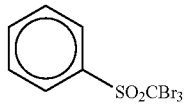

(H-2)

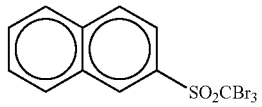

(H-3)

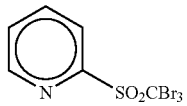

(H-4)

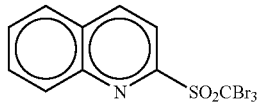

-continued (H-5)

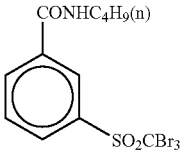

(H-6)

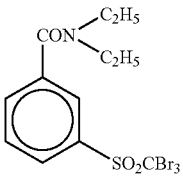

(H-7)

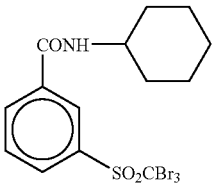

(H-8)

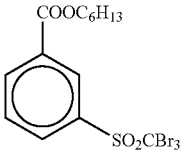

(H-9)

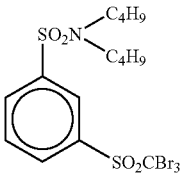

(H-10)

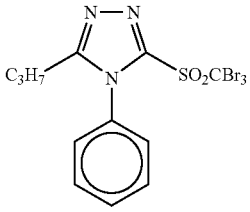

(H-11)

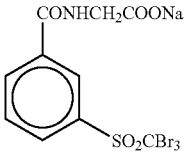

(H-12)

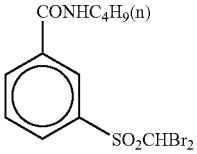

(H-13)

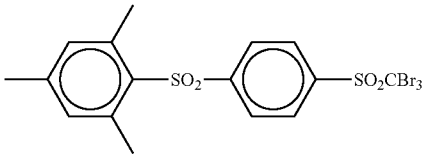

-continued (H-14)

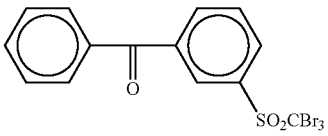

(H-15)

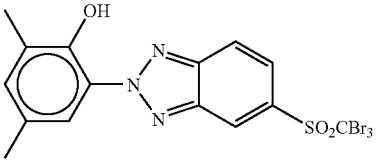

The polyhalogen compound preferable in the invention, other than those described above, may be those described in JP-A Nos. 2001-31644, 2001-56526 and 2001-209145.

The compound of formula (H) of the invention is preferably used within a range of $10^{-4}$ to 1 mole per mole of the non-photosensitive silver salt in the image forming layer, more preferably $10^{-3}$ to 0.5 moles, and further preferably $1\times10^{-2}$ to 0.2 moles.

In the invention, the anti-fogging agent may be included in the photosensitive material by the aforementioned method described for including the reducing agent, and it is preferable to add also the organic polyhalogen compound in a state of a solid fine particle dispersion.

The compound represented by formula (H) preferably has a melting point of 200° C. or less, more preferably 170° C. or less.

2) Other Anti-fogging Agents

As another anti-fogging agent, there may be employed a mercury (II) salt described in JP-A No. 11-65021, paragraph 0113, a benzoic acid described in paragraph 0114 therein, a salicylic acid derivative described in JP-A No. 2000-206642, a formalin scavenger compound represented by formula (S) in JP-A No. 2000-221634, a triazine compound described in claim 9 of JP-A No. 11-352624, a compound represented by formula (III) in JP-A No. 6-11791, 4-hydroxy-6-methyl-1,3,3a,7-tetrazaindene etc.

The photothermographic material of the invention may include an azolium salt for the purpose of fog prevention. The azolium salt may be a compound represented by formula (XI) in JP-A No. 59-193447, a compound described in JP-B No. 55-12581, or a compound represented by formula (II) in JP-A No. 60-153039. The azolium salt may be added to any part of the photosensitive material, but, as to a layer of addition, it is preferably added in a layer on a side having the photosensitive layer and more preferably added to the organic silver salt-containing layer. The azolium salt may be added in any step of preparation of the coating liquid, and, in case of an addition to the organic silver salt-containing layer, in any step from the preparation of the organic silver salt to the preparation of the coating liquid, but preferably within a period from a time after the preparation of the organic silver salt to a time immediately before the coating. The azolium salt may be added in any method, such as powder, a solution or a dispersion of fine particles. Also it may be added as a mixed solution with another additive such as a sensitizing dye, a reducing agent or a toning agent. In the invention, the azolium salt may be added in any amount, however there is preferred an amount from $1\times10^{-6}$ to 2 moles per mole of silver, more preferably from $1\times10^{-3}$ to 0.5 moles.

1-8. Other Additives

1) Mercapto, Disulfide and Thion

In the invention, for the purposes of controlling development by suppression or acceleration, for improving an efficiency of spectral sensitization, and for improving storability before and after the development, there may be included a mercapto compound, a disulfide compound or a thion compound such as those described in JP-A No. 10-62899, paragraphs 0067–0069, those represented by a formula (I) in JP-A No. 10-186572 and specific example described in paragraphs 0033–0052 thereof, and those described in EP-A No. 0,803,764A1, page 20, lines 36–56. Among these, particularly preferred is a mercapto-substituted heteroaromatic compound described for example in JP-A Nos. 9-297367, 9-304875 and 2001-100358 and Japanese Patent Applications Nos. 2001-104213 and 2001-104214.

2) Toning Agent

In the photothermographic material of the invention, a toning agent is preferably added. The toning agent is described in JP-A No. 10-62899, paragraphs 0054–0055, EP-A No. 0,803,764A1, p.21, lines 23 to 48, JP-A Nos. 2000-356317 and 2000-187298, and there is particularly preferred a phthalazinone (phthalazinone, a phthalazinone derivative or a metal salt thereof, such as 4-(1-naphthyl) phthalazinone, 6-chlorophthalazinone, 5,7-dimethoxyphthazinone or 2,3-dihydro-1,4-phthalazindione); a combination of a phthalazinone and a phthalic acid (such as phthalic acid, 4-methylphthalic acid, 4-nitrophthalic acid, diammonium phthalate, sodium phthalate, potassium phthalate or tetrachlorophthalic anhydride); a phthalazine (phthalazine, a phthalazine derivative or a metal salt thereof, such as 4-(1-naphtyl)phthalazine, 6-isopropylphthalazine, 6-t-butylphthalazine, 6-chlorophthalazine, 5,7-dimethoxyphthalazine or 2,3-dihydrophthalazine); or a combination of a phthalazine and a phthalic acid, and, there is particularly preferred a combination of a phthalazine and a phthalic acid. Among such combination, a combination of 6-isopropylphthazine and phthalic acid or 4-methylphthalic acid is particularly preferable.

3) Plasticizer and Lubricant

A plasticizer and a lubricant employable in the photosensitive layer of the invention are described in JP-A No. 11-65021, paragraph 0117. A lubricant is described in JP-A No.11-84573, paragraphs 0061–0064, and Japanese Patent Application No. 11-106881, paragraphs 0049–0062.

4) Dye and Pigment

In the photosensitive layer of the invention, for the purposes of color tone improvement, prevention of interference fringes at the laser exposure and prevention of irradiation, there may be employed various dyes and pigments (for example C. I. Pigment Blue 60, C. I. Pigment Blue 64, or C. I. Pigment Blue 15:6). These are described in detail for example in WO98/36322, and JP-A Nos. 10-268465 and 11-338098.

5) Ultra-hard Gradation Enhancing Agent

For forming an ultra high contrast image suitable for printing platemaking, it is preferable to add an ultra-hard gradation enhancing agent in the image forming layer. The ultra-hard gradation enhancing agent, a method of addition thereof and an amount of addition thereof are described for example in JP-A No. 11-65021, paragraph 0118, JP-A No. 11-223898, paragraphs 0136–0193, Japanese Patent Application No. 11-87297, compounds of formulas (H), (1) to (3), (A) and (B), Japanese Patent Application No. 11-91652, compounds of formulas (III) to (V) (specific compounds in formulas 21–24), while a hard gradation accelerating agent is described in JP-A No. 11-65021, paragraph 0102 and JP-A No. 11-223898, paragraphs 0194–0195.

In order to employ formic acid or a formate salt as a strong fogging substance, it is preferably added in a side having the image forming layer, containing photosensitive silver halide, in an amount of 5 mmol. or less per 1 mole of silver, more preferably 1 mmol. or less.

In case of employing an ultra-hard gradation enhancing agent in the photothermographic material of the invention, it is preferable to use, in combination, an acid formed by hydration of phosphorous pentoxide or a salt thereof. Examples of the acid formed by hydration of phosphorous pentoxide or a salt thereof include metaphosphoric acid (and salt thereof), pyrophosphoric acid (and salt thereof, orthophosphoric acid (and salt thereof), triphosphoric acid (and salt thereof), tetraphosphoric acid (and salt thereof, and hexametaphosphoric acid (and salt thereof. An acid formed by hydration of phosphorous pentoxide or a salt thereof, that may be particularly preferably employed, is orthophosphoric acid (or salt thereof), or hexametaphosphoric acid (or salt thereof). Specific examples of salt include sodium orthophosphate, sodium dihydrogen orthophosphate, sodium hexametaphosphate and ammonium hexametaphosphate.

An amount of use (coating amount per 1 $m^2$ of the photosensitive material) of the acid formed by hydration of phosphorous pentoxide or the salt thereof may be suitably selected according to desired performances such as the sensitivity or the fog level, however is preferably 0.1 to 500 $mg/m^2$ and more preferably 0.5 to 100 $mg/m^2$.

The reducing agent, the hydrogen bond-forming compound, the development accelerator and the polyhalogen compound of the invention are preferably used as a solid dispersion, and a preferable producing method of such solid dispersion is described in JP-A No. 2002-55405.

1-9. Preparation and Coating of Coating Liquid

A coating liquid for the image forming layer of the invention is preferably prepared at a temperature from 30° C. to 65° C., more preferably at a temperature equal to or higher than 35° C. but less than 60° C., further preferably a temperature from 35° C. to 55° C. Also the coating liquid for the image forming layer is preferably maintained, immediately after the addition of polymer latex, at a temperature from 30° C. to 65° C.

1-10. Layer Configuration and Constituent Components

The image forming layer of the invention is constituted of one or more layers provided on a support. In case it is constituted of a single layer, it is formed by an organic silver salt, a photosensitive silver halide, a reducing agent and a binder, and includes desired additional materials such as a toning agent, an auxiliary coating agent, and other auxiliary materials, if necessary. In case it is constituted of two or more layers, a first image forming layer (usually adjacent to the support) includes an organic silver salt and a photosensitive silver halide, and certain other components have to be included in a second image forming layer or in both layers. In a configuration of a multi-color photothermographic material, a combination of these two layers may be included for each color, or, as described in U.S. Pat. No. 4,708,928, all the components may be included within a single layer. In case of a multi-dye, multi-color photothermographic material, emulsion layers are generally maintained in a separate state, as described in U.S. Pat. No. 4,460,681, by employing a functional or non-functional barrier layer between the photosensitive layers.

The photothermographic material of the invention may have a non-photosensitive layer in addition to the image forming layer. The non-photosensitive layer may be classified, based on a position thereof, into (a) a surface protective layer provided on the image forming layer (namely, remotest from the support), (b) an intermediate layer provided between plural image forming layers or between an image forming layer and a protective layer, (c) an undercoat layer formed between an image forming layer and the support, and (d) a back layer formed at a side opposite to the image forming layer.

There may also be provided a layer functioning as an optical filter, which is formed as a layer (a) or (b). Also an antihalation layer is provided as a layer (c) or (d) in the photosensitive material.

1) Surface Protective Layer

The photothermographic material of the invention may have a surface protective layer, for example for preventing sticking of the image forming layer. The surface protective layer may be formed by a single layer or by plural layers.

The surface protective layer is described in JP-A No. 11-65021, paragraphs 0119–0120, and JP-A No. 2000-171936.

As a binder for the surface protective layer of the invention, gelatin is preferred, but it is also preferable to use polyvinyl alcohol (PVA) singly or in combination. For the gelatin, there may be employed inert gelatin (for example, Nitta gelatin 750) or phthalated gelatin (for example, Nitta gelatin 801). As PVA, there may be employed one described in JP-A No. 2000-171936, paragraphs 0009–0020, and there may be preferably employed a completely saponified product such as PVA-105, a partially saponified product such as PV-205, PVA-335, or a denatured polyvinyl alcohol such as MP-203 (foregoing are trade names of Kuraray Co.). A coating amount of polyvinyl alcohol (per $m^2$ Of support) in the protective layer (per layer) is preferably 0.3 to 4.0 $g/m^2$, more preferably 0.3 to 2.0 $g/m^2$.

A coating amount of the total binder (including the water-soluble polymer and the latex polymer) (per 1 $m^2$ of support) in the surface protective layer (per one layer) is preferably 0.3 to 5.0 $g/m^2$, more preferably 0.3 to 2.0 $g/m^2$.

2) Antihalation Layer

In the photothermographic material of the invention, an antihalation layer may be provided at a side farther than the photosensitive layer from the exposure light source.

The antihalation layer is described in JP-A No. 11-65021, paragraphs 0123–0124, JP-A Nos. 11-223898, 9-230531, 10-36695, 10-104779, 11-231457, 11-352625 and 11-352626.

The antihalation layer includes an antihalation dye having an absorption in the exposing wavelength. In case the exposure wavelength is in an infrared region, an infrared-absorbing dye may be employed, and, in such a case, there is preferred a dye which has no absorption in the visible region.

In case of executing antihalation with a dye having an absorption in the visible region, it is preferable that the color of the dye does not substantially remain after the image formation. It is preferable to employ means for discoloration by the action of heat upon thermal development, and particularly preferable to add a thermally discolorable dye and a base precursor in the non-photosensitive layer to thereby achieve a function as an antihalation layer. Such a technology is described for example in JP-A No. 11-231457.

An addition amount of the discolorable dye is determined according to the purpose of the dye. In general it is used in such an amount that the optical density (absorbance) measured at an object wavelength is higher than 0.1. The optical density is preferably within a range from 0.15 to 2, and more preferably from 0.2 to 1. An amount of the dye used for obtaining such an optical density is generally within a range of about 0.001 to 1 $g/m^2$.

By discoloring of the dye, it is possible to reduce the optical density after thermal development to 0.1 or less. It is also possible to use two or more discolorable dyes in combination, in a thermally discolorable recording material or in a photothermographic material. Similarly, it is possible to use two or more base precursors in combination.

In such a thermal discoloration utilizing a discolorable dye and a base precursor, it is preferable, for the thermal discoloring property, to use in combination a substance (such as diphenylsulfon, 4-chlorophenyl(phenyl)sulfon or 2-naphthyl benzoate) that can lower the melting point by 3° C. (deg) or more when mixed with the base precursor, as described in JP-A No. 11-352626.

3) Back Layer

A back layer that may be employed in the invention is described in JP-A No. 11-65021, paragraphs 0128–0130.

In the invention, a coloring agent having an absorption maximum at 300 to 450 nm may be added in order to improve a tone of silver image and a time-dependent change of the image. Such a coloring agent is described for example in JP-A Nos. 62-210458, 63-104046, 63-103235, 63-208846, 63-306436, 63-314535, 01-61745 and 2001-100363.

The coloring agent is added usually within a range of 0.1 $mg/m^2$ to 1 $g/m^2$, and preferably added in a back layer formed at an opposite side of the photosensitive layer.

Also for adjusting a color of a base, it is preferable to use a dye having an absorption peak at 580 to 680 nm. For the dye of such a purpose, there is preferred a dye having a low absorption intensity at a short wavelength side, such as an oil-soluble azomethine dye described in JP-A Nos. 4-359967 and 4-359968, or a water-soluble phthalocyanine dye described in Japanese Patent Application No.2002-96797. The dye for such a purpose may be added in any layer, but is preferably added in a non-photosensitive layer at the emulsion side, or in the back surface side.

The photothermographic material of the invention is preferably a so-called one-side photosensitive material, having at least one photosensitive layer containing a silver halide emulsion on one side of a support, and a back layer on the other side.

4) Matting Agent

In the invention, it is preferable to add a matting agent for improving a transporting property. The matting agent is described in JP-A No. 11-65021, paragraphs 0126–0127. A use amount of the matting agent, in a coating amount per $m^2$ of the photosensitive material, is preferably 1 to 400 $mg/m^2$, more preferably 5 to 300 $mg/m^2$.

In the invention, the matting agent may have a fixed shape or an amorphous shape, however it is preferably of a fixed shape, and a spherical shape is employed preferably. An average particle size is preferably 0.5 to 10 μm, more preferably 1.0 to 8.0 μm, and further preferably 2.0 to 6.0 μm. Also a fluctuation factor of the size distribution is preferably 50% or less, more preferably 40% or less, and further preferably 30% or less. The fluctuation factor is represented by (standard deviation of particle size)/(average of particle size)×100. It is also preferable to use, in combination, two matting agents having low fluctuation factors and having a ratio of the average particle sizes larger than 3.

A matting degree of an emulsion surface may be arbitrarily selected within an extent of absence of so-called stardust failure, but is preferably within a range of Beck's smoothness of 30 to 2,000 seconds, particularly preferably 40 to 1,500 seconds. The Beck's smoothness may be easily determined according to JIS P8119 "Smoothness testing method with Beck's tester for paper and board", and TAPPI standard method T479.

In the invention, a matting degree of the back layer is preferably within a range of Beck's smoothness of 1,200 to 10 seconds, more preferably 800 to 20 seconds and further preferably 500 to 40 seconds.

In the invention, the matting agent is preferably included in an outermost surface layer of the photosensitive material, a layer functioning as an outermost surface layer, or a layer close to the external surface, or it is preferably included in a layer functioning as a so-called protective layer.

5) Polymer Latex

A polymer latex is preferably employed in a surface protective layer or in a back layer, in case where the photothermographic material of the invention is applied to a printing application, in which a dimensional change is a major concern. Such polymer latex is described for example in *Gosei Jushi Emulsion* (edited by Taira Okuda and Hiroshi Inagaki, published by Kobunshi Kankokai (1978)), *Gosei Latex no Ouyou*, (edited by Takaaki Sugimura, Yasuo Kataoka, Soichi Suzuki and Keiji Kasahara, published by Kobunshi Kankokai (1993)), and *Gosei Latex no Kagaku* (Soichi Muroi, published by Kobunshi Kankokai (1970)), and may more specifically be a latex of a methyl methacrylate (33.5 mass %)/ethyl acrylate (50 mass %)/methacrylic acid (16.5 mass %) copolymer, a latex of a methyl methacrylate (47.5 mass %)/butadiene (47.5 mass %)/itaconic acid (5 mass %) copolymer, a latex of an ethyl acrylate/methacrylic acid copolymer, a latex of a methyl methacrylate (58.9 mass %)/2-ethylhexyl acrylate (25.4 mass %)/styrene (8.6 mass %)/2-hydroxyethyl methacrylate (5.1 mass %)/acrylic acid (2.0 mass %) copolymer, a latex of a methyl methacrylate (64.0 mass %)/styrene (9.0 mass %)/butyl acrylate (20.0 mass %)/2-hydroxyethyl methacrylate (5.0 mass %)/acrylic acid (2.0 mass %) copolymer etc. Also, as a binder for the surface protective layer, there may be applied a combination of polymer latexes described in Japanese Patent Application No. 11-6872, a technology described in JP-A No. 2000-267226, paragraphs 0021–0025, a technology described in JP-A No.11-6872, paragraphs 0027–0028, or a technology described in JP-A No.2000-19678, paragraphs 0023–0041. A proportion of the polymer latex in the surface protective layer is preferably 10 to 90 mass % in all the binder, particularly preferably 20 to 80 mass %.

6) Film Surface pH

The photothermographic material of the invention preferably has a film surface pH of 7.0 or less before the thermal development, more preferably 6.6 or less. A lower limit of the film surface pH is not particularly restricted but is generally about 3. A most preferred pH range is from 4 to 6.2. For regulating the film surface pH, there is preferably employed an organic acid such as a phthalic acid derivative, a non-volatile acid such as sulfuric acid, or a volatile base such as ammonia, in view of lowering the film surface pH. In particular, ammonia is preferable for attaining a low film surface pH, as it is easily volatile and may be removed in the coating step or before the thermal development.

It is also preferable to employ a non-volatile base such as sodium hydroxide, potassium hydroxide or lithium hydroxide in combination with ammonia. A measuring method for the film surface pH is described in JP-A No. 2000-284399, paragraph 0123.

7) Hardening Agent

A hardening agent may be used in the photosensitive layer, the protective layer, or the back layer of the invention. Examples of the hardening agent are described in T. H. James, "The Theory of the Photographic Process Fourth Edition" (Macmillan Publishing Co. Inc., 1977) pp.77–87, and there may be preferably employed chromium alum, sodium 2,4-dichloro-6-hydroxy-s-triazine, N,N-ethylenebis(vinylsulfonacetamide), N,N-propylenebis(vinylsulfonacetamide), a polyvalent metal ion described in p.78 of the aforementioned reference, a polyisocyanate described in U.S. Pat. No. 4,281,060, JP-A No. 6-208193 etc., an epoxy compound described in U.S. Pat. No. 4,791,042 etc. and a vinylsulfone compound described in JP-A No. 62-89048 etc.

The hardening agent is added as a solution, and a timing of addition of such solution to the coating liquid for the protective layer is within a period from 180 minutes before the coating operation to a time immediately before the coating operation, preferably within a period from 60 minutes before the coating operation to 10 seconds before the coating operation, but a mixing method and a mixing condition are not particularly restricted as long as the effect of the invention may be sufficiently exhibited. Specific examples of the mixing method include a mixing method in a tank for obtaining a desired average stay time based on a flow rate of addition and a liquid supply rate to a coater, and a method of utilizing a static mixer, as described in N. Harnby, M. F. Edwards, A. W. Nienow, "Liquid Mixing Technologies" (translated by Koji Takahashi, Nikkan Kogyo Shimbunsha, 1989), chapter 8.

8) Surfactant

A surfactant employable in the invention is described in JP-A No. 11-65021, paragraph 0132. Also the above-mentioned references describes a solvent in a paragraph 0133, a support in a paragraph 0134, an antistatic agent or a conductive layer in a paragraph 0135, a method for obtaining a color image in a paragraph 0136. Also a lubricant is described in JP-A No. 11-84573, paragraphs 0061–0064 and Japanese Patent Application No. 11-106881, paragraphs 0049–0062.

In the invention, it is preferable to employ a fluorine-type surfacant. Preferred specific examples of the fluorine-type surfacant include those described in JP-A Nos. 10-197985, 2000-19680 and 2000-214554. There can also be preferably employed a fluorinated polymer surfactant described in JP-A No. 9-281636. In the photothermographic material of the invention, it is preferable to employ a fluorine-type surfacant described in JP-A No. 2002-82411, and Japanese Patent Applications Nos. 2001-242357 and 2001-264110. In particular, the fluorine-type surfacant described in Japanese Patent Applications Nos. 2001-242357 and 2001-264110 is preferable in a charge regulating ability, a stability of a coated surface and a lubricating ability in case of executing a coating with an aqueous coating liquid, and a fluorine-type surfacant described in Japanese Patent Application No. 2001-264110 is most preferable in that it has a high charge adjusting ability and it may be used in a small amount.

In the invention, the fluorine-type surfacant may be employed in either of the emulsion surface and the back surface, and is preferably employed in both surfaces. It is particularly preferable to employ it in combination with a conductive layer including the aforementioned metal oxide. In such case, a sufficient performance may be obtained even in case the fluorine-type surfacant on a surface having the conductive layer is reduced in the amount or is eliminated.

An amount of use of the fluorine-type surfacant, in each of the emulsion surface and the back surface, is preferably within a range of 0.1 to 100 mg/m$^2$, more preferably 0.3 to 30 mg/m$^2$, and further preferably 1 to 10 mg/m$^2$. In particular, a fluorine-type surfacant described in Japanese Patent Application No. 2001-264110 has a large effect and is employed preferably within a range of 0.01 to 10 mg/m$^2$, more preferably 0.1 to 5 mg/m$^2$.

9) Antistatic Agent

In the invention, a conductive layer including a metal oxide or a conductive polyer is preferably provided. The antistatic layer may be formed as the undercoat layer, the back layer or the surface protective layer, or may be formed separately. For a conductive material in the antistatic layer, there is preferably employed a metal oxide of which conductivity is improved by introducing an oxygen defect or a different metal atom in a metal oxide. Preferable examples of the metal oxide include ZnO, $TiO_2$ and $SnO_2$, and there is preferred an addition of Al or In to ZnO, an addition of Sb, Nb, P or a halogen element to $SnO_2$, or an addition of Nb, Ta etc. to $TiO_2$. $SnO_2$ added with Sb is particularly preferable. An amount of addition of a different element is preferably within a range of 0.01 to 30 mol %, more preferably 0.1 to 10 mol %. A shape of the metal oxide may be spherical, acicular or plate-shaped, but, in consideration of an effect of providing conductivity, there is preferred an acicular particle with a longer axis/shorter axis ratio of 2.0 or higher, preferably 3.0 to 50. An amount of use of the metal oxide is preferably within a range of 1 to 1000 mg/m$^2$, more preferably 10 to 500 mg/m$^2$, and further preferably 20 to 200 mg/m$^2$. The antistatic layer of the invention may be provided on either of the emulsion side and the back side, but is preferably provided between the support and the back layer. Specific examples of the antistatic layer of the invention are described in JP-A No. 11-65021, paragraph 0135, JP-A Nos. 56-143430, 56-143431, 58-62646 and 56-120519, JP-A No. 11-84573, paragraphs 0040–0051, U.S. Pat. No. 5,575,957 and JP-A No. 11-223898, paragraphs 0078–0084.

10) Support

For a transparent support, there is preferably employed a polyester, particularly polyethylene terephthalate, subjected to a heat treatment in a temperature range of 130 to 185° C. in order to relax an internal strain remaining in the film at a biaxial drawing thereby eliminating a thermal shrinking strain generated at the thermal development. In a photothermographic material for medical use, the transparent support may be colored with a blue dye (for example, a dye 1 described in examples of JP-A No. 8-240877), or may be colorless. For the support, there is preferably applied an undercoating technology, e.g., with a water-soluble polyester described in JP-A No. 11-84574, a styrene-butadiene copolymer described in JP-A No. 10-186565, or a vinylidene chloride copolymer described in JP-A No. 2000-39684 and Japanese Patent Application No. 11-106881, paragraphs 0063–0080. At the coating of the emulsion layer or the back layer on the support, the support preferably has a water content of 0.5 mass % or less.

11) Other Additives

In the photothermographic material, there may be further added an antioxidant, a stabilizer, a plasticizer, an ultraviolet absorber or an auxiliary coating agent. These additives are added either in the photosensitive layer or in the non-photosensitive layer. For these, reference may be made for example to WO No. 98/36322, EP No. 803,764A1, JP-A Nos. 10-186567 and 10-18568.

12) Coating Method

The photothermographic material of the invention may be coated by any coating method. More specifically, various coating operation are applicable, including extrusion coating, slide coating, curtain coating, dip coating, knife coating, flow coating and extrusion coating utilizing a hopper of a kind described in U.S. Pat. No. 2,681,294, and there is preferably employed extrusion coating described in Stephen F. Kistler and Petert M. Schweizer, "Liquid Film Coating" (Chapman & Hall, 1997), pp.399–536, or slide coating, and particularly preferably slide coating. An example of a shape of a slide coater to be used in the slide coating is shown in FIG. 11*b*.1 in the above-mentioned reference, p.427. Also, if desired, two or more layers may be simultaneously applied by a method described in the above-mentioned reference, pp.399–536, or methods described in U.S. Pat. No. 2,761,791 and BP No. 837,095. A coating method particularly preferable in the invention is a method described in JP-A Nos. 2001-194748, 2002-153808, 2002-153803, and 2002-182333.

The coating liquid for the organic silver salt-containing layer of the invention is preferably so-called thixotropic fluid. For such technology, reference may be made to JP-A No. 11-52509. The coating liquid for the organic silver salt-containing layer of the invention preferably has a viscosity at a shear speed of 0.1 $S^{-1}$ within a range from 400 to 100,000 mPa·s, and more preferably 500 to 20,000 mPa·s. Also a viscosity at a shear speed of 1000 $S^{-1}$ is preferably within a range from 1 to 200 mPa·s, and more preferably 5 to 80 mPa·s.

In the preparation of the coating liquid of the invention, in case of mixing two liquids, there is preferably employed a known in-line mixer or an in-plant mixer. An in-line mixer and an in-plant mixer preferred in the invention are described respectively in JP-A Nos. 2002-85948 and 2002-90940.

The coating liquid of the invention is preferably subjected to a defoaming process in order to maintain a satisfactory coated surface. A deforming process preferable in the invention is described in JP-A No. 2002-66431.

In coating the coating liquid of the invention, a charge elimination is preferably executed in order to prevent deposition of dusts and particles by a charging of the support. An example of a charge eliminating method preferable in the invention is described in JP-A No. 2002-143747.

In the invention, in order to dry a non-settable coating liquid for the image forming layer, it is important to precisely control a drying air and a drying temperature. A drying method preferred in the invention is described in detail in JP-A Nos. 2001-194749 and 2002-139814.

In the photothermographic material of the invention, a heat treatment is preferably applied immediately after coating and drying, in order to improve a film forming property. The heat treatment is carried out at a film surface temperature preferably within a range of 60 to 100° C. and with a heating time of 1 to 60 seconds. More preferably, the film surface temperature is within a range of 70 to 90° C., and the heating time is within a range of 2 to 10 seconds. A method of heat treatment preferred in the invention is described in JP-A No. 2002-107872.

Also for continuous manufacture of the photothermographic material of the invention in stable manner, there is preferably employed a producing method described in JP-A Nos. 2002-156728 and 2002-182333.

The photothermographic material is preferably a monosheet type (capable of forming an image on the photothermographic material, without requiring another sheet such as an image receiving material).

13) Packaging Material

The photosensitive material of the invention is preferably packaged by a packaging material of a low oxygen permeation rate and/or a low moisture permeation rate, in order to avoid an alteration of the photographic performance during storage of an unprocessed stock, or to improve a curling or a bending. The oxygen permeation rate at 25° C. is preferably 50 ml/atm/$m^2$·day or less, more preferably 10 ml/atm/$m^2$·day or less, and further preferably 1.0 ml/atm/$m^2$·day or less. The moisture permeation rate is preferably 10 g/atm/$m^2$·day or less, more preferably 5 g/atm/$m^2$ day or less, and further preferably 1 g/atm/$m^2$·day or less.

Specific examples of the packaging material of a low oxygen permeation rate and/or a low moisture permeation rate include those described in JP-A Nos. 8-254793 and 2000-206653.

14) Other Applicable Technologies

In the photothermographic material of the invention, other technologies are also applicable, such as those described in EP No. 803,764A1, EP No. 883,022A1, WO No.98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099, 11-343420, 2000-187298, 2000-10229, 2000-47345, 2000-206642, 2000-98530, 2000-98531, 2000-112059, 2000-112060, 2000-112104, 2000-112064 and 2000-171936.

15) Color Image Formation

In a multi-color photothermographic material, the emulsion layers are maintained in a mutually separated manner, as described in U.S. Pat. No. 4,460,681, by employing a functional or non-functional barrier layer between the photosensitive layers.

In a multi-color photothermographic material, a combination of these two layers may be included for each color, or all the components may be included in a single layer as described in U.S. Pat. No. 4,708,928.

2. Image Forming Method

An image forming method for forming an image with an image recording apparatus of a first embodiment of the invention is characterized in that a distance between a scanning line of a laser irradiating means and an inserting portion of a thermal development unit is 50 cm or less. The scanning line means a position of scanning exposure in a direction perpendicular to a conveying direction, with a laser light from the laser irradiating means, based on image data.

(Image Recording Apparatus)

An image recording apparatus to be employed in the image forming method according to the first embodiment of the invention is constituted of a laser irradiating means for laser scanning based on image data thereby writing an image on a photothermographic material, a conveying means for guiding the photothermographic material in a sub-scanning direction to a thermal development unit for executing development by heating.

For assisting understanding, a specific example is shown in FIG. 1, however the image recording apparatus of the invention is not limited to a structure shown in FIG. 1.

A photothermographic material 11, while being conveyed by driving rollers 17A, 17B, is scanning-exposed in a direction perpendicular to the conveying direction by a laser light B based on image data, emitted from laser irradiating means 20. The exposed photothermographic material is conveyed continuously and is guided, through a guide unit 32, to a thermal development unit 34.

The thermal development unit 34 is constituted of three heating plates 40, a group of pressing rollers 42 for maintaining the photothermographic material in contact with the heating plates, and a casing 36 enclosing these components. After having passed the thermal development unit, the photothermographic material is discharged, then cooled to a stable temperature area through a cooling zone and is discharged from the apparatus.

In the invention, a distance between the laser irradiating unit and the thermal development unit corresponds, in the image recording apparatus 10 shown in FIG. 1, to a distance between a scanning exposure position 18 of the photothermographic material 11 and an inserting portion of the thermal development unit (meaning, in FIG. 1, an end face of the casing 36 where the photothermographic material is inserted), such a distance is 50 cm or less. In FIG. 1, there are shown a recording surface 11A of the photothermographic material, an exposure unit 12, a laser light B, a conveying unit 14, an upper guide plate 32A, a lower guide plate 32B, an inflated part 32C and a development unit 38.

The image forming method of the invention, utilizing the photothermographic material and maintaining the distance between the scanning line of the laser irradiating unit and the inserting portion of the thermal development unit at 50 cm or less, allows to make the image recording apparatus more compact.

The aforementioned distance is more preferably 45 cm or less, and further preferably 40 cm or less. The distance is not particularly restricted in a lower limit, and is preferably as short as possible in the designing of the apparatus. It is, however, not preferred that a guide plate 16 of the laser irradiating unit comes into a direct contact with the casing 36 or the heating plate 40 since the heat of the heating unit is transmitted to the laser irradiating unit.

The image forming method of the invention utilizing the aforementioned image forming apparatus exhibits preferable characteristics by combining with a thermal development device capable of rapid processing, as will be explained in the following.

(Exposure)

For the laser light, there may be utilized a He—Ne laser emitting red to infrared light, an $Ar^+$, He—Ne or He—Cd laser emitting blue to green light, or a semiconductor laser emitting blue light. A semiconductor laser emitting red to infrared light is preferable, and a peak wavelength of the laser light is 600 to 900 nm, preferably 620 to 850 nm. On the other hand, a laser output apparatus of a short wavelength region is recently attracting particular attention, with the development of an integrated module of an SHG (second harmonic generator) element and a semiconductor laser, and of a blue light-emitting semiconductor laser. Demand for the blue light-emitting semiconductor laser is anticipated to increase hereafter, since such laser is capable of recording a high-definition image, achieving an increase in the recording density and providing a stable output with a long service life. A peak wavelength of the blue laser light is 300 to 500 nm, preferably 400 to 500 nm.

A laser light oscillated in a vertical multi mode for example by a high frequency superposing method can also be employed advantageously.

(Thermal Development)

The photothermographic material of the invention may be developed in any method, however the development is usually executed by elevating the temperature of the photothermographic material which has been exposed imagewise. A developing temperature is arbitrarily selected, but preferably 80 to 250° C., more preferably 100 to 140° C., and further preferably 110 to 130° C.

A developing time is preferably 6 to 14 seconds, more preferably 7 to 13 seconds in consideration of productivity and stability of performance, and further preferably 8 to 12 seconds.

For thermal development of the photothermographic material, a drum heater or a plate heater may be employed, however a plate heater method is preferable. For thermal development with a plate heater method, there is preferred a method described in JP-A No. 11-133572 utilizing a thermal development apparatus which brings a photothermographic material containing a latent image in contact with heating means in a thermal development unit thereby obtaining a visible image, wherein the heating means is constituted by a plate heater, while plural pressing rollers are positioned along a surface of the plate heater, and the thermal development is carried out by passing the photothermographic material between the pressing rollers and the plate heater. It is preferable to divide the plate heater into 2 to 6 stages and to lower the temperature by 1 to 10° C. in a leading end stage. An example utilizes four sets of plate heaters which may be independently temperature controlled and which are respectively controlled at 112, 119, 121 and 120° C. Such method, described also in JP-A No. 54-30032., allows to eliminate moisture or organic solvent, contained in the photothermographic material, from the system, and to suppress a change in the shape of the support of the photothermographic material, resulting from a rapid heating thereof.

For making the thermal developing apparatus compact and reducing the thermal developing time, a stabler heater control is preferable, and it is also preferable to execute an exposure from a leading end of a photosensitive sheet and to initiate the thermal development before the exposure reaches a trailing end. An imager capable of a rapid process preferable for the invention is described for example in Japanese Patent Application Nos. 2001-088832 and 2001-091114. Such imager allows for example to execute a thermal development in 14 seconds with 3-stage plate heaters controlled at 107°-121°-121° C., and to shorten an output time of a first sheet to about 60 seconds. For such rapid processing, it is preferable to employ, in combination, the photothermographic material of the invention, having a high sensitivity and less susceptible to the atmospheric temperature.

Then, an image forming method according to a second embodiment of the invention is characterized in thermally developing the photothermographic material with an interval time of 12 seconds or less at a thermal development in a thermal developing device.

An image forming apparatus is generally constituted of a laser irradiating means for laser scanning based on image data to thereby write an image on a photothermographic material, a conveying means for guiding the photothermographic material in a sub-scanning direction to a thermal development unit, and a heat development unit for executing a development by heating. The thermal development unit includes a heater to constitute a heat supply source.

(Exposure)

A laser to be employed in the second embodiment of the invention is similar to that in the foregoing first embodiment.

(Thermal Development)

Figure 2:
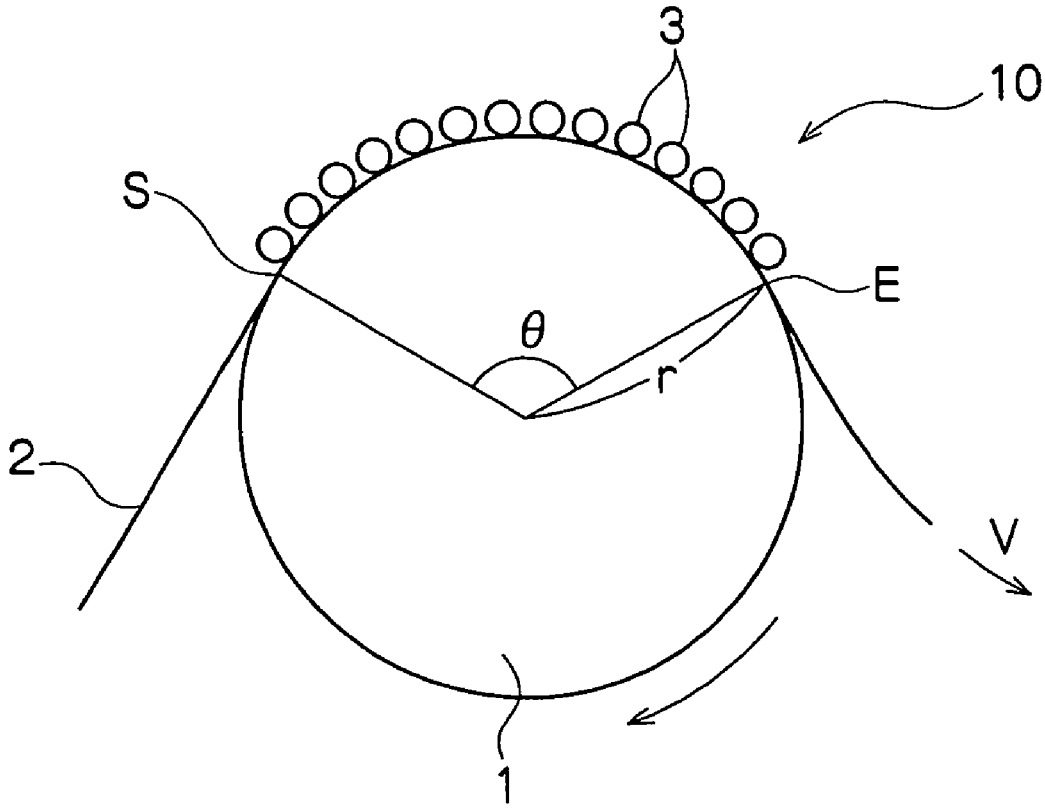
FIG. 2 is a conceptional view showing a heat drum unit in an image forming apparatus employed in an image forming method according to a second aspect of the invention.

A drum-shaped heater unit of an image forming apparatus, to be employed in the image forming method of the second embodiment of the invention, will be explained in detail by an example shown in FIG. 2. However, the invention is not limited to the structure shown in FIG. 2.

A photothermographic material 2 subjected to a laser exposure (not shown) is conveyed continuously between a guide roller 3 and a heat drum 1, together with a rotation of the heat drum 1 and with a linear speed v caused by the rotation of the heat drum 1, and is thermally developed within a range from a position S coming into contact with the heat drum 1 and a position E separating from the heat drum 1. After passing the thermal development unit, the photothermographic material 2 is discharged, then cooled to a stable temperature area through a cooling zone (not shown) and is discharged from the apparatus. In case of executing these steps at a high speed and processing photosensitive materials in succession, it is preferable to supply the photosensitive materials rapidly with a short interval. In FIG. 2, there are shown a heat drum unit 10, a position S where the photothermographic material comes into contact with the heat drum, a position E where the photothermographic material is separated from the heat drum, a radius r of the heat drum, a wrapping angle θ (radian), and a linear transporting speed v of the photothermographic material caused by the rotation of the heat drum.

The interval mentioned above is a time from the discharge of a photosensitive material from the drum heater of the thermal development unit to the start of thermal development of a next photothermographic material, and the interval time T in the invention is defined, more strictly, by a time from a separation of a first photosensitive material 2 from a certain portion (e.g., position S) of the drum heater 1 in the thermal development unit to a contact of a next photosensitive material 2 to the same heater portion (position S).

In case the photosensitive material need to be processed more rapidly, the photosensitive materials are supplied in succession so that the interval time T becomes shorter.

The interval time T depends on a linear speed v for thermally developing the photosensitive material and a processing interval, and, in case of a drum-shaped heater, also depends on a drum radius r and a wrapping angle θ (radian), thus involving complex control parameters.

The interval time may be calculated from the thermal development time, utilizing the aforementioned parameters.

In case the photosensitive material 2 is heat developed in contact with the heat drum 1 of a radius r, with a wrapping angle θ (radian), and is thereafter transported with a linear speed v caused by the rotation of the heat drum 1, the thermal development time is determined by a contact time from a position S where the photosensitive material 2 contacts the heat drum 1 to a separating position E, and is represented by rθ/v.

Therefore the interval time T, which is a time from a separation of the photosensitive material 2 at the position E to an arrival of the same portion of the heat drum to the position S and is represented by (2πr−rθ)/v.

By employing the photothermographic material of the invention and setting the interval time at 12 seconds or less, it is rendered possible to achieve a high-speed thermal development in continuation and to obtain an image satisfactory in image density and color tone stability.

The interval time is preferably 0.1 to 12 seconds, more preferably 0.5 to 10 seconds and particularly preferably 1 to 8 seconds.

The photothermographic material of the invention may be developed in any method, however it exhibits preferable characteristics by a combination with a thermal developing device capable of rapid processing as explained above.

A temperature of such thermal development may be selected arbitrarily, however a preferable developing temperature is 80 to 250° C., more preferably 100 to 140° C., and further preferably 110 to 130° C. A developing time is preferably 1 to 60 seconds, more preferably 3 to 25 seconds, further preferably 5 to 16 seconds and particularly preferably 6 to 12 seconds.

For thermal development, a drum heater or a plate heater may be employed, however a drum heater is preferable in exhibiting features of the photosensitive material of the invention.

In case of a drum heater, a contact of the photosensitive material with the heat source causes a local temperature decrease in a portion of the drum where the photosensitive material is in contact. An influence of the local temperature decrease becomes larger in a thermal development with the interval mentioned above. For such rapid processing, it is preferable to employ, in combination, the photothermographic material of the invention, having a high sensitivity and less susceptible to the atmospheric temperature.

A silver salt in the coated film of a photothermographic material is reduced, at the thermal development, to metallic silver by a reducing agent, thereby forming an image. An efficiency of utilization of silver in the image is generally called a silver development rate.

In the invention, a silver development rate is defined by B/A×100, in which A indicates a number of moles total silver (sum of organic silver salt and silver halide) per unit area of the photothermographic material, and B indicates a number of moles of silver, reduced by the thermal development, per unit area.

For determining the silver development rate, at first a number B of moles of the reduced silver. A photothermographic material subjected to an exposure and a development so as to obtain a maximum density is immersed for 1 hour in 10 mass % methanol solution of 2,2'-(ethylenedithio) diethanol to fix organic silver salt and photosensitive silver halide in an undeveloped state. Then it is washed with methanol solution and dried. It is subjected to a measurement of silver amount per unit area, by an X-ray fluorometry. It may be determined from a calibration line obtained from a sample of a known silver coating amount. Then a number A of moles of total silver in the photothermographic material may be determined by measuring a total silver coating amount utilizing an undeveloped photothermographic material by means of X-ray fluorometry.

The photothermographic material of the invention preferably has a silver development rate at a maximum density (Dmax) of 70% or higher, preferably 80% or higher.

A higher silver development rate is preferable because an efficiency of utilization of the organic silver salt becomes higher and a higher maximum density may be obtained with a smaller amount of the organic silver salt. Investigation of the present inventors on the silver development rate has clarified that a part of the organic silver salt is converted into silver halide by the organic polyhalogen compound and that the silver development rate may be increased by a sufficient development but optimum photographic properties (e.g., a fog, an image color tone, a gradation etc.) may be obtained with a thermal developing condition of a lower silver development rate. Consequently, it has been a constant and fundamental issue in designing a photothermographic material, to increase the silver development rate while maintaining other properties of the photothermographic material such as a storability, photographic characteristics, a rapid processability etc.

Among the photographic characteristics, an image color tone is highly dependent on the silver development rate and it has not been easy to obtain a high development rate while obtaining an optimum color tone of the developed silver.

The image color tone may be evaluated by a subjective evaluation, however it is determined quantitatively by a color hue angle $h_{ab}$ defined in JIS Z8729. The hue angle $h_{ab}$ may be represented by $h_{ab}=\tan^{-1}(b^*/a^*)$, based on a XYZ color representation system or three stimulation values X, Y, Z or X10, Y10, Z10 defined in JIS Z8701 and utilizing color coordinates a*, b* of an L*a*b* color representation system defined in JIS Z8729.

In the invention, a hue angle was measured on a sample which was so exposed and developed as to provide an optical density of 1.0. The hue angle is preferably 180° to 270°.

Formulas (R1) and (R2) for the reducing agent of the invention were effective for efficiently increasing the silver development rate and obtaining a preferable image color tone.

3) System

Examples of a laser imager system for medical use, having an exposure unit and a thermal development unit, are Fuji Medical Dry Laser Imager FM-DPL and DRYPIX 7000. The FM-DPL is described in Fuji Medical Review No. 8, p.39–55, and such described technology is naturally applicable as a laser imager for the photothermographic material of the invention. Also it may be utilized as a photothermographic material for a laser imager in an AD Network, proposed by Fuji Film Medical Co. as a network system meeting the DICOM standard.

3. Application of Invention

The photothermographic material of the invention forms a black-and-white image by a silver image, and is preferably utilized as a photothermographic material for medical diagnosis, a photothermographic material for industrial photography, a photothermographic material for printing and a photothermographic material for COM (computer output microfilm).

EXAMPLES

The present invention will now be further described with reference to the following examples, but the invention is not limited to the examples.

Example 1

(Preparation of PET Support)

1) Film Formation

From terephthalic acid and ethylene glycol, PET was produced in an ordinary manner. PET thus produced had an intrinsic viscosity, IV, of 0.66, as measured in a phenol/tetrachloroethane ratio (6/4 by mass) at 25° C. After pelletized, the PET was dried at 130° C. for 4 hours, and melted at 300° C., followed by extrusion through a T-die. After rapid cooling, a non-oriented film was obtained which had a thickness of 175 μm after thermal fixation.

The resultant film was stretched 3.3 times in MD (machine direction) using a roll at different rotating speeds, then stretched 4.5 times in CD (cross direction) using a tenter. The temperatures for MD and CD stretchings were 110° C. and 130° C., respectively. Then, the film was thermally fixed at 240° C. for 20 seconds, and relaxed by 4% in CD at the same temperature. Subsequently, the chuck of the tenter was released, the both edges of the film was knurled, and the film was rolled up under 4 kg/cm$^2$ to give a rolled film having a thickness of 175 μm.

2) Corona Discharge Surface Treatment

Both surfaces of the support were subjected to corona discharge treatment at room temperature at a speed of 20 m/min, using a solid-state corona discharge system MODEL 6KVA manufactured by Pillar Technologies. From the data of the current and the voltage read from the system, the support was found to be processed at 0.375 kV·A·min/m$^2$. The frequency for the treatment was 9.6 kHz, and the gap clearance between an electrode and a dielectric roll was 1.6 mm.

3) Undercoating

| 1) Preparation of coating liquid for undercoat layer | |
|---|---|
| Formulaion (1) (for undercoat layer at a side provided with photosensitive layer) | |
| Pesresin A-520 (30 mass % solution) (manufactured by Takamatsu Yushi Co.) | 59 g |
| polyethylene glycol monononylphenyl ether (average number of ethylene oxide = 8.5), 10 mass % solution | 5.4 g |
| MP-1000 (polymer fine particles, average particle size 0.4 μm) (manufactured by Soken Kagaku Co.) | 0.91 g |
| distilled water | 935 ml |
| Formulation (2) (for first layer on back side) | |
| styrene-butadiene copolymer latex (solid 40 mass %, styrene/butadiene mass ratio = 68/32) | 158 g |
| 2,4-dichloro-6-hydroxy-S-triazine sodium salt, 8 mass % aqueous solution | 20 g |
| sodium laurylbenzenesulfonate, 1 mass % aqueous solution | 10 ml |
| distilled water | 854 ml |
| Formulation (3) (for second layer on back side) | |
| $SnO_2$/SbO (mass ratio 9/1, average particle size 0.038 μm, 17 mass % dispersion) | 84 g |
| gelatin (10 mass % aqueous solution) | 89.2 g |
| Metolose TC-5 (2 mass % aqueous solution) (manufactured by Shin-etsu Chemical Ltd.) | 8.6 g |
| MP-1000 (manufactured by Soken Chemical Co.) | 0.01 g |
| sodium dodecylbenzenesulfonate, 1 mass % aqueous solution | 10 ml |
| NaOH (1 mass %) | 6 ml |
| Proxel (manufactured by ICI Ltd.) | 1 ml |
| distilled water | 805 ml |

2) Undercoating

The aforementioned biaxially drawn polyethylene terephthalate support of a thickness of 175 μm was subjected, on both sides thereof, to the aforementioned corona discharge treatment, then the aforementioned undercoating formulation (1) was coated on a side (at the side of the photosensitive layer) by a wire bar with a wet coating amount of 6.6 ml/m$^2$ (per one side) and dried for 5 minutes at 180° C. Then the aforementioned undercoating formulation (2) was coated on a rear side (back surface) by a wire bar with a wet coating amount of 5.7 ml/m$^2$ and dried for 5 minutes at 180° C., and the aforementioned undercoating formulation (3) was coated on the rear side (back surface) by a wire bar with a wet coating amount of 7.7 ml/m$^2$ and dried for 6 minutes at 180° C. to obtain an undercoated support.

(Back layer)

1) Preparation of Coating Liquid for Back Layer (Preparation of Solid Fine Particle Dispersion (a) of Base Precursor)

2.5 kg of a base precursor-1,300 g of a surfactant (trade name: Demol N, manufactured by Kao Corp.), 800 g of diphenylsulfon, 1.0 g of sodium benzoisothiazolinone and distilled water to make a total amount of 8.0 kg were mixed, and the mixture was bead-dispersed in a horizontal sand mill (UVM-2; manufactured by Imex Co.). The dispersion was executed by feeding the mixture with a diaphragm pump to UVM-2 filled with zirconia beads of an average diameter of 0.5 mm, and executed with an internal pressure of 50 hPa or higher, until a desired average particle size was obtained.

The dispersion was subjected to a measurement of spectral absorption and was dispersed until a ratio of an absorbance at 450 nm and an absorbance at 650 nm (D450/D650) in the spectral absorption of the dispersion has become 3.0. The obtained dispersion was diluted with distilled water to a concentration of the base precursor of 25 mass % and was used after a filtration (with a polypropylene filter of an average pore size of 3.0 μm), for eliminating dusts.

2) Preparation of Dye Solid Fine Particle Dispersion 6.0 kg of a cyanine dye compound-1, 3.0 kg of sodium p-dodecylbenzenesulfonate, 0.6 kg of a surfactant (trade name: Demol SNB, manufactured by Kao Corp.), and 0.15 kg of a defoaming agent (trade name: Surfinol 104E, manufactured by Nisshin Chemical Co.) were mixed with distilled water to make a total amount of 60 kg. The mixture was dispersed in a horizontal sand mill (UVM-2; manufactured by Imex Co.), utilizing zirconia beads of 0.5 mm.

The dispersion was subjected to a measurement of spectral absorption and was dispersed until a ratio of an absorbance at 650 nm and an absorbance at 750 nm (D650/D750) in the spectral absorption of the dispersion became 5.0 or higher. The obtained dispersion was diluted with distilled water to a concentration of the cyanine dye of 6 mass % and was used after a filtration (with a filter of an average pore size of 1 μm), for eliminating dusts.

3) Preparation of Coating Liquid for Antihalation Layer

In a container maintained at 40° C., 40 g of gelatin, 20 g of mono-dispersed polymethyl methacrylate fine particles (average particle size 8 μm, a standard deviation of particle size 0.4), 0.1 g of benzoisothiazolinone, and 490 ml of water were added to dissolve gelatin. Then 2.3 ml of a 1 mol/l aqueous solution of sodium hydroxide, 40 g of the dye solid fine particle dispersion, 90 g of the base precursor solid fine particle dispersion (a), 12 ml of a 3 mass % aqueous solution of sodium polystyrenesulfonate, and 180 g of a 10 mass % SBR latex liquid were mixed. 80 ml of a 4 mass % aqueous solution of N,N-ethylenebis(vinylsulfonacetamide) were mixed immediately before coating, to obtain a coating liquid for the antihalation layer.

4) Preparation of Coating Liquid for Back Protective Layer

In a container maintained at 40° C., 40 g of gelatin, 35 mg of benzoisothiazolinone and 840 ml of water were added to dissolve gelatin. Then 5.8 ml of 1 mol/l aqueous solution of sodium hydroxide, 1.5 g of liquid paraffin in a liquid paraffin emulsion, 10 ml of a 5 mass % aqueous solution of sodium di(2-ethylhexyl)sulfosuccinate, 20 ml of a 3 mass % aqueous solution of sodium polystyrenesulfonate, 2.4 ml of a 2 mass % solution of a fluorine-type surfacant (F-1), 2.4 ml of a 2 mass % solution of a fluorine-type surfacant (F-2), and 32 g of a 19 mass % solution of a methyl methacrylate/styrene/butyl acrylate/hydroxyethyl methacrylate/acrylic acid copolymer (copolymerization mass ratio 57/8/28/5/2) were mixed. 25 ml of a 4 mass % aqueous solution of N,N-ethylenebis(vinylsulfonacetamide) were mixed immediately before coating, to obtain a coating liquid for the back protective layer.

4) Coating of Back Layer

On the back surface of the aforementioned undercoated support, the coating liquid for the antihalation layer and the coating liquid for the back protective layer were simultaneously coated in superposed layers with respective gelatin coating amounts of 0.52 and 1.7 g/m$^2$ and dried to obtain a back layer.

(Image Forming Layer, Intermediate Layer and Surface Protective Layer)

1. Preparation of Coating Materials

1) Silver Halide Emulsion

<<Preparation of Silver Halide Emulsion 1>>

A solution, obtained by adding 3.1 ml of a 1 mass % solution of potassium bromide, 3.5 ml of sulfuric acid of a concentration of 0.5 mol/L and 31.7 g of phthalated gelatin to 1421 ml of distilled water, was maintained at 30° C. under agitation in a stainless steel reaction pot, and a solution A formed by diluting 22.22 g of silver nitrate in distilled water to an amount of 95.4 ml and a solution B formed by diluting 15.3 g of potassium bromide and 0.8 g of potassium iodide in distilled water to an amount of 97.4 ml were added in entire amounts under constant flow rates and over a period of 45 seconds. Then 10 ml of a 3.5 mass % aqueous solution of hydrogen peroxide were added, and 10.8 ml of a 10 mass % aqueous solution of benzimidazole were added. Then, a solution C formed by diluting 51.86 g of silver nitrate in distilled water to an amount of 317.5 ml and a solution D formed by diluting 44.2 g of potassium bromide and 2.2 g of potassium iodide in distilled water to an amount of 400 ml were added in such a manner that the solution C was added in the entire amount under a constant flow rate and over a period of 20 minutes, while the solution D was added in a controlled double jet method under a constant pAg value of 8.1. At 10 minutes after the start of addition of the solutions C and D, potassium hexachloroiridate (III) was added in entire amounts in such an amount of $1\times10^{-4}$ moles per 1 mole of silver. Also at 5 seconds after the end of addition of the solution C, an aqueous solution of potassium hexacyanoferrate (II) was added in such an amount of $3\times10^{-4}$ moles per 1 mole of silver. Then pH value was adjusted to 3.8 with sulfuric acid of a concentration of 0.5 mol/L. Then the agitation was terminated and precipitation/desalting/rinsing steps were executed. The pH value was adjusted to 5.9 with sodium hydroxide of a concentration of 1 mol/L, thereby obtaining a silver halide dispersion of a pAg value of 8.0.

The aforementioned silver halide dispersion was maintained at 38° C. under agitation, then added with 5 ml of a 0.34 mass % methanol solution of 1,2-benzoisothiazolin-3-one, and heated to 47° C. after 40 minutes. At 20 minutes after the temperature elevation, sodium benzenethiosulfonate in a methanol solution was added in an amount of $7.6\times10^{-5}$ moles per 1 mole of silver, then after further 5 minutes, a tellurium sensitizer C in a methanol solution was added in an amount of $2.9\times10^{-4}$ moles with respect to 1 mole of silver, and a ripening was executed for 91 minutes. Then a methanol solution of a spectral sensitizing dye A and a sensitizing dye B in a molar ratio 3:1 was added in an amount $1.2\times10^{-3}$ moles in a total of the sensitizing dyes A and B per 1 mole of silver, and, after 1 minute, 1.3 ml of a 0.8 mass % methanol solution of N,N'-dihydroxy-N",N"-diethylmelamine were added, and, after further 4 minutes, 5-methyl-2-mercaptobenzimidazole in a methanol solution in an amount of $4.8\times10^{-3}$ moles with respect to 1 mole of silver, 1-phenyl-2-heptyl-5-mercapto-1,3,4-triazole in a methanol solution in an mount of $5.4\times10^{-3}$ moles with respect to 1 mole of silver, and 1-(3-methylureidephenyl)-5-mercaptotetrazole in an aqueous solution in an amount of $8.5\times10^{-3}$ moles with respect to 1 mole of silver, were added to prepare a silver halide emulsion 1.

Thus prepared silver halide emulsion contained silver iodobromide grains having an average sphere-corresponding diameter of 0.042 μm and a variation factor of the sphere-corresponding diameter of 20% and uniformly containing iodine in 3.5 mol %. The grain size etc. were determined by averaging 1000 grains, utilizing an electron microscope. A [100] plane ratio of the grains was determined by Kubelka-Munk method as 80%.

<<Preparation of Silver Halide Emulsion 2>>

A silver halide emulsion 2 was prepared in the same manner as the emulsion 1, except that the liquid temperature at the grain formation was changed from 30° C. to 47° C., that the solution B was formed by diluting 15.9 g of potassium bromide with distilled water to a volume of 97.4 ml, the solution D was formed by diluting 45.8 g of potassium bromide with distilled water to a volume of 400 ml, the addition time of the solution C was changed to 30 minutes and potassium hexacyanoferrate (II) was eliminated. Steps of precipitation/desalting/rinsing/dispersion were executed in a similar manner as in the silver halide emulsion 1. Also spectral sensitization, chemical sensitization and additions of 5-methyl-2-mercaptobenzimidazole, and 1-phenyl-2-heptyl-5-mercapto-1,3,4-triazole were executed in a similar manner as in the silver halide emulsion 1 except that the amount of the tellurium sensitizer C was changed to $1.1\times10^{-4}$ moles per 1 mole of silver, the amount of the methanol solution of the spectral sensitizing dyes A and B in a molar ratio 3:1 was changed to $7.0\times10^{-4}$ moles in a total of the sensitizing dyes A and B per 1 mole of silver, the amount of 1-phenyl-2-heptyl-5-mercapto-1,3,4-triazole was changed to $3.3\times10^{-3}$ moles per 1 mole of silver and the amount of 1-(3-methylureidophenyl)-5-mercaptotetrazole to $4.7\times10^{-3}$ moles per 1 mole of silver, to obtain a silver halide emulsion 2. The silver halide emulsion 2 contained pure silver bromide cubic grains having an average sphere-corresponding diameter of 0.080 μm and a variation factor of the sphere-corresponding diameter of 20%.

<<Preparation of Silver Halide Emulsion 3>>

A silver halide emulsion 3 was prepared in the same manner as the emulsion 1, except that the liquid temperature at the grain formation was changed from 30° C. to 27° C. Steps of precipitation/desalting/rinsing/dispersion were executed in a similar manner as in the silver halide emulsion 1. A silver halide emulsion 3 was obtained in the same manner as in the emulsion 1, except that the spectral sensitizing dyes A and B were added in a in a solid dispersion (aqueous gelatin solution) of a molar ratio 1:1 and in $6\times10^{-3}$ moles in a total of the sensitizing dyes A and B per 1 mole of silver, the amount of the tellurium sensitizer C was changed to $5.2\times10^{-4}$ moles per 1 mole of silver, and bromoauric acid in $5\times10^{-4}$ moles per 1 mole of silver and potassium thiocyanate in $2\times10^{-3}$ moles per 1 mole of silver were added 3 minutes after the addition of the tellurium sensitizer. The silver halide emulsion 3 contained silver iodobromide grains containing iodine uniformly in 3.5 mol % and having an average sphere-corresponding diameter of 0.034 μm and a variation factor of the sphere-corresponding diameter of 20%.

<<Preparation of Mixed Emulsion A for Coating Liquid>>

The silver halide emulsion 1 by 70 mass %, the silver halide emulsion 2 by 15 mass % and the silver halide emulsion 3 by 15 mass % were dissolved, and benzothiazolium iodide in a 1 mass % aqueous solution was added in an amount of $7\times10^{-3}$ moles per 1 mole of silver. Then water was added so as to obtain a silver halide content corresponding to 38.2 g of silver per 1 kg of mixed emulsion for the coating liquid, and 1-(3-methyureidophenyl)-5-mercapto-1,3,4-triazole was added in such an amount of 0.34 g per 1 kg of the mixed emulsion for the coating liquid.

Also, as "the compound of which 1-electron oxidized member, formed by 1-electron oxidation, can release 1 or more electrons", each of the compounds 1, 20 and 26 were added in an amount of $2\times10^{-3}$ moles per 1 mole of silver in silver halide.

2) Fatty Acid Silver Salt Dispersion 87.6 kg of behenic acid (trade name: Edenor C22-85R, manufactured by Henkel Co.), 423 L of distilled water, 49.2 L of a aqueous solution of NaOH of a concentration of 5 mol/L, and 120 L of t-butyl alcohol were mixed and reacted for 1 hour at 75° C. under agitation to obtain a sodium behenate solution A. Separately, 206.2 L of an aqueous solution (pH 4.0) of 40.4 kg of silver nitrate were prepared and maintained at 10° C. A reaction vessel containing 635 L of distilled water and 30 L of t-butyl alcohol was maintained at 30° C., and the entire amount of the sodium behenate solution A and the entire amount of the silver nitrate solution were added under sufficient agitation with constant flow rates, respectively over 93 minutes and 15 seconds and over 90 minutes. In this operation, during 11 minutes from the start of the addition of the silver nitrate solution, the silver nitrate solution alone was added, then the addition of the sodium behenate solution A was started, and, during 14 minutes and 15 seconds after the end of addition of the silver nitrate solution, the sodium behenate solution A alone was added. In this operation, the temperature in the reaction vessel was maintained at 30° C., and the external temperature was so controlled as to maintain a constant liquid temperature. Also a piping for adding the sodium behenate solution A was temperature controlled by circulating warm water in an outer jacket of double tubes, thereby adjusting the liquid temperature at an exit end of the addition nozzle at 75° C. Also a piping for adding the silver nitrate solution was temperature controlled by circulating cold water in an outer jacket of double tubes. A position of addition of the sodium behenate solution A and a position of addition of the silver nitrate solution were symmetrically positioned with respect to an agitating shaft, and were adjusted at such a height not touching the reaction liquid.

After the end of addition of the sodium behenate solution A, the reaction liquid was let to stand for 20 minutes at a same temperature and under agitation, then heated to 35° C. over a period of 30 minutes, and was thereafter ripened for 210 minutes. Immediately after the end of the ripening, solid was separated by a centrifuged filtration and was washed with water until the conductivity of filtered water reached 30 μS/cm. A fatty acid silver salt was obtained in this manner. The obtained solid was not dried but stored in a wet cake.

A shape of the obtained silver behanate grains was evaluated by electron photomicrographs. There were identified flake-shaped crystals with average values a=0.14 μm, b=0.4 μm and c=0.6 μm, an average aspect ratio of 5.2, a sphere-corresponding diameter of 0.52 μm and a variation factor of the sphere-corresponding diameter of 15% (a, b and c are defined as supra).

To the wet cake corresponding to 260 kg of dry solid, 19.3 kg of polyvinyl alcohol (trade name: PVA-217) and water were added to a total amount of 1000 kg, then the mixture was made in a slurry by fins of a dissolver and further pre-dispersed by a pipeline mixer (model PM-10; manufactured by Mizuho Kogyo Co.).

Then the pre-dispersed liquid was treated three times in a disperser (trade name: Microfluidizer M-610, manufactured by Microfluidics International Corporation; with a Z-type interaction chamber) with a pressure adjusted to 1260 kg/cm$^2$, thereby obtaining a silver behenate dispersion (fatty acid silver salt dispersion). A cooling operation was carried out under a dispersion temperature of 18° C. by mounting spiral-piped heat exchangers in front of and behind the interaction chamber and regulating the temperature of a coolant.

3) Preparation of Reducing Agent Dispersions 1–3

<<Preparation of Reducing Agent-1 Dispersion>>

10 kg of a comparative reducing agent-1 (6,6'-di-t-butyl-4,4'-dimethyl-2,2'-butylidenediphenol), 16 kg of a 10 mass % aqueous solution of denatured polyvinyl alcohol (Poval MP203, manufactured by Kuraray Co.), and 10 kg of water were added and mixed well to obtain a slurry. The slurry was fed by a diaphragm pump, then dispersed for 3 hours and 30 minutes in a horizontal sand mill (UVM-2; manufactured by Imex Co.) filled with zirconia beads of an average diameter of 0.5 mm, and 0.2 g of sodium benzoisothiazolinone and water were added to obtain a concentration of the reducing agent of 25 mass %. The dispersion was heated for 1 hour at 40° C., then for 1 hour at 80° C. to obtain a reducing agent-1 dispersion. The reducing agent particles contained in thus obtained reducing agent dispersion had a median diameter of 0.5 μm and a maximum particle size of 1.6 μm or less. The obtained reducing agent dispersion was stored after a filtration with a polypropylene filter of a pore size of 3.0 μm, for eliminating foreign substances such as dusts.

<<Preparation of Reducing Agent-2 Dispersion>>

Preparation was executed in the same manner as the reducing agent-1 dispersion except that the reducing agent-1 (6,6'-di-t-butyl-4,4'-dimethyl-2,2'-butylidene-diphenol) was replaced by a reducing agent R1-1 of the invention.

<<Preparation of Reducing Agent-3 Dispersion>>

Preparation was executed in the same manner as the reducing agent-1 dispersion except that the reducing agent-1 (6,6'-di-t-butyl-4,4'-dimethyl-2,2'-butylidene-diphenol) was replaced by a reducing agent R2-1 of the invention.

4) Preparation of Hydrogen Bond-forming Compound-1 Dispersion 10 kg of a hydrogen bond-forming compound-1 (tri(4-t-butylphenyl)phosphinoxide), 16 kg of a 10 mass % aqueous solution of denatured polyvinyl alcohol (Poval MP203, manufactured by Kuraray Co.), and 10 kg of water were added and mixed well to obtain a slurry. The slurry was fed by a diaphragm pump, then dispersed for 4 hours in a horizontal sand mill (UVM-2; manufactured by Imex Co.) filled with zirconia beads of an average diameter of 0.5 mm, and 0.2 g of sodium benzoisothiazolinone and water were added to obtain a concentration of the hydrogen bond-forming compound of 25 mass %. The dispersion was heated for a 1 hour at 40° C. and subsequently for 1 hour at 80° C. to obtain a hydrogen bond-forming compound-1 dispersion. The particles of the hydrogen bond-forming compound contained in thus obtained hydrogen bond-forming compound dispersion had a median diameter of 0.45 μm and a maximum particle size of 1.3 μm or less. The obtained hydrogen bond-forming compound dispersion was stored after a filtration with a polypropylene filter of a pore size of 3.0 μm, for eliminating foreign substances such as dusts.

5) Preparation of Development Accelerator-1 Dispersion 10 kg of a development accelerator-1, 20 kg of a 10 mass % aqueous solution of denatured polyvinyl alcohol (Poval MP203, manufactured by Kuraray Co.), and 10 kg of water were added and mixed well to obtain a slurry. The slurry was fed by a diaphragm pump, then dispersed for 3 hours and 30 minutes in a horizontal sand mill (UVM-2; manufactured by Imex Co.) filled with zirconia beads of an average diameter of 0.5 mm, and 0.2 g of sodium benzoisothiazolinone and water were added to obtain a concentration of the development accelerator of 20 mass % thereby obtaining a development accelerator-1 dispersion. The particles of the development accelerator contained in thus obtained development accelerator dispersion had a median diameter of 0.48 μm and a maximum particle size of 1.4 μm or less. The obtained development accelerator dispersion was stored after a filtration with a polypropylene filter of a pore size of 3.0 μm, for eliminating foreign substances such as dusts.

6) Preparation of Polyhalogen Compound Dispersion

<<Preparation of Organic Polyhalogen Compound-1 Dispersion>>

10 kg of an organic polyhalogen compound-1 (tribromomethanesulfonylbenzene), 10 kg of a 20 mass % aqueous solution of denatured polyvinyl alcohol (Poval MP203, manufactured by Kuraray Co.), 0.4 kg of a 20 mass % aqueous solution of sodium triisopropylnaphthalene-sulfonate and 14 kg of water were added and mixed well to obtain a slurry. The slurry was fed by a diaphragm pump, then dispersed for 5 hours in a horizontal sand mill (UVM-2; manufactured by Imex Co.) filled with zirconia beads of an average diameter of 0.5 mm, and 0.2 g of sodium benzoisothiazolinone and water were added to obtain a concentration of the organic polyhalogen compound of 26 mass % thereby obtaining an organic polyhalogen compound-1 dispersion. The particles of the organic polyhalogen compound contained in thus obtained organic polyhalogen compound dispersion had a median diameter of 0.41 μm and a maximum particle size of 2.0 μm or less. The obtained organic polyhalogen compound dispersion was stored after a filtration with a polypropylene filter of a pore size of 10.0 μm, for eliminating foreign substances such as dusts.

<<Preparation of Organic Polyhalogen Compound-2 Dispersion>>

10 kg of an organic polyhalogen compound-2 (N-butyl-3-tribromomethanesulfonylbenzamide), 20 kg of a 10 mass % aqueous solution of denatured polyvinyl alcohol (Poval MP203, manufactured by Kuraray Co.) and 0.4 kg of a 20 mass % aqueous solution of sodium triisopropylnaphthalenesulfonate were added and mixed well to obtain a slurry. The slurry was fed by a diaphragm pump, then dispersed for 5 hours in a horizontal sand mill (UVM-2; manufactured by Imex Co.) filled with zirconia beads of an average diameter of 0.5 mm, and 0.2 g of sodium benzoisothiazolinone and water were added to obtain a concentration of the organic polyhalogen compound of 30 mass %. The dispersion was heated for 5 hours at 40° C. to obtain an organic polyhalogen compound-2 dispersion. The particles of the organic polyhalogen compound contained in thus obtained organic polyhalogen compound dispersion had a median diameter of 0.40 μm and a maximum particle size of 1.3 μm or less. The obtained organic polyhalogen compound dispersion was stored after a filtration with a polypropylene filter of a pore size of 3.0 μm, for eliminating foreign substances such as dusts.

7) Preparation of Phthalazine Compound-1 Solution 8 kg of denatured polyvinyl alcohol (MP203, manufactured by Kuraray Co.) were dissolved in 174.57 kg of water, and 3.15 kg of a 20 mass % aqueous solution of sodium triisopropylnaphthalenesulfonate and 14.28 kg of a 70 mass % aqueous solution of phthalazine compound-1 (6-isopropylphthalazine) were added to obtain a 5 mass % solution of the phthalazine compound-1.

8) Preparation of a Mercapto Compound

<<Preparation of Aqueous Solution of a Mercapto Compound-1>>

7 g of a mercapto compound-1 (1-(3-sulfophenyl)-5-mercaptotetrazole sodium salt) were dissolved in 993 g of water to obtain a 0.7 mass % aqueous solution.

<<Preparation of Aqueous Solution of a Mercapto Compound-2>>

20 g of a mercapto compound-2 (1-(3-methylureidophenyl)-5-mercaptotetrazole) were dissolved in 980 g of water to obtain a 2.0 mass % aqueous solution.

9) Preparation of Pigment-1 Dispersion 64 g of C.I. Pigment blue 60, 6.4 g of Demol N (manufactured by Kao Corp.) and 250 g of water were added and mixed well to obtain a slurry. The slurry was placed in a vessel together with 800 of zirconia beads of an average diameter of 0.5 mm, then dispersed for 25 hours in a disperser (1/4G sand grinder mill, manufactured by Imex Co.) and water was added to obtain a concentration of the pigment of 5 mass %, thereby obtaining a pigment-1 dispersion. The pigment particles contained in thus obtained pigment dispersion had an average particle size of 0.21 μm.

10) Preparation of SBR Latex Liquid

An SBR latex was prepared in the following manner.

In a polymerization vessel of a gas monomer reaction apparatus (model TAS-2J, manufactured by Taiatsu Glass Kogyo Co.), 287 g of distilled water, 7.73 g of a surfactant (Pionin A-43-S (manufactured by Takemono Yushi Co.), solid content 48.5 mass %), 14.06 ml of 1 mol/L NaOH, 0.15 g of tetrasodium ethylenediamine-tetraacetate, 255 g of styrene, 11.25 g of acrylic acid and 3.0 g of tert-dodecylmercaptane were charged, then the reaction vessel was tightly closed, and agitation was executed with an agitating speed of 200 rpm. After a degassing with a vacuum pump and a replacement with nitrogen gas were repeated several times, 108.75 g of 1,3-butadiene were pressed in and an internal temperature was elevated to 60° C. Then a solution of 1.875 g of ammonium persulfate in 50 ml of water was added, and the agitation was continued for 5 hours. Then the temperature was further raised to 90° C. and the agitation was continued for 3 hours, and, after the completion of reaction, the internal temperature was lowered to the room temperature, and NaOH and $NH_4OH$ of a concentration of 1 mol/L were so added as to obtain $Na^+$ ion:$NH_4^+$ ion=1:5.3 (molar ratio) and to obtain a pH value of 8.4. Then a filtration was executed with a polypropylene filter of a pore size of 1.0 μm for eliminating foreign substances such as dusts and the filtrate is stored, thereby obtaining 774.7 g of SBR latex. A halogen ion measurement with an ion chromatography provided a chloride ion concentration of 3 ppm. Also a measurement with a high speed liquid chromatography provided a chelating agent concentration of 145 ppm.

The latex had an average particle size of 90 nm, Tg=17° C., a solid concentration of 44 mass %, an equilibrated water content at 25° C. and 60% RH of 0.6 mass %, an ion conductivity of 4.80 mS/cm (measured with a conductometer CM-30S manufactured by To a Dempa Kogyo Co., and at 25° C. on original latex stock (44 mass %)).

2. Preparation of Coating Liquid

1) Preparation of Coating Liquid-1 to -3 for Image Forming Layer 1000 g of the aforementioned fatty acid silver salt dispersion, 135 ml of water, 35 g of the pigment-1 dispersion, 16 g of the organic polyhalogen compound-1 dispersion, 35 g of the organic polyhalogen compound-2 dispersion, 162 g of the phthalazine-1 compound solution, 1060 g of the SBR latex liquid (Tg: 17° C.), 150 g of the reducing agent-1 to -3 dispersion (as shown in Table 1), 106 g of the hydrogen bond-forming compound-1 dispersion, 9.6 g of the development accelerator-1 dispersion, 9 ml of the mercapto compound-I aqueous solution, and 27 ml of the mercapto compound-2 aqueous solution were added in succession, and 118 g of the mixed emulsion A for the coating liquid were added and mixed well immediately before coating to obtain a coating liquid for image forming layer, which was fed to a coating die.

A zirconium amount in the coating liquid was 0.32 mg per 1 g of silver.

2) Preparation of Intermediate Layer Coating Liquid 1000 g of polyvinyl alcohol PVA-205 (manufactured by Kuraray Co.), 163 g of the pigment-1 dispersion, 33 g of an aqueous solution of a blue dye compound-1 (Kayafect Turquois RN liquid 150, manufactured by Nippon Kayaku Co.), 27 ml of a 5 mass % aqueous solution of sodium di(2-ethylhexyl)sulfosuccinate, 4200 ml of a 19 mass % latex liquid of methyl methacrylate/styrene/butyl acrylate/hydroxyethyl methacrylate/acrylic acid copolymer (copolymerizing mass ratio: 64/9/20/5/2), 27 ml of a 5 mass % aqueous solution of Aerosol OT (manufactured by American Cyanamide Inc.), 135 ml of a 20 mass % aqueous solution of diammonium phthalate, and water to make a total amount of 10000 g were added and the pH was adjusted to 7.5 with NaOH to obtain an intermediate layer coating liquid, which was fed to a coating die with a rate of 8.9 ml/$m^2$.

The coating liquid had a viscosity of 58 [mPa·s] in a measurement with a Brookfield viscosimeter (rotor No. 1, 60 rpm) at 40° C.

3) Preparation of Coating Liquid for First Surface Protective Layer 100 g of inert gelatin and 10 mg of benzoisothiazolinone were dissolved in 840 ml of water, then 180 g of a 19 mass % latex liquid of methyl methacrylate/styrene/butyl acrylate/hydroxyethyl methacrylate/acrylic acid copolymer (copolymerizing mass ratio: 57/8/28/5/2), 46 ml of a 15 mass % methanol solution of phthalic acid, 5.4 ml of a 5 mass % aqueous solution of sodium di(2-ethylhexyl)sulfosuccinate were mixed, and after addition of 40 ml of a 4 mass % solution of chromium alum by a static mixer immediately before coating, the mixture was fed to a coating die with a coating liquid amount of 26.1 ml/$m^2$.

The coating liquid had a viscosity of 20 [mPa·s] in a measurement with a Brookfield viscosimeter (rotor No. 1, 60 rpm) at 40° C.

4) Preparation of Coating Liquid for Second Surface Protective Layer 100 g of inert gelatin and 10 mg of benzoisothiazolinone were dissolved in 800 ml of water, then 8.0 g of liquid paraffin emulsion as a liquid paraffin, 180 g of a 19 mass % latex liquid of methyl methacrylate/styrene/butyl acrylate/hydroxyethyl methacrylate/acrylic acid copolymer (copolymerizing mass ratio: 5718/28/5/2), 40 ml of a 15 mass % methanol solution of phthalic acid, 5.5 ml of a 1 mass % solution of a fluorine-type surfacant (F-1), 5.5 ml of a 1 mass % aqueous solution of a fluorine-type surfacant (F-2), 28 ml a 5 mass % aqueous solution of sodium di(2-ethylhexyl) sulfosuccinate, 4 g of of polymethyl methacrylate fine particles (average particle size 0.7 μm), and 21 g of of polymethyl methacrylate fine particles (average particle size 4.5 μm), were added to form a coating liquid for a surface protective layer, which was fed to a coating die with a rate of 8.3 ml/$m^2$.

The coating liquid had a viscosity of 19 [mPa·s] in a measurement with a Brookfield viscosimeter (rotor No. 1, 60 rpm) at 40° C.

3. Preparation of Photothermographic Materials-1 to -3

Samples of the photothermographic material were prepared by simultaneous multi-layer coatings by a slide bead coating method on a side opposite to the back side, in an order, from the undercoated surface, of an image forming layer, an intermediate layer, a first surface protective layer, and a second surface protective layer. In this operation, the temperature was controlled at 31° C. for the coating liquids of the image forming layer and the intermediate layer, 36° C. for the coating liquid of the first surface protective layer and 37° C. for the coating liquid of the second surface protective layer.

In the image forming layer, each compound therein had a following coating amount (g/$m^2$):

| | |
|---|---|
| silver behenate (as Ag) | 1.31 |
| pigment-1 (C.I. Pigment Blue 60) | 0.036 |
| organic polyhalogen compound-1 | 0.10 |
| organic polyhalogen compound-2 | 0.15 |
| phthalazine compound-1 | 0.18 |
| SBR latex | 9.70 |
| reducing agent-1 to -3(shown in Table 1) | 0.80 |
| hydrogen bond-forming compound-1 | 0.58 |
| development accelerator-1 | 0.04 |
| mercapto compound-1 | 0.002 |

-continued

| | |
|---|---|
| mercapto compound-2 | 0.012 |
| silver halide (as Ag) | 0.10 |

Coating and drying conditions were as follows.

The coating was executed with a speed of 160 m/min, with a gap between a front end of the coating die and the support within 0.10 to 0.30 mm, a pressure in a reduced-pressure chamber maintained lower than the atmospheric pressure by 196 to 882 Pa. The support was subjected to charge elimination by an ionized air flow before coating.

The coating liquids were cooled in a succeeding chilling zone with an air flow of a dry bulb temperature of 10 to 20° C., and, after a non-contact transportation, drying was executed on a non-contact spiral drying apparatus with a drying air flow of a dry bulb temperature of 23 to 45° C. and a wet bulb temperature of 15 to 21°.

After the drying, a humidity adjustment was executed at a temperature of 25° C. and in a humidity of 40 to 60% RH, and the film surface was then heated to 70 to 90° C., and thereafter, the film surface being cooled to 25° C.

The photothermographic material thus prepared had a matting degree, represented by Beck's smoothness, of 550 seconds on the side of the photosensitive layer and 130 seconds on the back side. Also the side of the photosensitive layer had a film pH of 6.0.

4. Evaluation of Photographic Performance

1) Preparation

An obtained sample was cut into a folio size (about 35×43 cm), then packed in a following packaging material in an environment of 25° C. and 50% RH, and subjected to following evaluations after storage for two weeks at the normal temperature.

2) Packaging Material

A sheet of PET 10 μm/PE 12 μm/aluminum foil 9 μm/nylon 15 μm/polyethylene 50 μm containing 3 mass % of carbon;

oxygen permeation rate: 0.02 ml/atm·$m^2$·25° C.·day, moisture permeation rate: 0.10 g/atm·$m^2$·25° C.·day.

3) Exposure and Thermal Development Conditions for Photosensitive Material

In an image recording apparatus of a structure shown in FIG. 1, the photothermographic materials-1 to -3 were exposed with a semiconductor laser of 660 nm and thermally developed (14 seconds in total with three panel heaters set at 112° C.-119° C.-121° C.), with a distance from the laser irradiation unit to the entrance part of the thermal development unit set at values shown in Table 1, by regulating a length of a guide plate 32.

4) Evaluation of Photographic Performance in Continuous Processing of 20 Sheets

The photothermographic materials-1 to -3 were exposed and thermally developed under the aforementioned conditions in continuous manner for 20 sheets, and sensitivities in 1st, 5th, 10th and 20th sheets are shown in Table 1.

A sensitivity (S) is a reciprocal of an exposure amount providing a black density of 1.0 over a fog level, and is represented by a relative value, taking a sensitivity of a first sheet of the photothermographic material-2 as 100. A larger number indicates a higher sensitivity.

As is apparent from Table 1, the photothermographic material-1 showed a decrease of the sensitivity with an increase in the number of processed sheets when a distance between the laser exposure unit and the thermal developing unit was made shorter. A distance of 75 cm or larger, preferably 100 cm or larger was necessary for obtaining a stable sensitivity, so that a compact designing of the apparatus was difficult. On the other hand, the photothermographic materials-2 and -3 of the invention provided a preferred result as an extremely small change in the sensitivity equal to or less than 1%, even when this distance is selected as 45 cm.

TABLE 1

| Experiment No. | Photothermographic material | Reducing agent | Path length from scanning line of laser irradiating means to inserting portion of thermal development unit (cm) | Sensitivity (S) 1st | 5th | 10th | 15th | 20th | Remarks |
|---|---|---|---|---|---|---|---|---|---|
| 1 | Photothermographic material-1 | reducing agent-1 | 45 | 105 | 104 | 98 | 90 | 80 | Comparative Example |
| 2 | Photothermographic material-1 | reducing agent-1 | 55 | 105 | 104 | 101 | 95 | 88 | Comparative Example |
| 3 | Photothermographic material-1 | reducing agent-1 | 75 | 105 | 105 | 104 | 104 | 104 | Comparative Example |
| 4 | Photothermographic material-1 | reducing agent-1 | 100 | 105 | 105 | 105 | 105 | 105 | Comparative Example |
| 5 | Photothermographic material-2 | reducing agent-2 | 45 | 100 | 100 | 99 | 99 | 99 | Present Invention |
| 6 | Photothermographic material-2 | reducing agent-2 | 55 | 100 | 100 | 100 | 100 | 100 | Comparative Example |
| 7 | Photothermographic material-2 | reducing agent-2 | 75 | 100 | 100 | 100 | 100 | 100 | Comparative Example |
| 8 | Photothermographic material-2 | reducing agent-2 | 100 | 100 | 100 | 100 | 100 | 100 | Comparative Example |
| 9 | Photothermographic material-3 | reducing agent-3 | 45 | 102 | 102 | 101 | 101 | 101 | Present Invention |
| 10 | Photothermographic material-3 | reducing agent-3 | 55 | 102 | 102 | 102 | 102 | 102 | Comparative Example |
| 11 | Photothermographic material-3 | reducing agent-3 | 75 | 102 | 102 | 102 | 102 | 102 | Comparative Example |

TABLE 1-continued

| Experiment No. | Photothermographic material | Reducing agent | Path length from scanning line of laser irradiating means to inserting portion of thermal development unit (cm) | Sensitivity (S) 1st | 5th | 10th | 15th | 20th | Remarks |
|---|---|---|---|---|---|---|---|---|---|
| 12 | Photothermographic material-3 | reducing agent-3 | 100 | 102 | 102 | 102 | 102 | 102 | Comparative Example |

These results indicate that the invention provides an image forming method capable of forming a stable image on a photothermographic material by a laser exposure and a thermal development in a compacter image recording apparatus.

Example 2

1) Film Formation

A PET support was prepared, and a back layer, an image forming layer, an intermediate layer and a surface protective layer were prepared in the identical manner as in Example 1.

2) Preparation of Fatty Acid Silver Salt Dispersion B

<<Preparation of Recrystallized Behenic Acid>>

100 kg of behenic acid (trade name: Edenor C22-85R manufactured by Henkel Co.) were mixed with 1200 kg of isopropyl alcohol, dissolved therein at 50° C., then filtered with a filter of 10 μm and recrystallized by cooling to 30° C. A cooling speed at the recrystallization was controlled at 3° C./hr. The obtained crystals were filtered by centrifuging, washed by pouring 100 kg of isopropyl alcohol, and dried. The obtained crystals, in a GC-FID measurement after esterification, had a behenic acid content of 96 mol %, and also contained lignoceric acid by 2 mol %, arachidic acid by 2 mol % and erucic acid by 0.001 mol %.

<<Preparation of Fatty Acid Silver Salt Dispersion B>>

88 kg of recrystallized behenic acid, 422 L of distilled water, 49.2 L of a concentration of 5 mol/L of aqueous solution of NaOH, and 120 L of t-butyl alcohol were mixed and reacted for 1 hour at 75° C. under agitation to obtain a sodium behenate solution B. Separately, 206.2 L of an aqueous solution (pH 4.0) of 40.4 kg of silver nitrate were prepared and maintained at 10° C. A reaction vessel containing 635 L of distilled water and 30 L of t-butyl alcohol was maintained at 30° C., and the entire amount of the sodium behenate solution B and the entire amount of the silver nitrate solution were added under sufficient agitation with constant flow rates, respectively over 93 minutes and 15 seconds and over 90 minutes. In this operation, during 11 minutes from the start of the addition of the silver nitrate solution, the silver nitrate solution alone was added, then the addition of the sodium behenate solution B was started, and, during 14 minutes and 15 seconds after the end of addition of the silver nitrate solution, the sodium behenate solution B alone was added. In this operation, the temperature in the reaction vessel was maintained at 30° C., and the external temperature was so controlled as to maintain a constant liquid temperature. Also a piping for adding the sodium behenate solution B was temperature controlled by circulating warm water in an outer jacket of double tubes, thereby adjusting the liquid temperature at an exit end of the addition nozzle at 75° C. Also a piping for adding the silver nitrate solution was temperature controlled by circulating cold water in an outer jacket of double tubes. A position of addition of the sodium behenate solution B and a position of addition of the silver nitrate solution were symmetrically positioned with respect to an agitating shaft, and were adjusted at such a height not touching the reaction liquid.

After the end of addition of the sodium behenate solution B, the reaction liquid was let to stand for 20 minutes at a same temperature and under agitation, then heated to 35° C. over a period of 30 minutes, and was thereafter ripened for 210 minutes. Immediately after the end of the ripening, solid was separated by a centrifuged filtration and was washed with water until the conductivity of filtered water reached 30 μS/cm. A fatty acid silver salt was obtained in this manner. The obtained solid was not dried but stored in a wet cake.

A shape of the obtained silver behanate grains was evaluated by electron photomicrographs. There were identified crystals with average values a=0.21 μm, b=0.4 μm and c=0.4 μm, an average aspect ratio of 2.1, and a variation factor of the sphere-corresponding diameter of 11% (a, b and c being defined in the present specification).

To the wet cake corresponding to 260 kg of dry solid, 19.3 kg of polyvinyl alcohol (trade name: PVA-217) and water were added to a total amount of 1000 kg, then the mixture was made in a slurry by fins of a dissolver and further pre-dispersed by a pipeline mixer (model PM-10; manufactured by Mizuho Kogyo Co.).

Then the pre-dispersed liquid was treated three times in a disperser (trade name: Microfluidizer M-610, manufactured by Microfluidics International Corporation; with a Z-type interaction chamber) with a pressure adjusted to 1150 kg/cm$^2$, thereby obtaining a silver behenate dispersion. A cooling operation was carried out under a dispersion temperature of 18° C. by mounting spiral-piped heat exchangers in front of and behind the interaction chamber and regulating the temperature of a coolant.

3) Preparation of Reducing Agent Dispersion

<<Preparation of Reducing Agent-1 Dispersion>>

10 kg of a comparative reducing agent-1 (Red-3), 16 kg of a 10 mass % aqueous solution of denatured polyvinyl alcohol (Poval MP203, manufactured by Kuraray Co.), and 10 kg of water were added and mixed well to obtain a slurry. The slurry was fed by a diaphragm pump, then dispersed for 3 hours in a horizontal sand mill (UVM-2; manufactured by Imex Co.) filled with zirconia beads of an average diameter of 0.5 mm, and 0.2 g of sodium benzoisothiazolinone and water were added to obtain a concentration of the reducing agent of 25 mass %. The dispersion was heated for 1 hour at 80° C. to obtain a reducing agent-1 dispersion. The reducing agent particles contained in thus obtained reducing agent dispersion had a median diameter of 0.35 μm and a maximum particle size of 1.4 μm or less. The obtained reducing agent dispersion was stored after a filtration with a polypropylene filter of a pore size of 3.0 μm, for eliminating foreign substances such as dusts.

<<Preparation of Dispersions of Reducing Agent R1-8 of the Invention and Other Reducing Agents of the Invention>>

These were prepared in the same manner as the dispersion of the reducing agent-1 (Red-3).

Specifically, in the identical manner as in Example 1, a hydrogen bond-forming compound-1 dispersion was prepared, and a development accelerator-1 dispersion and a development accelerator-2 solid dispersion were obtained. Also a solid dispersion of the toning agent-1 was dispersed in a similar manner as the development accelerator-1 to obtain a 15 mass % dispersion liquid. Also preparations of a polyhalogen compound, a phthalazine compound-1 solution, a mercapto compound-2 aqueous solution, a pigment-1 dispersion and an SBR latex liquid were executed in the same manner as in Example 1.

2. Preparation of Coating Liquid

1) Preparation of Coating Liquid for Image Forming Layer 1000 g of the aforementioned fatty acid silver salt dispersion B, 135 ml of water, 36 g of the pigment-1 dispersion, 25 g of the organic polyhalogen compound-1 dispersion, 39 g of the organic polyhalogen compound-2 dispersion, 171 g of the phthalazine-1 compound solution, 1060 g of the SBR latex liquid (Tg: 17° C.), 180 g of the reducing agent-1 dispersion, 55 g of the hydrogen bond-forming compound-1 dispersion, 4.8 g of the development accelerator-1 dispersion, 2.6 g of the development accelerator-2 dispersion, 2.1 g of the toning agent-1 dispersion, and 8 ml of the mercapto compound-2 aqueous solution were added in succession, and 140 g of the mixed emulsion A for the coating liquid were added and mixed well immediately before coating to obtain a coating liquid for image forming layer, which was fed to a coating die.

The coating liquid for image forming layer had a viscosity of 40 [mPa·s] in a measurement with a Brookfield viscosimeter manufactured by Tokyo Keiki(rotor No. 1, 60 rpm) at 40° C.

The coating liquid has a viscosity, measured with Rheo-Stress RS150 manufactured by Haake Co. at 38° C., of 30, 43, 41, 28 and 20 [mPa·s] respectively at shearing speeds of 0.1, 1, 10, 10 and 1000 [1/sec].

The coating liquid has a zirconium content of 0.30 mg per 1 g of silver.

2) Preparation of Coating Liquids

Coating liquids for an intermediate layer, a first surface protective layer and a second surface protective layer were prepared in the identical manner as in Example 1.

3. Preparation of Photothermographic Material-4

1) Preparation of Photothermographic Material-4

A sample of the photothermographic material was prepared by simultaneous superposed coatings by a slide bead coating method on a side opposite to the back side, in an order, from the undercoated surface, of an image forming layer using the coating liquid for image forming layer, an intermediate layer, a first surface protective layer, and a second surface protective layer. In this operation, the temperature was controlled at 31° C. for the coating liquids of the image forming layer and the intermediate layer, 36° C. for the coating liquid of the first surface protective layer and 37° C. for the coating liquid of the second surface protective layer.

In the image forming layer, each compound therein had a following coating amount (g/m$^2$):

| | |
|---|---|
| silver behenate | 5.27 |
| pigment (C.I. Pigment Blue 60) | 0.036 |
| polyhalogen compound-1 | 0.12 |
| polyhalogen compound-2 | 0.25 |
| phthalazine compound-1 | 0.18 |
| SBR latex | 9.43 |
| reducing agent-1 (Red-3) | 0.92 |
| hydrogen bond-forming compound-1 | 0.28 |
| development accelerator-1 | 0.015 |
| development accelerator-2 | 0.008 |
| toning agent-1 | 0.006 |
| mercapto compound-2 | 0.003 |
| silver halide (as Ag) | 0.13 |

Coating and drying conditions were same as in Example 1.

The photothermographic material thus prepared had a matting degree, represented by Beck's smoothness, of 550 seconds on the side of the photosensitive layer and 130 seconds on the back side. Also the side of the photosensitive layer had a film pH of 6.0.

In the following, there are shown chemical structures of compounds employed in the examples of the invention.

Spectral Sensitizing Dye A

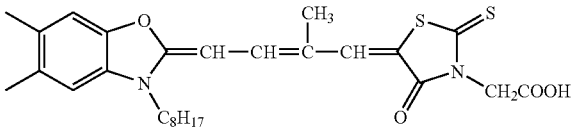

Spectral Sensitizing Dye B

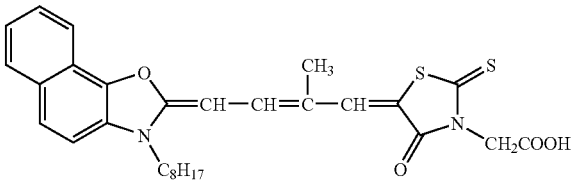

Tellurium Sensitizer C

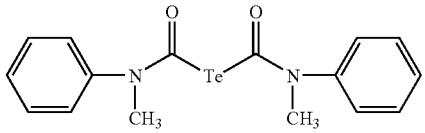

Base Precursor Compound-1

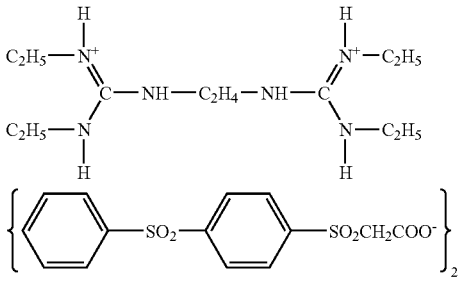

-continued
Cyanine Dye Compound-1
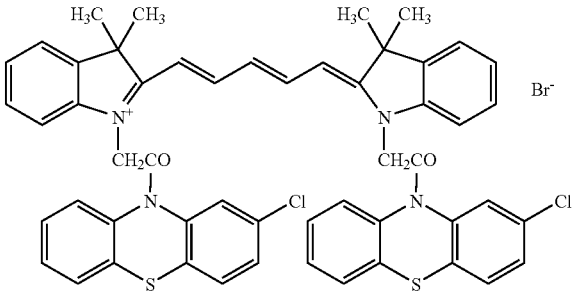
Blue Dye Compound-1
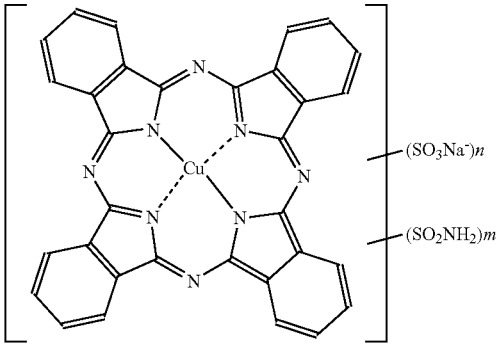
n = 0.5~2.0
m = 0.5~2.5
Yellow Dye Compound-1
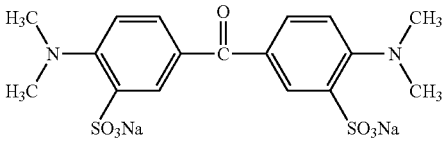
Reducing Agent-1
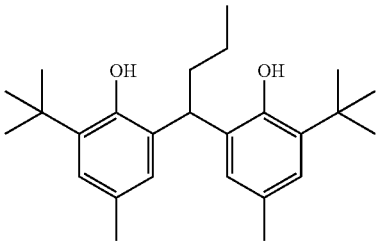
Hydrogen Bond-Forming Compound-1
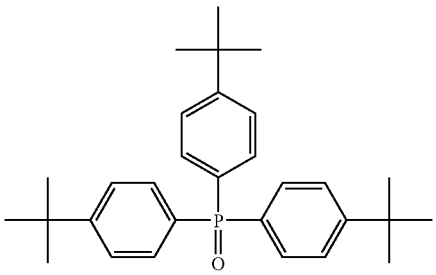
Polyhalogen Compound-1
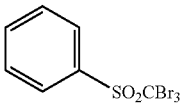
-continued
Polyhalogen Compound-2
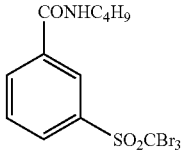
Mercapto Compound-1
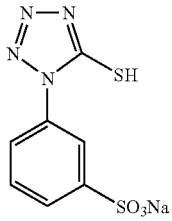
Mercapto Compound-2
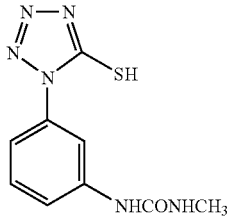
Phthalazine Compound-1
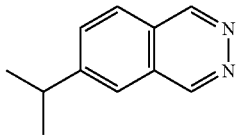
Development Accelerator-1
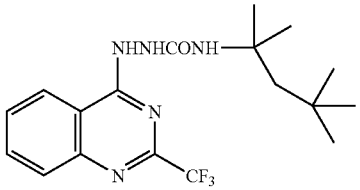
Development Accelerator-2
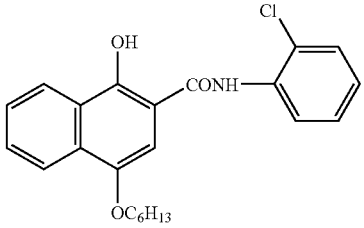
Color Tone Controlling Agent-1
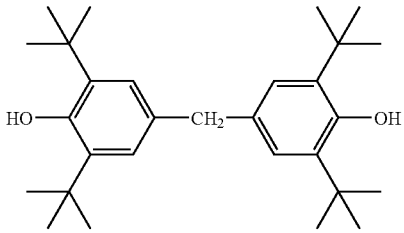

$CF_3(CF_2)_nCH_2CH_2SCH_2CH_2COOLi$ (F-1)

a mixture of n=5 to 11

$CF_3(CF_2)_nCH_2CH_2O(CH_2CH_2O)_mH$ (F-2)

a mixture of n=5 to 11, and m=5 to 15

A photothermographic material-2 was prepared in the manner as the photothermographic material-4 except for employing a reducing agent dispersion in which the reducing agent-1 (Red-3) was changed to R1-8 shown in Table 2.

An obtained sample was cut into a folio size (about 35×43 cm), then packed in a following packaging material in an environment of 25° C. and 50% RH, and subjected to following evaluations after storage for two weeks at the normal temperature.

<Packaging Material>

A sheet of PET 10 μm/PE 12 μm/aluminum foil 9 μm/nylon 15 μm/polyethylene 50 μm containing 3 mass % of carbon;

oxygen permeation rate: 0.02 ml/atm·$m^2$·25° C.·day, moisture permeation rate: 0.10 g/atm·$m^2$·25° C.·day.

4. Exposure and Development Conditions for Photosensitive Material 4 and 5

The photothermographic materials 4 and 5 were uniformly exposed with a semiconductor laser of 660 nm so as to obtain a density 1.0. A thermal developing unit of a Fuji medical dry laser imager DRYPIX 7000 was modified and replaced by a thermal development of heat drum type. The heat drum had a metal thickness of 6 mm, and a control was executed to obtain a constant temperature on the heat drum with a 3-divided heater of 1200 W. A comparative developing condition 1 and a developing condition 2 of the invention are shown in the following.

Comparative Example

<Developing Condition 1>

A thermal development was executed by contacting a photosensitive material with a half of an external periphery of 471 mm of the heat drum of a diameter of 150 mm, with a transporting speed of 17.4 mm/sec for the photosensitive material. A thermal development time was 13.5 seconds, and an interval time from separation of the photosensitive material from a part of the thermal development unit to contact with a next photosensitive material was 13.5 seconds. The heat drum was maintained at a constant thermal developing temperature of 121° C.

Under such developing conditions, 100 folio-sized photosensitive materials were developed in succession at a rate of one sheet for every 30 seconds. A development time required for processing 100 sheets was about 50 minutes.

<Developing Condition 2> Present Invention

A thermal development was executed by contacting a photosensitive material with 70% of an external periphery of 471 mm of the heat drum of a diameter of 150 mm, with a transporting speed of 24.4 mm/sec for the photosensitive material. A thermal development time was 13.5 seconds, and an interval time from separation of the photosensitive material from a part of the thermal development unit to contact with a next photosensitive material was 5.8 seconds. The heat drum was maintained at a constant thermal developing temperature of 121° C.

Under such developing conditions, 100 folio-sized photosensitive materials were developed in succession at a rate of one sheet for every 20 seconds. A development time required for processing 100 sheets was about 34 minutes.

5. Evaluation

Uniformity in density and uniformity in color tone (density uniformity evaluation-1) within one folio-sized sheet of the photosensitive material, and uniformity in density and uniformity in color tone (density uniformity evaluation-2) from the first to the last of 100 sheets were visually evaluated. Obtained results are shown in Table 2.

In the experiments 13 to 16 in Table 2, the first photosensitive material in the thermal development had a hue angle of 260°.

<Density Uniformity Evaluation 1>

A: no visual unevenness in density in all the sheets

B: uneven density observed in several sheets, but practically acceptable

C: uneven density observed in 10 or more sheets, but slight level

D: uneven density observed in half or more of sheets, and a tolerable level is exceeded in several sheets.

<Density Uniformity Evaluation 2>

A: scarce difference in density and color tone among the sheets

B: slight color tone difference observed between sheets, but difference is only noticeable in careful observation on sheets placed side-by-side, and practically no problem C: apparent difference in density and color tone between the sheets, a limit of acceptable level D: large difference in density among sheets, not permissible.

TABLE 2

| Experiment No. | Photosensitive Material (reducing agent) | Developing condition (interval time) | Density uniformity evaluation 1 | Density uniformity evaluation 2 | Remarks |
|---|---|---|---|---|---|
| 13 | Photosensitive material 4 (Red-3) | Developing condition 1 (13.5 sec) | A | B | Comparative Example |
| 14 | Photosensitive material 5 (R1–8) | Developing condition 1 (13.5 sec) | A | A | Comparative Example |
| 15 | Photosensitive material 4 (Red-3) | Developing condition 2 (5.8 sec) | D | D | Comparative Example |
| 16 | Photosensitive material 5 (R1–8) | Developing condition 2 (5.8 sec) | B | B | Present Invention |

As will be apparent from Table 2, the photosensitive material 5 utilizing the reducing agent of the invention provides a high stability in color tone and density even in a rapid processing condition with a short interval time.

Example 3

1. Preparation, Exposure and Developing Conditions of Photothermographic Materials-6 to -10

Photothermographic materials-6 to -10 were prepared in the same manner as in Example 2 except the reducing agent was changed as shown in Table 3. Also exposure was executed in the same manner as in Example 2.

Developing conditions were same as in Example 2, except that that developing condition 2 of Example 2 were changed to following developing condition 3.

<Developing Condition 3> Present Invention

A thermal development was executed by contacting a photosensitive material with 60% of an external periphery of 565 mm of the heat drum of a diameter of 180 mm, with a transporting speed of 25.1 mm/sec for the photosensitive material. A thermal development time was 13.5 seconds, and an interval time from separation of the photosensitive material from a part of the thermal development unit to contact with a next photosensitive material was 9 seconds. The heat drum was maintained at a constant thermal developing temperature of 121° C.

Under such developing conditions, 100 folio-sized photosensitive materials were developed in succession at a rate of one sheet for every 20 seconds. A development time required for processing 100 sheets was about 34 minutes.

2. Evaluation

Thermal development was executed with the developing condition 2 described in Example 2 and the developing condition 3, and uniformity in density and uniformity in color tone (density uniformity evaluation-1), and uniformity in density and uniformity in color tone (density uniformity evaluation-2) were conducted as in Example 2. Obtained results are shown in Table 3.

TABLE 3

| Experiment No. | Photosensitive Material (reducing agent) | Developing condition (interval time) | Density uniformity evaluation 1 | Density uniformity evaluation 2 | Remarks |
|---|---|---|---|---|---|
| 17 | Photosensitive material 4 (Red-3) | Developing condition 3 (9 sec) | D | C | Comparative Example |
| 18 | Photosensitive material 5 (R1–8) | Developing condition 3 (9 sec) | A | B | Present Invention |
| 19 | Photosensitive material 6 (R1–31) | Developing condition 3 (9 sec) | A | A | Present Invention |
| 20 | Photosensitive material 7 (R1–45) | Developing condition 3 (9 sec) | A | A | Present Invention |
| 21 | Photosensitive material 8 (R1–11) | Developing condition 3 (9 sec) | B | B | Present Invention |
| 22 | Photosensitive material 9 (R2–21) | Developing condition 3 (9 sec) | A | B | Present Invention |
| 23 | Photosensitive material 10 (R2–17) | Developing condition 3 (9 sec) | A | A | Present Invention |
| 24 | Photosensitive material 11 (R1–11) | Developing condition 2 (5.8 sec) | B | C | Present Invention |
| 25 | Photosensitive material 12 (R2–21) | Developing condition 2 (5.8 sec) | A | B | Present Invention |
| 26 | Photosensitive material 13 (R2–17) | Developing condition 2 (5.8 sec) | A | B | Present Invention |

As is apparent from thr results shown in Table 3, the comparative examples showed an ununiform density within one folio-sized sheet of the photosensitive material in half or more of the sheets, and showed an apparent difference in color tone and density between the sheets, whereby that ununiformity in density and color tone was confirmed in both cases.

On the other hand, it is understood that use of the reducing agent of the invention provides excellent stability in density and color tone. Also among the reducing agents of the invention represented by formula (R1) or (R2), it is particularly preferable that either one of $R^1$ and $R^{1'}$ is a secondary or tertiary alkyl group.

Example 4

1. Preparation, Exposure and Developing Conditions of Photothermographic Materials-11 to -14 (Present Invention) and -15 to -18 (comparative example)

Photosensitive materials-11 to -14 were prepared in the same manner as in the photosensitive material-4 in Example 2, except that the reducing agent and the silver coating amount were changed to those shown in Table 4.

Separately, photosensitive materials-15 to -18 were prepared in the same manner as in the photosensitive material-4 in Example 2, except the the silver coating amount were changed to those shown in Table 4.

The silver coating amount was obtained by changing the coating amount of the image forming layer coating liquid. The silver coating amount is shown by a sum of silver amounts derived from the fatty acid silver salt and the silver halide.

2. Evaluation

Thermal development was executed with the developing condition 3 described in Example 3, and uniformity in density and uniformity in color tone (density uniformity evaluation-1), and uniformity in density and uniformity in color-tone (density uniformity evaluation-2) were evaluated as in Example 2. Obtained results are in Table 4.

TABLE 4

| Experiment No. | Photosensitive Material (reducing agent) | Silver coat amount ($g/m^2$) | Developing Condition (interval time) | Density Uniformity Evaluation 1 | Density Uniformity Evaluation 2 | Remarks |
|---|---|---|---|---|---|---|
| 27 | Photosensitive material 11 (R1–21) | 1.3 | Developing condition 3 (9 sec) | A | B | Present Invention |
| 28 | Photosensitive material 12 (R1–21) | 1.6 | Developing condition 3 (9 sec) | B | B | Present Invention |
| 29 | Photosensitive material 13 (R1–21) | 1.8 | Developing condition 3 (9 sec) | C | B | Present Invention |
| 30 | Photosensitive material 14 (R1–21) | 2.1 | Developing condition 3 (9 sec) | C | C | Present Invention |
| 31 | Photosensitive material 15 (Red-3) | 1.3 | Developing condition 3 (9 sec) | D | C | Comparative Example |
| 32 | Photosensitive material 16 (Red-3) | 1.6 | Developing condition 3 (9 sec) | D | C | Comparative Example |
| 33 | Photosensitive material 17 (Red-3) | 1.8 | Developing condition 3 (9 sec) | D | C | Comparative Example |
| 34 | Photosensitive material 18 (Red-3) | 2.1 | Developing condition 3 (9 sec) | D | D | Comparative Example |

As is apparent from Table 4, the photosensitive material using the reducing agent of the invention exhibits a particularly preferable effect even in a low silver coating amount.

As detailed above, the present invention can provide an image forming method that may be subjected to rapid processing using the photothermographic material, is excellent in density stability and color tone of images, and is capable of forming a stable image even at rapid processing.

What is claimed is:

1. An image forming method comprising:

providing an image recording apparatus comprising a laser irradiating means for laser scanning of a photothermographic material and a conveying means for guiding the laser scanned photothermographic material in a sub-scanning direction to a thermal development unit, providing a photothermographic material that has a support and includes on at least one surface thereof a photosensitive silver halide, a non-photosensitive organic silver salt, a reducing agent and a binder; and forming an image by using the image recording apparatus to laser scan the photothermographic material, convey the photothermographic material to the thermal development unit and thermally develop the photothermographic material, wherein a distance between scanning exposure position of the photothermographic material and an inserting portion of the thermal development unit is equal to or shorter than 40 cm, and the reducing agent is at least one selected from the group of compounds represented by the following formula (R1):

Formula (R1)

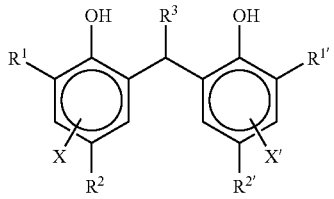

wherein, in formula (R1), $R^1$ and $R^{1'}$ each independently represents an alkyl group having 1 to 20 carbon atoms; $R^2$ and $R^{2'}$ each independently represents a hydrogen atom or a substituent for a benzene ring; $R^3$ represents a substituent for forming a 3- to 7-membered ring composed of atoms selected from a carbon atom, an oxygen atom, a nitrogen atom, a sulfur atom and a phosphor atom; and X and X' each independently represents a hydrogen atom or a substituent for a benzene ring; and compounds represented by the following formula (R2):

Formula (R2)

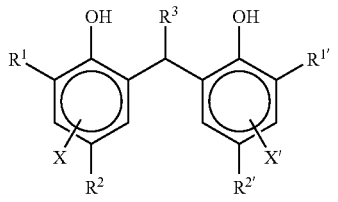

wherein, in formula (R2), $R^1$ and $R^{1'}$ each independently represents an alkyl group having 1 to 20 carbon atoms; $R^2$ and $R^{2'}$ each independently represents a hydrogen atom or a substituent for a benzene ring; $R^3$ represents an alkenyl group or an alkyl group having a substituent having an unsaturated bond; and X and X' each independently represents a hydrogen atom or a substituent for a benzene ring.

2. The image forming method according to claim 1, wherein the photothermographic material has a silver coating amount of 1.9 g or less per $m^2$ of the photothermographic material.

3. The image forming method according to claim 2, wherein thermal development is carried out with a thermal developing time ranging from 6 to 14 seconds.

4. The image forming method according to claim 1, wherein thermal development is carried out with a thermal developing time ranging from 6 to 14 seconds.

5. The image forming method according to claim 1, wherein thermal development is carried out at a temperature ranging from 80 to 250° C.

6. The image forming method according to claim 1, wherein thermal development is carried out at a temperature ranging from 110 to 130° C.

7. The image forming method according to claim 1, wherein thermal development is carried out using a plate heater.

* * * * *